US007223216B1

(12) United States Patent
McBride

(10) Patent No.: US 7,223,216 B1
(45) Date of Patent: May 29, 2007

(54) EXERCISER WITH MULTIPLE BUNGEE CORD RESISTANCE AND ENHANCED BENCH MOVEMENTS

(75) Inventor: Robert W. McBride, Springfield, MO (US)

(73) Assignee: Stamina Products, Inc., Springfield, MO (US)

( * ) Notice: Subject to any disclaimer, the term of this patent is extended or adjusted under 35 U.S.C. 154(b) by 600 days.

(21) Appl. No.: 10/623,177

(22) Filed: Jul. 21, 2003

Related U.S. Application Data

(63) Continuation-in-part of application No. 09/738,317, filed on Dec. 18, 2000, now Pat. No. 6,595,905.

(51) Int. Cl.
*A63B 21/00* (2006.01)

(52) U.S. Cl. ..... 482/121; 482/130; 482/142

(58) Field of Classification Search ..... 482/121, 482/127, 130, 142, 92, 30–32, 51, 72; D21/662
See application file for complete search history.

(56) References Cited

U.S. PATENT DOCUMENTS 4,620,704 A * 11/1986 Shifferaw ..... 482/130
4,634,127 A 1/1987 Rockwell
5,468,205 A 11/1995 McFall et al.
5,674,167 A 10/1997 Piaget et al.
5,906,566 A 5/1999 Whitcomb
6,585,626 B2 * 7/2003 McBride ..... 482/130
6,683,607 B1 * 1/2004 Matsuda et al. ..... 345/419
7,060,012 B2 * 6/2006 Howell et al. ..... 482/121

OTHER PUBLICATIONS

IMPEX Bodyflex Gym WM 1407 Owner's Manual, IMPEX Fitness Products, Jun. 4, 2002, City of Industry, CA.
Bowflex Fitness Assembly Manual for the Bowflex Ultimate, Bowflex, Inc., Vancouver, WA.
Bowflex Power Pro Assembly Manual, Bowflex, Inc., Vancouver, WA.
Bowflex Motivator Assembly Instructions, Bowflex, Inc., Vancouver, WA.

* cited by examiner

*Primary Examiner*—Jerome Donnelly
(74) *Attorney, Agent, or Firm*—Pillsbury Winthrop Shaw Pittman LLP

(57) ABSTRACT

An exerciser includes a frame assembly including a lower frame portion constructed and arranged to be stably supported in an operative position on a horizontal surface and rigid upright frame structure defining laterally spaced left and right free end portions. A user support assembly is operatively connected with the lower frame portion and is constructed and arranged to support a user thereon. Left and right moving assemblies are disposed in normal inoperative positions with respect to the user support assembly constructed and arranged to be manually engaged and individually manually moved away from the normal inoperative position thereof into a desired extended position by a user supported on the user support assembly.

50 Claims, 32 Drawing Sheets

EXERCISER WITH MULTIPLE BUNGEE CORD RESISTANCE AND ENHANCED BENCH MOVEMENTS

CROSS-REFERENCE TO RELATED APPLICATION

This application claims the benefit of U.S. patent application Ser. No. 09/738,317, entitled "EXERCISER WITH MULTIPLE BUNGEE CORD RESISTANCE AND ENHANCED BENCH MOVEMENTS," McBride, and filed Dec. 18, 2000, now U.S. Pat. No. 6,595,905, the contents of which are incorporated herein by reference in their entirety.

FIELD OF THE INVENTION

This invention relates generally to exercisers and more specifically to exercisers with multiple resistance and bench movements that enable a user to perform various different exercises.

BACKGROUND AND SUMMARY OF THE INVENTION

Recent years have seen an increasing awareness of the benefits of physical exercise and widespread use of exercisers. The therapeutic value of progressive resistance exercises has long been recognized. Exercising muscles against progressively increasing resistance not only results in added strength and endurance in the muscles, but also in a more efficient functioning of the cardiovascular and respiratory systems.

Various types of exercisers have been suggested which use elastomeric members such as resistance bands to provide non-gravity resistance to the performance of the exercises.

One such exerciser is described in U.S. Pat. No. 5,674,167 issued to Piaget et al. The exerciser taught by Piaget et al. includes a first plurality of resistance cords for providing resistance to pivotal movement of first and second arm members and a second plurality of resistance cords for providing resistance to a leg member. Each plurality of resistance cords are releasably secured to a fixed anchor such that the first plurality of resistance cords provides resistance to the arm members independently from the resistance provided by the second plurality of resistance cords to the leg member. A user may exercise his/her arms and legs without complex maneuvering or adjustments to the exercise machine as taught by Piaget et al. However, varying the resistance by using elastomeric resistance as taught by Piaget et al. involves adding or subtracting individual resistance cords to the apparatus, which can be both burdensome and time consuming. Further, since the resistance cords are typically separate units, they can be lost or misplaced, increasing costs for replacement, and frequently are strewn about the apparatus in a manner to create substantial tripping hazards.

Another such exerciser is described in U.S. Pat. No. 5,906,566 issued to Whitcomb. The exerciser taught by Whitcomb includes a single plurality of resistance elements for either providing resistance to handle grips or to a leg unit which are connected to opposite ends of the resistance elements. Whitcomb provides an exercise machine having a single plurality of resistance elements, which are not removed from the exercise machine during normal usage, thus eliminating the risks and cost described above with respect to loose resistance elements. Even though the exercise machine is relatively versatile, it includes numerous pivotally movable components, which can be relatively bulky and can require many steps to maneuver the exercise machine into various positions for effecting the different modes of exercise. These extra steps require extra time to move the exercise machine between different positions and can significantly lengthen the workout. Thus, the ability to maneuver the exerciser into various positions for effecting the different modes of exercise quickly is greatly desirable to help reduce unnecessary time between exercises.

While the cited prior art exercisers are effective for their intended purpose, there is always a continuing need for new and improved exercisers which are cost-effective, convenient for transportation and storage, versatile, capable of providing variable resistance and relatively easy to maneuver between various positions for effecting different modes of exercise.

To achieve this need, an exerciser comprising a frame assembly including a lower frame portion constructed and arranged to be stably supported in an operative position on a horizontal surface is provided. The frame assembly also includes rigid upright frame structure defines laterally spaced left and right free end portions. A user support assembly is operatively connected with the lower frame portion constructed and arranged to support a user thereon. Left and right moving assemblies are disposed in normal inoperative positions with respect to the user support assembly constructed and arranged to be manually engaged and individually manually moved away from the normal inoperative position thereof into a desired extended position by a user supported on the user support assembly.

The left and right moving assemblies comprise left and right upper pulley members rotatably mounted on the left and right upper free end portions of the rigid upright frame structure respectively and left and right lower pulley members rotatably mounted on the frame assembly at fixed positions below the upper pulley members respectively. The left and right moving assemblies also comprise left and right flexible elongated structures trained around the left and right upper and lower pulley members respectively and left and right user hand grip units connected with left and right end portions of the left and right flexible elongated structures extending in positions to enable a user supported on the user support assembly to move the left and right user hand grip units away from inoperative positions thereof into desired extended positions.

The left and right flexible elongated structures include left and right bungee cords having fixed ends and movable ends provided with stop structure thereon for engaging cooperating stop structure associated with left and right pulley members respectively so as to determine inoperative positions thereof and enable resilient movements therefrom to desired extended positions and to resiliently return the left and right user hand grip units to the inoperative positions thereof when no longer moved by the user.

Connecting structure is provided on the frame assembly which is constructed and arranged to enable the fixed end of the left and right bungee cords to be fixed in selected fixed positions on the frame assembly which provide selected different resilient bias of the bungee cords when in the inoperative and extended positions thereof.

Generally, exercisers of this type have been known to provide a user support assembly or bench for supporting users while they effect various different modes of exercise. Numerous exercisers that incorporate benches for providing support to users have heretofore been known in the art.

Some exercisers incorporate benches such as a split bench having a seat back and a seat member hingeably connected so that the bench can be adjusted for use in connection with both a flat bench position and a sitting position. Snyderman et al U.S. Pat. No. 5,069,447 represents an example of one such exerciser.

Other exercisers, especially those configured to provide multiple exercises or a bench which may be maneuvered between various positions may be cumbersome to transport and may take up a large area. One such exerciser, such as Rockwell U.S. Pat. No. 4,634,127, includes a bench assembly which may be moved into a storage position. The exercise machines taught by Piaget et al. and Whitcomb may also be moved into a storage position, but both exercise machines require a relatively complex series of movements and adjustments before being moved into the storage positions thereof.

Consequently, there exists a need in the art to provide an exerciser that is cost-effective, convenient for transportation and storage, versatile, and relatively easy to maneuver between various positions for effecting different modes of exercise.

Another aspect of the present invention is to provide an exerciser comprising a frame assembly that includes a lower frame portion constructed and arranged to be stablely supported in an operative position on a horizontal surface and left and right rigid upright support members fixed at lower end portions thereof on the lower frame portion. The left and right rigid upright support members extend upwardly from the lower frame portion when in the operative position thereof. The left and right rigid upright support members have integral laterally spaced left and right upper free ends disposed above the lower frame portion in outwardly diverging relation with respect to one another. A user support assembly is operatively connected with the lower frame portion and is constructed and arranged to support a user thereon. Left and right moving assemblies are disposed in normal inoperative positions with respect to the user support assembly and are constructed and arranged to be manually engaged and individually manually moved away from the normal inoperative position thereof into a desired extended position by a user supported on the user support assembly.

The left and right moving assemblies comprise left and right upper pulley members rotatably mounted on the left and right upper free end portions of the left and right rigid upright support members respectively and left and right lower pulley members rotatably mounted on the frame assembly at fixed positions below the upper pulley members respectively.

Left and right flexible elongated structures are trained around the left and right upper and lower pulley members respectively. Left and right user hand grip units are connected with left and right end portions of the left and right flexible elongated structures extending in positions to enable a user supported on the user support assembly to move the left and right user hand grip units away from inoperative positions thereof into desired extended positions.

The left and right flexible elongated structures include left and right bungee cords having fixed ends fixed directly to the frame structure and movable ends provided with stop structure thereon for engaging cooperating stop structure associated with left and right pulley members respectively so as to determine inoperative positions thereof and enable resilient movements therefrom to desired extended positions and to resiliently return the left and right user hand grip units to the inoperative positions thereof when no longer moved by the user.

Another aspect of the present invention is achieved by an exerciser that comprises a frame assembly including a lower frame portion constructed and arranged to be stablely supported in an operative position on a horizontal surface and left and right rigid upright support members fixed at lower end portions thereof on the lower frame portion. The left and right rigid upright support members extend upwardly from the lower frame portion when in the operative position thereof. The left and right rigid upright support members have integral laterally spaced left and right upper free ends disposed above the lower frame portion in outwardly diverging relation with respect to one another.

A user support assembly is operatively connected with the frame assembly and is constructed and arranged to support a user thereon. The user support assembly includes a user seat member, a user seat back member and an elongated support member having one end connected to the upright frame assembly and extending in an operative position generally horizontally outwardly therefrom. The user support assembly also includes an outer leg structure that is constructed and arranged to engage and be supported on the horizontal surface in spaced relation to the frame extending in an operative position in supporting relation with respect to the elongated support member to maintain the elongated support member in the generally horizontally outwardly extending relation from the lower frame portion. Seat mounting structure constructed and arranged to mount the user seat member for movement horizontally with respect to the elongated support member when in the operative position thereof between an outer position and a inner position and spaced inwardly of and at generally the same level as the outer position. Seat back mounting structure operatively associated with the seat back member that is constructed and arranged to enable the seat back member to be selectively retained in a bench position extending in generally horizontally aligned relation to the user seat member in an outer position thereof and an upright position extending generally inwardly in inclined relation to the user seat member in an inner position thereof.

The upright frame assembly includes a lower frame portion constructed and arranged to be stablely supported on a horizontal surface and an upstanding portion extending upwardly from the lower frame portion, and a seat support portion extending upwardly from the lower frame portion in horizontally spaced relation to the upstanding portion. The elongated support member is pivotally mounted on the seat support portion so as to be moved between the operative position thereof and an upright storage position wherein the elongated support member, the outer leg structure and the seat and seat back members are alongside the upstanding portion.

Left and right moving assemblies are disposed in normal inoperative positions with respect to the user support assembly and are constructed and arranged to be manually engaged and individually manually moved away from the normal inoperative position thereof into a desired extended position by a user supported on the user support assembly. The left and right moving assemblies have left and right portions operatively associated with cooperating structure on the left and right upper free ends.

Other objects, aspects, features, and advantages of the present invention will become apparent from the following detailed description, the accompanying drawings, and the appended claims.

BRIEF DESCRIPTION OF THE SEVERAL VIEWS OF THE DRAWING

The accompanying drawings, which are incorporated in and constitute a part of the specification, of embodiments of the invention, together with the general description given above and the detailed description of the embodiments given below, serve to explain the principles of the invention wherein.

DETAILED DESCRIPTION OF THE INVENTION

Figure 1:
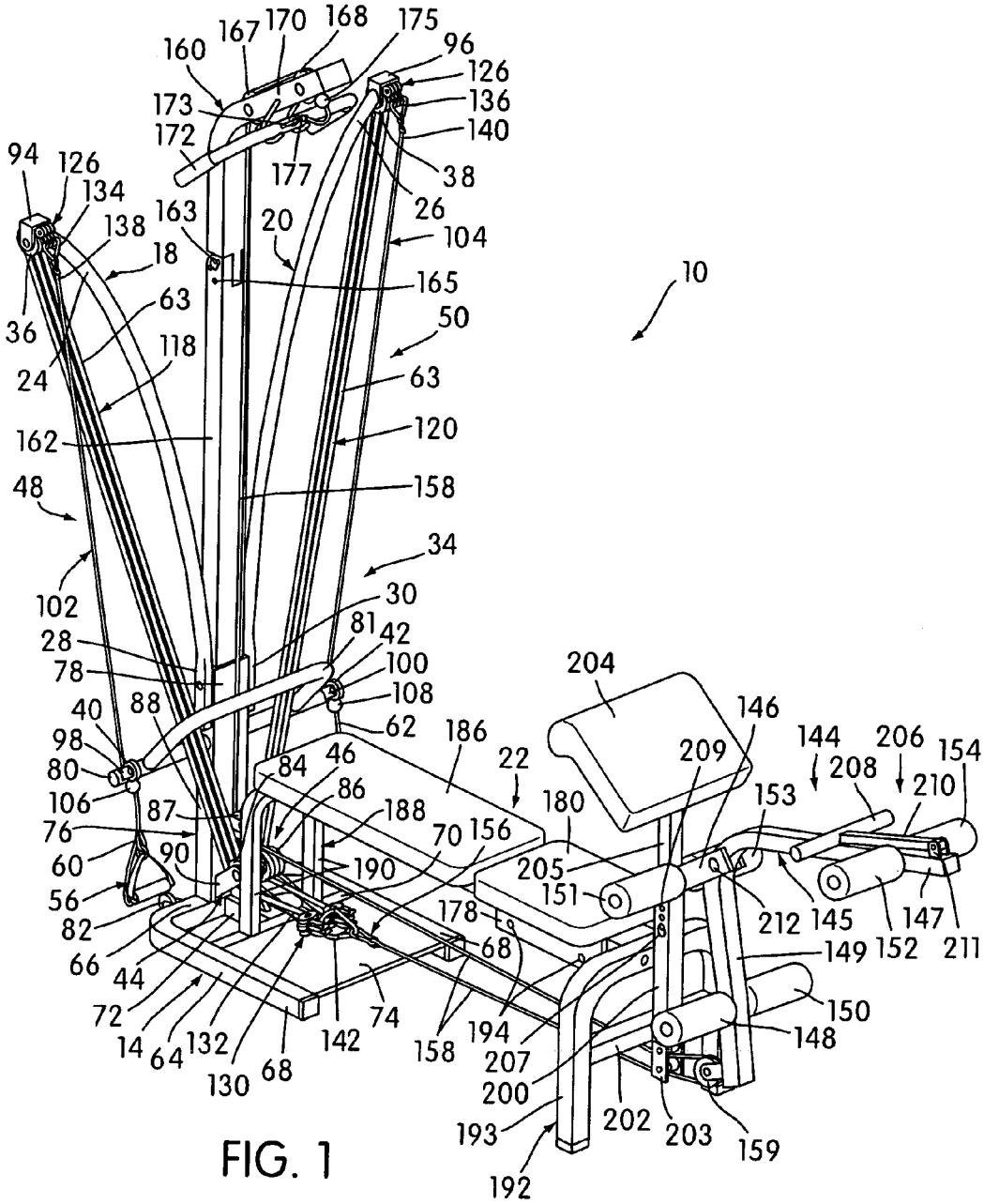
FIG. 1 is a perspective view of an exerciser embodying the principles of the present invention shown in an inline bench position.
Figure 2:
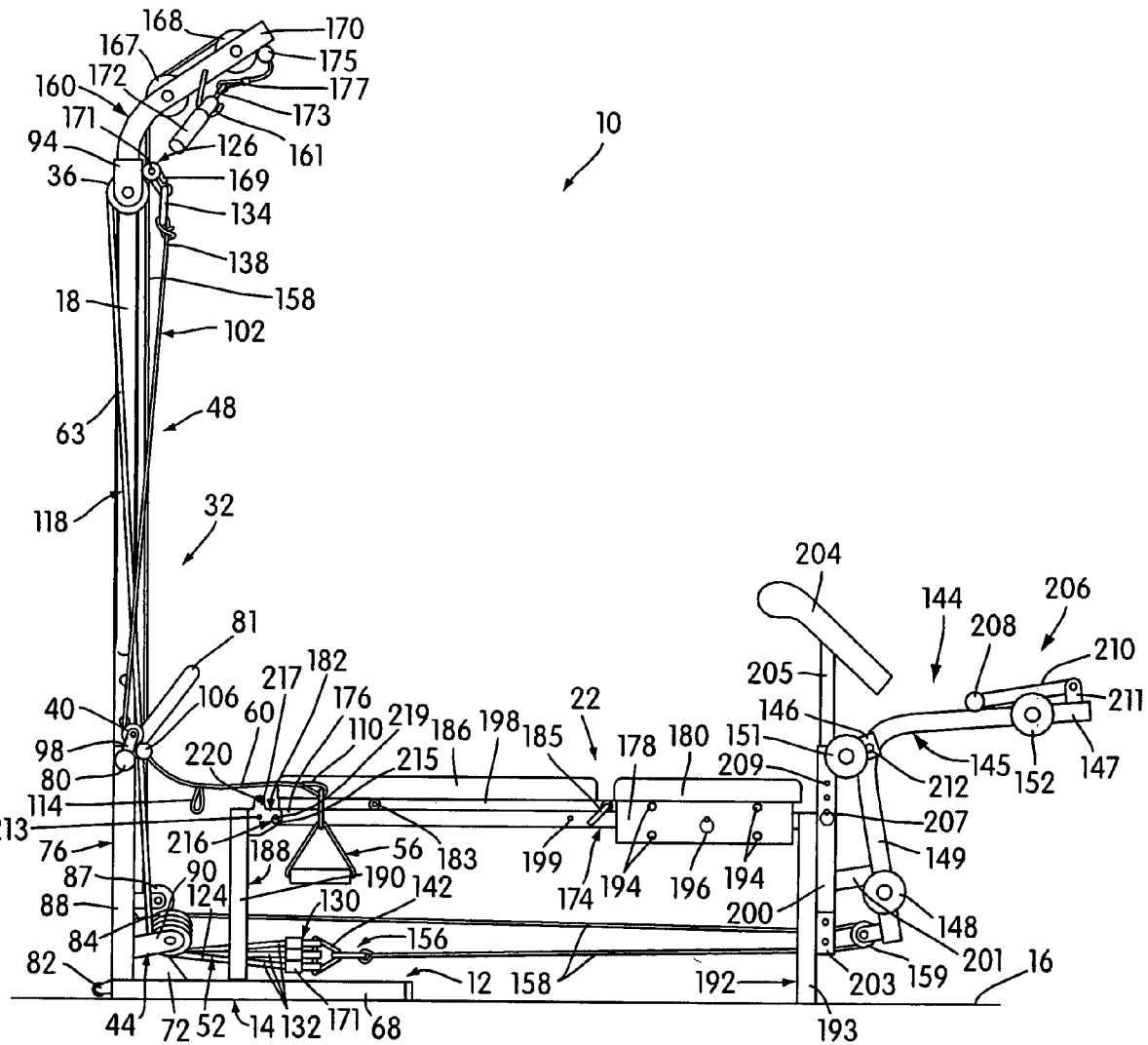
FIG. 2 is a side view of the exerciser of FIG. 1 showing the leg-engaging unit in a normal inoperative position thereof and the user support assembly in the inline bench or outer position thereof.
Figure 3:
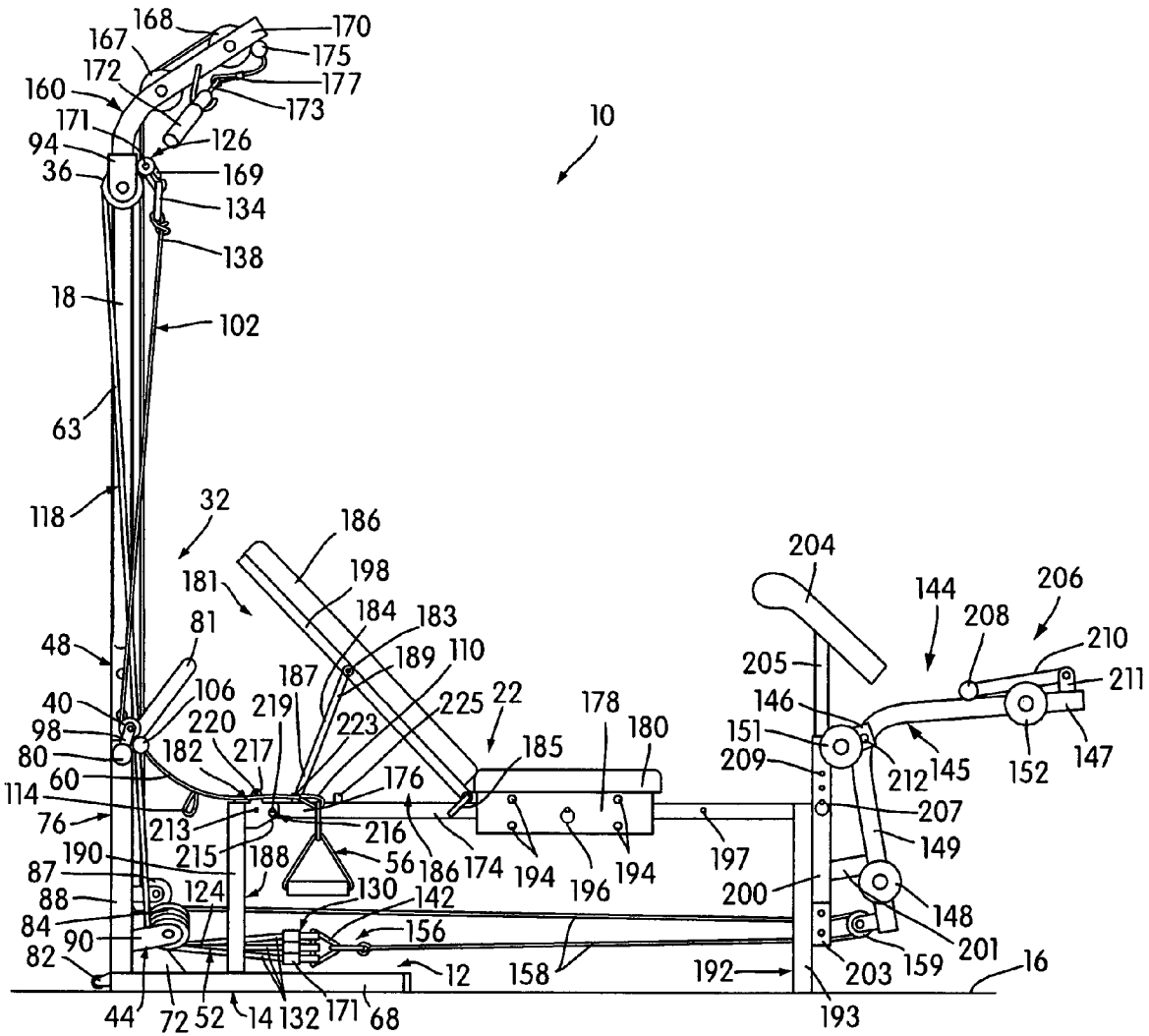
FIG. 3 is a side view of the exerciser of FIG. 1 showing the leg-engaging unit connected to the exerciser in a normal inoperative position thereof and the user support assembly in the upright or inner position thereof.

Referring now more particularly to the drawings, FIGS. 1–3 illustrate an exerciser, generally indicated at 10, embodying the principles of the present invention. The exerciser 10 comprises a frame assembly, generally indicated at 12, having bungee cords 63 mounted thereto to provide resilient resistance to first and second moving assemblies, generally indicated at 32, 34, respectively, a leg-engaging unit, generally indicated at 144, and a hand grip bar assembly, generally indicated at 160. The exerciser 10 further comprises a user support assembly, generally indicated at 22, movable between an inner and outer position thereof by seat back mounting structure.

The frame assembly 12 includes a lower frame portion, generally indicated at 14, constructed and arranged to be stablely supported in an operative position on a horizontal surface 16 and the user support assembly 22 is operatively connected with the lower frame portion 14 to support a user thereon.

First and second rigid upright support members 18, 20 are fixed at lower end portions 28, 30 thereof on the lower frame portion 14 and extend upwardly from the lower frame portion 14 when in the operative position thereof. The first and second rigid upright support members 18,20 have first and second rigid upper free end portions 24, 26, respectively. The upper free end portions 24, 26 are configured to curve or extend upwardly from the lower portions 28, 30 thereof in outwardly diverging relation with respect to one another.

A pair of separate moving assemblies 32, 34 is disposed in normal inoperative positions with respect to the user support assembly 22. Each moving assembly 32, 34 is constructed and arranged to be manually engaged and individually manually moved away from the normal inoperative position thereof into a desired extended position by a user supported on the user support assembly 22.

The first and second moving assemblies 32, 34 include first and second upper pulley members 36, 38 rotatably mounted on the upper free end portions 24, 26 of the first and second rigid upright support members 18, 20, respectively. First and second lower pulley members 40, 42 are rotatably mounted on the frame assembly 12 at fixed positions below the upper pulley members 36, 38, respectively. First and second flexible elongated structures, generally indicated at 48, 50, are trained around the lower pulley members 40, 42 and extend upwardly over the first and second upper pulley members 36, 38 respectively. Terminal end portions 52, 54 of the first and second flexible elongated structures 48, 50 extend downwardly from the upper pulley members 36, 38 toward the lower frame portion 14.

Movement preventing structures, generally indicated at 44, 46, on the lower frame portion 14 are operatively associated with the terminal end portions 52, 54 of the first and second flexible elongated structures 48, 50, respectively, (only the movement preventing structure 44 and its operatively associated terminal end portions 52 are seen in FIGS. 1–3). The movement preventing structures 44, 46 are constructed and arranged to prevent upward movements of the terminal end portions 52, 54.

First and second user hand grip units 56, 58 are connected with first and second end portions 60, 62 of the first and second flexible elongated structures 48, 50, respectively. The end portions 60, 62 are at opposite ends of the first and second flexible elongated structures 48, 50 as the terminal end portions 52, 54. The end portions 60, 62 extend outwardly from the lower pulley members 40, 42 in positions to enable a user supported on the user support assembly 22 to move the user hand grip units 56, 58 away from inoperative positions thereof into desired extended positions.

The first and second flexible elongated structures 48, 50 include bungee cords 63, which constitute resilient resistance structures, at the terminal end portions 52, 54 thereof. The bungee cords 63 resiliently resist movement of the user hand grip units 56, 58 and the end portions 60, 62 of the flexible elongated structures 48, 50 away from the inoperative positions thereof into desired extended positions. The bungee cords 63 are further configured to resiliently return the user hand grip units 56, 58 to the inoperative positions thereof when no longer moved by the user.

The lower frame assembly 14 may be formed from a rigid material, such as steel, and includes a substantially symmetrical U-shaped support base 64. The U-shaped support base 64 has a generally straight central section 66 and a pair of spaced legs 68 which extend from the central section 66 to provide support to the lower frame portion 14 of the exerciser 10. A cross member 70 extends between the support legs 68 in parallel spaced relation to the central section 66 and a support bar 72 extends from the mid-portion of the central section 66 toward the cross member 70 in order to provide additional support to the lower frame portion 14. A cover plate 74, which may be made from steel, plastic, wood, such as plywood, or any other type of material, is positioned in abutting relation to the cross member 70 so as to form a common plane therewith which substantially covers the area extending between the spaced legs 68. As best shown in FIG. 1, a mounting support member 76 vertically extends from the central section 66 of the support base 64. The mounting support member 76 has a hollow transverse cross section, preferably substantially rectangular in form so as to provide sufficient strength and support to the lower frame assembly 14 of the exerciser 10. Other exercise components, such as the hand grip bar assembly 160, can be positioned within the mounting support member 76 to provide added versatility to the exerciser 10, as will be further described in detail below.

A pulley mounting member 80 is mounted to an upper portion 78 of the mounting support member 76, such as by transversely extending therethrough, so as to form a cross or t-shape therewith. The pulley mounting member 80 is preferably tubular in form and bonded to the mounting support member 76, for example, by welding, for additional structural rigidity of the lower frame portion 14. It may be preferable to mount the pulley mounting member 80 forwardly or rearwardly of the mounting support member 76.

A protruding member 81 outwardly and upwardly extends from the pulley mounting member 80 such that during certain exercises described below, the user may position his/her feet thereon, e.g. for resting purposes. The protruding member 81 is generally C-shaped and may be adapted to retain the bungee cords 63 within a confined area of lateral movement in cooperation with the pulley mounting member 80.

In the illustrated embodiment, each rigid upright support member 18, 20 is mounted, preferably by fasteners or bonding, such as welding, at respective lower portions 28, 30 thereof to the mounting support member 76. The rigid upright support members 18, 20 may be positioned on opposite sides of the mounting support member 76 and slightly above the pulley mounting member 80 such that the lower end portions 28, 30 thereof abut the upper portion 78 of the mounting support member 76.

A guide pulley member 87 may be rotatably mounted on a lower portion 88 of the mounting support member 76 to extend outwardly therefrom. The guide pulley member 87 is configured to guide an elongated flexible non-extensible element 158 extending from the hand grip bar assembly 160, as will be described in greater detail below.

A pair of horizontally spaced rollers 82 might be rotatably mounted on the generally straight central section 66 of the lower frame 14 for rotation about a horizontal axis parallel to the central section 66. The rollers 82 are positioned to facilitate the transport of the exerciser 10 to different locations of use, as will be described in further detail below.

The movement preventing structures 44, 46 include a series of lower pulley members 84, 86. Each lower pulley member 84, 86 is rotatably mounted on the lower portion 88 of the mounting support member 76 by a lower bungee cord stop structure 90, 92, respectively. The lower bungee cord stop structures 90, 92 extend across a peripheral portion of the associated lower pulleys 84, 86.

The movement preventing structure 46 and the lower bungee cord stop structure 92 are not visible in FIG. 1, however, these elements are represented by the movement preventing structure 44 and the lower bungee cord stop structure 90, respectively, shown in FIG. 1.

Alternatively, in an embodiment not shown, the first and second elongated structures 48, 50 could be fixed at the terminal ends 52, 54 thereof to the mounting support member 76 to prevent upward movements of the terminal portions 52, 54. For example, the lower pulleys 84, 86 and stop structures 90, 92 may be removed from the mounting support member 76 by securing the terminal portions 52, 54 of each elongated structure 48, 50, respectively to the mounting support member 76.

FIG. 1 best illustrates the first and second upper pulley members 36, 38 having an upper stop structure 94, 96, respectively, which extends across a peripheral portion thereof. The upper stop structures 94, 96 rotatably mount the first and second upper pulley members 36, 38, respectively on the upper free end portions 24, 26 of the first and second rigid upright support members 18, 20.

As illustrated, a pair of lower stop structures 98, 100 diagonally extends upwardly and outwardly from the pulley mounting member 80. The lower stop structures 98, 100 rotatably mount the lower pulley members 40, 42 in horizontally spaced relation on the pulley mounting member 80 such that the lower stop structures 98, 100 extend across a peripheral portion of the lower pulley members 40, 42, respectively.

The first and second flexible elongated structures 48, 50 further include first and second flexible elongated non-extensible elements 102, 104, such as, for example, nylon cords or other flexible elongated non-extensible elements. The first and second flexible elongated non-extensible elements 102, 104 are trained around the lower pulley members 40, 42 so as to provide the first and second outwardly extending end portions 60, 62, respectively, of the first and second flexible elongated structures 48, 50.

Each non-extensible element 102, 104 has a stop element 106, 108, respectively, fixed to the respective end portion 60, 62 thereof. Each non-extensible element 102, 104 interengages with the respective lower stop structure 98, 100 to determine the inoperative position of the first and second moving assemblies 32, 34, respectively. More specifically, the stop elements 106, 108 cooperate with the stop structure 98, 100 of the respective lower pulley members 40, 42 to determine the inoperative positions of the end portions 60, 62 of the non-extensible elements 102, 104.

The end portions 60, 62 of the non-extensible elements 102, 104 have respective looped end portions 110, 112. The looped end portions 110, 112 are configured to connect with the first and second hand grip units 56, 58, respectively. The stop elements 106, 108 are fixed on the non-extensible elements 102, 104 in spaced relation to the looped end portions 110, 112 thereof. Looped intermediate portions 114, 116 are disposed between the associated stop elements 106, 108 and the respective looped end portions 110, 112 of the non-extensible elements 102, 104. The looped intermediate portions 114, 116 are configured to selectively receive the first and second hand grip units 56, 58, respectively, in connecting relation thereto.

Figure 4:
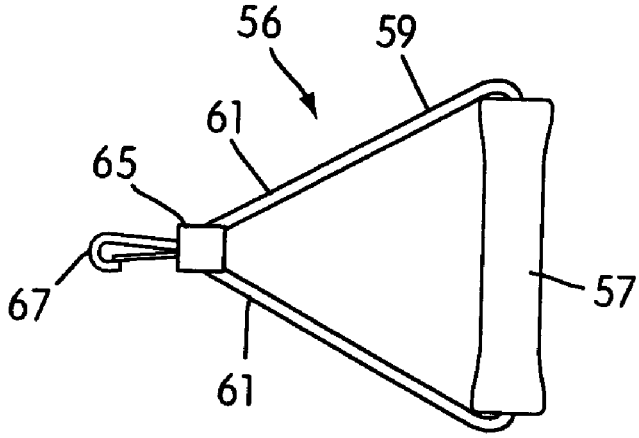
FIG. 4 is a side view of a hand grip unit of FIG. 1.

FIG. 4 illustrates the hand grip unit 56. The hand grip units 56, 58 are the same in construction and the description of the hand grip unit 56 will suffice for both. As best shown in FIG. 4, each hand grip unit 56, 58 includes a tubular gripping member 57 which is manually engageable by the user during various exercises. A flexible strap 59, such as nylon or cable, extends through the gripping member 57 to provide free ends 61. A binding member 65 binds the free ends 61 together and secures the gripping member 57 between the free ends 61.

A latching or securing member 67 is releasably secured to the binding member 65 at one end thereof in a position which facilitates the other end thereof to latch onto the first and second moving assemblies 32, 34, respectively, through the looped portions 110, 112, 114, or 116. When the latching member 67 is latched onto one of the first and second moving assemblies 32, 34, a force exerted on the gripping member 57 by the user moves the respective moving assembly 32, 34 on which the gripping member 57 is attached.

It may be preferable to store the hand grip units 56, 58, when not in use, by connecting the latching member 67 through both looped portions 110, 114 or 112, 116 of the non-extensible elements 102, 104, respectively (as illustrated in FIG. 1).

Alternatively, the hand grip units 56, 58 may include the tubular gripping member 57 and any known flexible or rigid member for securing the latching member 67 thereto. The latching member 67 may be of any known configuration.

In the embodiment illustrated in FIG. 1, the bungee cords 63 are grouped into a first and second series of resiliently extensible bungee cords 118, 120 associated with the first and second moving assemblies 32, 34, respectively. Each series of bungee cords 118, 120 may include three bungee cords 63, each providing a resilient resistance.

In the illustrated embodiment, each series of bungee cords 118, 120 includes one bungee cord 63 that provides ten pounds of resistance and two bungee cords 63 that each provide twenty pounds of resistance. However, any number of bungee cords 63 may be used in each series 118, 120 and the bungee cords 63 can have equal or different resilient resistances so as to provide the desired resilient resistance.

Each bungee cord 63 in the first and second series 118, 120 has an upper end portion 122 trained around one of the upper pulley members 36, 38 and a lower end portion 124 trained about one of the lower pulleys 44, 46, respectively.

Figure 5:
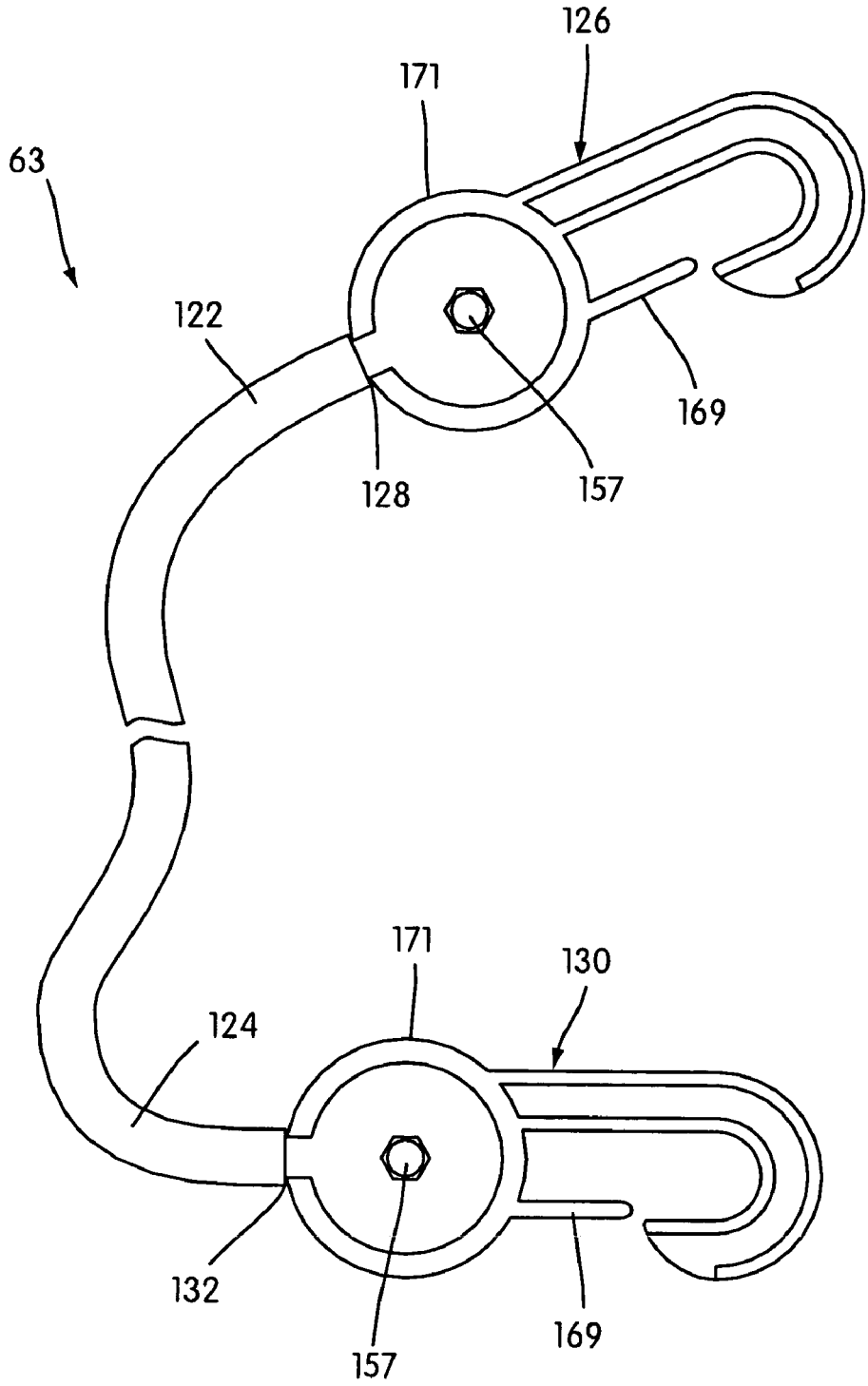
FIG. 5 is a side view of a bungee cord of FIG. 1.

As best shown in FIG. 5, an upper hook connector 126 is fixed on each terminal end 128 of the bungee cords 63 and a lower hook connector 130 is fixed on each terminal end 132 of the bungee cords 63. The upper hook connectors 126 selectively engage with first and second connecting terminals 134, 136, respectively, so that the first and second connecting terminals 134, 136 move substantially in the same direction when the respective moving assemblies 32, 34 are moved away from the normal inoperative position thereof.

The connecting terminals 134, 136 are fixedly disposed on adjacent ends 138, 140 of the associated non-extensible element 102, 104 to provide resilient resistance thereto. For example, the adjacent ends 138, 140 of the non-extensible elements 102, 104 may be fixedly disposed on the connecting terminals 134, 136 by a hook connector or by tying the ends 138, 140 around the respective connecting terminal 134, 136. The connecting terminals 134, 136 are disposed in close proximity to the associated upper stop structure 94, 96 when the moving assemblies 32, 34 are in an inoperative position thereof. The lower hook connector 130 selectively engages a third connecting terminal 142, which is connected with the leg-engaging unit 144 to provide resilient resistance thereto, as will be described in further detail below. The lower hook connectors 130 may be configured to have an enlarged portion 171, which might selectively engage the associated lower bungee cord stop structure 90, 92 when the moving assemblies 32, 34 are in an inoperative position thereof.

It is contemplated that the leg-engaging unit 144, the hand grip bar assembly 160, or the combination thereof may constitute the third moving assembly.

The number of hook connectors 126, 130 connected to each connecting terminal 134, 136, 142 determines the number of bungee cords 63 resisting movement of the corresponding moving assembly 32, 34, 144 away from the inoperative position thereof. In the illustrated embodiment, each bungee cord 63 provides a resilient resistance and the total resistance provided with respect to any moving assembly 32, 34, 144 can be varied by virtue of a selection of any one, any two or all three bungee cord hook connectors 126, 130, respectively to be connected to the associated connecting terminal 134, 136, 142.

It may be preferable for the connecting terminals 134, 136, 142 to be constructed in the form of rigid annular members, such as metal rings, but the connecting terminals 134, 136, 142 could be formed into any rigid or flexible configuration capable of being engaged by the hook elements 126, 130. For example, as shown in FIGS. 1–4 and 7–13, the third connecting member 142 is formed into a hook up bracket having three separate connecting portions thereof, two of which being engaged by the hook elements 126, 130 and one of which being engaged by the connector 156.

As illustrated in FIGS. 2–4, 7 and 8, the leg-engaging unit 144 is disposed in a normal inoperative position with respect to the user support assembly 22. The leg-engaging unit 144 includes an L-shaped member 145 that is pivotally attached to an outer end portion 146 of the user support assembly 22. The L-shaped member 145 is engaged to be moved away from the normal inoperative position thereof into a desired extended position by a user supported on the user support assembly 22, as will be described in greater detail below.

The L-shaped member 145 includes a generally straight portion 147 and a downwardly angled portion 149. A pair of horizontally aligned and fixedly spaced leg-engaging members 148, 150 is pivotally mounted to the angled portion 149 of the L-shaped member 145. The leg-engaging members 148, 150 are pivotally movable with the angled portion 149 from a normal inoperative position disposed outwardly of the user support assembly 22. Another pair of horizontally aligned and fixedly spaced leg-engaging members 151, 153 are mounted to the angled portion 149 above the other pair of leg-engaging members 148, 150 in vertically spaced relation with respect thereto.

A pair of leg curl members 152, 154 are mounted to the generally straight portion 147 outwardly of the outer end portion 146 so as to engage a user's legs during leg curl exercises. The leg curl members 152, 154 are positioned in a normal inoperative position spaced upwardly and outwardly from the inoperative position of the leg-engaging members 148,150 and move with the leg-engaging unit 144.

In the illustrated embodiment, a pulley member 159 is rotatably mounted to the angled portion 149 of the L-shaped member 145. An elongated flexible non-extensible element 158 has one end connected to a selectively connectable and disconnectable connector 156, which is selectively connected to the third connecting terminal 142. The elongated flexible non-extensible element 158 extends away from the third connecting terminal 142 toward the leg-engaging unit 144. The elongated flexible non-extensible element 158 abuts a pair of rollers 203, i.e., the lower roller of the pair, and is trained around the pulley member 159. The elongated flexible non-extensible element 158 extends from the pulley member 159 through the pair of rollers 203, i.e., between the upper and lower rollers, to the guide pulley member 87. The elongated flexible non-extensible element 158 is trained around the guide pulley member 87 and extends upwardly along the centrally located upright frame member 162 toward the hand grip bar assembly 160.

The bungee cords 63, which constitute the terminal end 52, 54 of the first and second flexible elongated structures 48, 50, are connected to the third connecting terminal 142 in opposing relation to the connector 156 by the lower hook connectors 130.

The elongated flexible non-extensible element 158 facilitates the first and third connecting terminals 134, 142 and the second and third connecting terminals 136, 142 to move away from one another when one of the moving assemblies 32, 34, 144 is moved away from the normal inoperative position thereof.

As best shown in FIGS. 1 and 7–14, the hand grip bar assembly 160 is mounted to extend upwardly from the mounting support member 76. A centrally located upright rigid frame member 162 is disposed within the interior of the mounting support member 76 and is fixedly secured therein by welding or any known manner such as, for example screws, nuts and bolts, friction fit, interference fit or any fastener arrangement known in the art.

Alternatively, the fastener arrangement may include a pin and opening arrangement whereby the pin is removable received through a pair of horizontally aligned openings (not shown) extending through the mounting support member 76 and the frame member 162. That way, the fastener could allow optional removable attachment of the frame member 162 of the hand grip assembly bar 160.

The hand grip bar assembly 160 is carried by the central upright rigid frame member 162 in a normal inoperative position with respect to the user support assembly 22. An upper inclined end 170 of the hand grip bar assembly 160 may be pivoted away from the leg-engaging unit 144 with respect to the central upright rigid frame member 162 via a pivot pin 165. The upper inclined end 170 may be retained in either the upright position (FIG. 1) or the pivoted position (FIG. 14) by a pin and opening arrangement. Alternatively, the central upright rigid frame member 162 may be configured to stop pivotal movement of the upper inclined end 170 away from the leg-engaging unit 144.

The pin and opening arrangement may include a pin 163, which is removably received through a pair of vertically spaced aligned openings (not shown) extending through the central upright rigid frame member 162. The pin 163 may be removably received through any two of the aligned openings to allow pivotal adjustment of the upper portion 170 for accommodating the leg-engaging unit 144 when the exerciser is moved into the storage position thereof, as will be further described below. The pin 163 may be removed from the openings to allow the upper inclined end 170 to pivot away from the leg-engaging unit 144.

The elongated flexible non-extensible element 158 extends upwardly from the guide pulley member 87 along the centrally located upright frame member 162 and over two upper pulleys 167, 168. The two upper pulleys 167, 168 are rotatably mounted on the upper inclined end 170 of the centrally located upright frame member 162.

A manually engageable hand grip bar 172 defines an opening 173 in a mid-portion thereof. The hand grip bar 172 is latched to a conventional latching mechanism 177 that is disposed on the end of the elongated flexible non-extensible element 158. The elongated flexible non-extensible element 158 and latching mechanism 177 extends from both upper pulleys 167, 168, and latches the hand grip bar 172 through the opening 173 therein.

In the exemplary embodiment, the hand grip bar 172 may be engaged by a user and moved away from the normal inoperative position of the hand grip bar assembly 160 into a desired extended position thereof by a user supported on the user support assembly 22.

The upper inclined end 170 may include a pair of J-shaped supporting elements 161, which are rigidly mounted to opposite sides thereof. The J-shaped supporting elements 161 are configured to receive and retain the hand grip bar 172 therebetween to stabilize and preclude swinging thereof when not being used. Alternatively, the J-shaped supporting elements 161 may be pivotally mounted to opposite sides of the upper inclined end 170.

An annular stop element 175 is disposed between the latching mechanism 177 and the upper inclined end 170. The upper inclined end 170 together with the uppermost pulley member 168 precludes the stop element 175 and the elongated flexible non-extensible element 158 from moving due to the resilient bias exerted by the bungee cords 63.

In the embodiment illustrated in FIGS. 1–3, the connector 156 is connected to the connecting terminal 142 so as to render the leg-engaging unit 144 and the hand grip bar assembly 160 to have the movement thereof away from the inoperative position thereof resisted by the bungee cords 63. That way, the bungee cords 63 may provide resistance to the movement of the leg-engaging unit 144 and the hand grip bar assembly 160 without disconnecting or connecting the connector 156.

FIG. 5 illustrates a bungee cord 63 having the hook connectors 126, 130 disposed on opposite terminal ends 128, 132 thereof. The hook connectors 126, 130 are of the same construction and operation as one another. Each hook connector 126, 130 includes a flexible movable element 169 extending from the enlarged annular portion 171. The flexible movable elements 169 are preferably made from plastic so as to allow easy passage of the respective connecting terminal 134, 136, 142 therethrough. That way, each hook connector 126, 130 may be quickly connected to and quickly disconnected from the respective connecting terminal 134, 136, 142.

The annular portions 171 of the hook connectors 126, 130 are constructed to engage the respective upper stop structures 94, 96 and the stop structures 90, 92, respectively, when the first and second moving assemblies 32, 34 are moved into the normal inoperative positions thereof.

Extending through each hook connector 126, 130 is a conventional fastener 157, which fixedly secures each bungee cord 63 thereto. The fastener 157 secures the bungee cords 63 to the annular portions 171 so that forces exerted on the bungee cords 63 can be transmitted through the respective hook connector 126, 130 without the bungee cords 63 becoming unattached from the annular portions 171.

The hook connectors 126, 130 may be molded from a plastic material, however, it is contemplated that the hook connectors 126, 130 may be constructed in any known manner. The hook connectors 126, 130 may be of any known material capable of providing sufficient strength or rigidity that may easily connect and disconnect from the connecting terminals 134, 136, 142.

As best shown in FIGS. 1–3, the user support assembly 22 includes an elongated support member 174. The elongated support member 174 has one end 176 connected to a U shaped frame support member 188, with the opened portion of the U configuration facing downwardly toward the cross member 70. Spaced ends 190 of the support member 188 are integrally attached to cross member 70 in substantially perpendicular relation thereto. The elongated support member 174 extends in an operative position generally horizontally outwardly from a pivoted frame bracket member 182 extending from the support member 188. The elongated support member 174 is pivotally attached to the support member 188 by a pivot pin 213, which horizontally extends through both the elongated support member 174 and the pivoted frame bracket member 182.

In the illustrated embodiment, the pivoted frame bracket member 182 provides a projecting flange 215, which projects outwardly from the pivoted frame bracket member 182 toward the leg-engaging unit 144, and an upwardly extending flange 217. The projecting flange 215 and the upwardly extending flange 217 define a pair of centrally disposed fastener-receiving holes 219, 220, respectively, therein. The fastener-receiving holes 219, 220 can align with fastener-receiving holes (not shown) in the elongated support member 174 for removably receiving a removable fastener or pin 216 therethrough, as will be described in greater detail below.

A slide frame unit 178 supports a user seat member 180 in slidable relation with respect to the elongated support member 174 to be moved horizontally with respect thereto. The user seat member 180 is slidably mounted on the elongated support member 174 to be moved into operative position thereof between an outer position and an inner position. The inner position of the user seat member 180 is spaced inwardly of and at generally the same level as the outer position.

In the illustrated embodiment, a pivoted strut frame 184 and a pivoted support frame unit 181 are disposed in supporting relation to a seat back member 186. The seat back member 186 is pivotally connected to the slide frame unit 178 by the pivoted support frame unit 181. A removable cylindrical shaft member 185 extends through and is supported in journaling openings 141 (FIG. 10) formed in the slide frame unit 178 and the pivoted support frame unit 181. Thus, the pivoted support frame unit 181 and the removable cylindrical shaft member 185 cooperate to form a pivot axis about which the user seat back member 186 may pivot relative to the user seat member 180 without obstruction. The removable cylindrical shaft member 185 may be removable from the journaling openings 141 such that the seat back member 186 may be detached from the user seat member 180.

Figure 6:
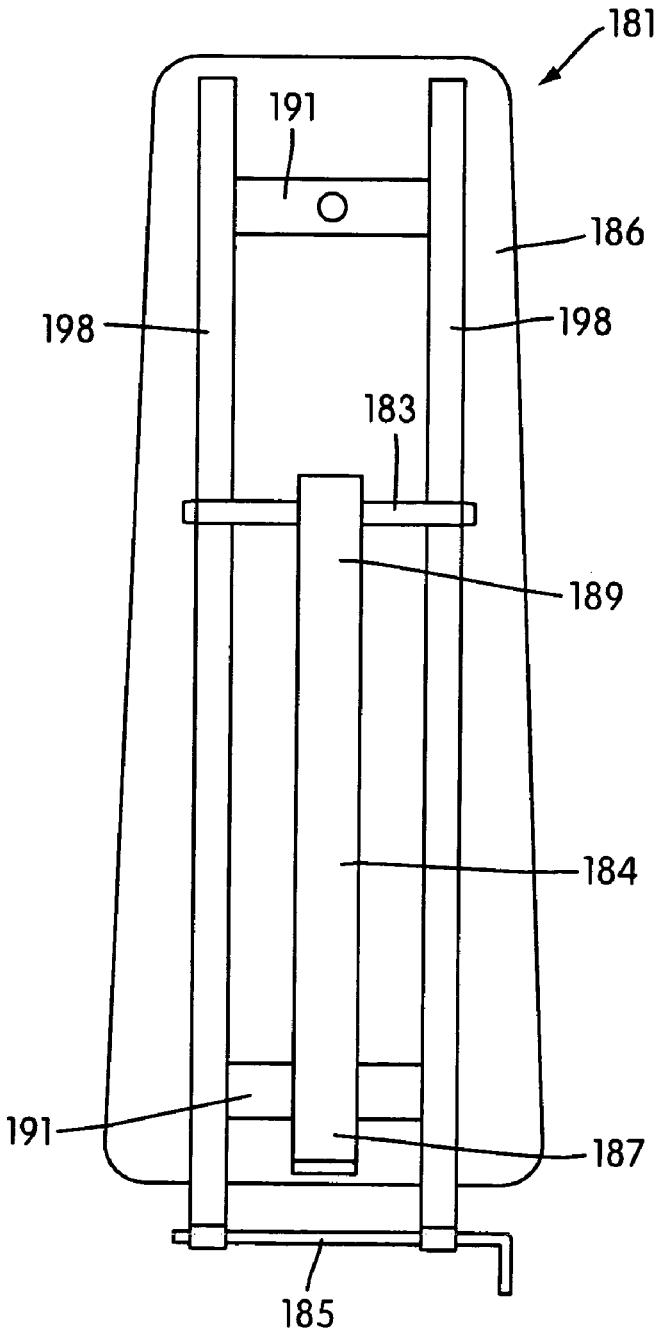
FIG. 6 is a bottom plan view of the user seat back of FIG. 1.

FIG. 6 best illustrates the pivoted support frame unit 181 and the seat back member 186. One end 189 of the pivoted strut frame 184 is connected to the seat back member 186. The pivoted support frame unit 181 includes a pair of longitudinally elongated support members 198 and a pair of cross support members 191, which are fixedly secured to the seat back member 186. A cylindrical shaft 183 extends through a through hole (not shown) in the end 189 of the pivot strut frame 184 and is fixedly secured to each of the longitudinally elongated support members of the pivoted support frame unit 181. The end 189 of the pivot strut frame 184 is pivotally connected to the shaft 183 so that the pivot strut frame 184 may be pivoted relative to the seat back member 186.

Figure 13:
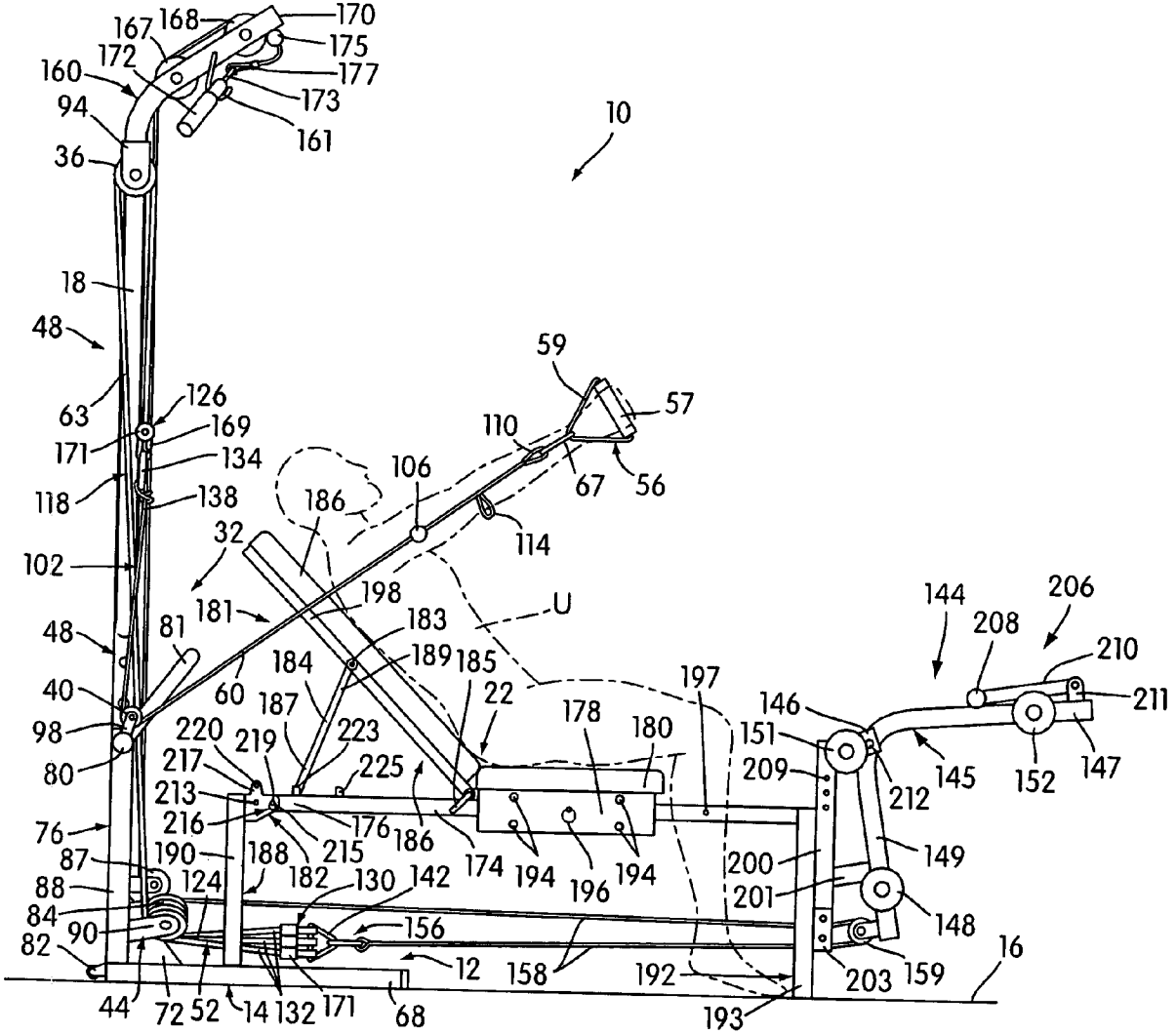
FIG. 13 is a side view of the exerciser of FIG. 3 but showing the hand grip units being extended away from the lower pulley members while a user is effecting a bench press or chest fly exercise.

As best illustrated in FIGS. 3 and 13, a pair of U-shaped mounting brackets 223, 225 extends upwardly from the elongated support member 174 in spaced relation with respect to one another in the longitudinal direction along the elongated support member 174. Each mounting bracket 223, 225 may have an opening (not shown) formed therethrough for receiving a removable pin, such as a similar removable pin as the removable pin 163 described above, therethrough. The free ends of the mounting brackets 223, 225 open upwardly so that the pivoted strut frame 184 may be received therebetween. Another end 187 of the pivoted strut frame 184 may be pivotally connected through the openings in the mounting brackets 223, 225 of either one of the mounting brackets 223, 225 by a cylindrical shaft, such as, for example, a releasable locking pin.

Pivotally connecting the end 187 between the free ends of the mounting bracket 223 generally decreases the angle at which the user seat member 180 and the seat back member 186 are positioned with respect to one another. In other words, the seat back member 186 may be disposed at a steeper inclination with respect to the user seat member 180 by pivotally connecting the end 187 between the free ends of the mounting bracket 225.

The pivoted support frame unit 181 and the pivoted strut frame 184 constitute the seat back mounting structure. The seat back mounting structure can be constructed and arranged to enable the seat back 186 to be selectively retained in an inline bench position and an upright position thereof. In the inline bench position, the seat back 186 extends in generally horizontally aligned relation to the user seat member 180 and the pivoted strut frame 184 is moved into a position between the mounting structures 223, 225, which are upwardly extending from the elongated support member 174.

In the upright position, the pivoted strut frame 184 extends generally inwardly in inclined relation to the user seat member 180 in response to the movement of the user seat member 180 between the outer and inner positions thereof, respectively. One of the ends 187, 189 of the pivoted strut frame 184 is releasably secured between the free ends of either mounting bracket 223, 225.

The slide frame unit 178 includes a series of rollers 194. The rollers 194 are conventionally secured to the slide frame unit 178, such as for example, by fasteners, so as to engage oppositely facing sides of the elongated support member 174. The rollers 194 are constructed and arranged to roll along the elongated support member 174 in rolling relation thereto as the user seat member 180 is moved between the inner or outer positions thereof, such as during the rowing exercise shown in FIG. 10.

A releasably engageable lock 196 is disposed in operative relation between the slide frame unit 178 and the elongated support member 174. The releasably engageable lock 196 releasably locks the user seat member 180 in either of the inner or outer positions thereof by extending through the horizontally aligned holes 197, 199, respectively, in the elongated support member 174.

In an alternative embodiment not shown, the elongated support member 174 may be telescopically constructed so as to permit movement of the user seat member 180 from the outer position thereof to the inner position thereof by moving the elongated support member in a telescoping manner.

The elongated support member 174 is pivoted at its end 176 so as to be moved between the operative position thereof and an upright storage position. In the operative position, the fastener-receiving holes in the elongated support member 174 align with the fastener-receiving holes 219 in the projecting flange 215. By inserting the removable pin 216 through the aligned holes, the elongated support member 174 may be releasably locked into its operative position.

In the storage position, the elongated support member 174, an outer leg structure 192 and the seat and seat back members 180, 186 are pivoted about the end 176 so as to be positioned alongside the upright frame member 162 and the mounting support member 76. In the storage position, the fastener-receiving holes in the elongated support member 174 align with the fastener-receiving holes 220 in the upwardly extending flange 217. By inserting the removable pin 216 through the aligned holes, the elongated support member 174 may be releasably locked into its storage position.

The outer leg structure 192 is generally U-shaped and opens downwardly to have a pair of spaced ends 193. The outer leg structure 192 is fixed, preferably by welding, to the elongated support member 174. The spaced ends 193 of the outer leg structure 192 engage and are supported on the horizontal surface 16 in spaced relation to the frame 12. The spaced legs 193 support the elongated support member 174 while the elongated support member 174 is in the generally horizontally outwardly extending relation from the U shaped member 188 and the lower frame portion 14. A support member 202 extends between the spaced ends 193 of the outer leg structure 192 so as to provide support to the user support assembly 22 when a user is positioned thereon.

Extending vertically from the mid-portion of the outer leg structure 192 is an arm support mounting member 200. The arm support mounting member 200 has a hollow transverse cross section, preferably substantially rectangular in form so as to provide sufficient mounting structure for the leg-engaging unit 144. A rubber stop member 201 is mounted on the arm support mounting member 200. The angled portion 149 of the leg-engaging unit 144 abuts the rubber stop member 201 when in the normal inoperative position thereof.

As illustrated in FIGS. 1–3 and 7–14, it may be preferable to fixedly mount a pair of rollers 203 to the lower portion of the arm support mounting member 200. However, the pair of rollers 203 may be fixedly mounted to the lower portion of the support member 202 as well. The pair of rollers 203 may be configured to facilitate movement of the elongated flexible non-extensible element 158 thereby as the leg-engaging unit 144 is moved from the inoperative position thereof to the extended position thereof. For example, the pair of rollers 203 roll when the elongated flexible non-extensible element 158 moves thereby to allow smooth movement of the leg-engaging unit 144. The pair of rollers 203 may engage the elongated flexible non-extensible element 158 in rolling relation to thereby reduce frictional wear on the elongated flexible non-extensible element 158 during movement.

An upper arm supporting pad 204 has a mounting member 205 extending downwardly therefrom to extend into the arm support mounting member 200. The mounting member 205 is secured within the hollow configuration of the arm support mounting member 200 by a fastener such that the arm supporting pad 204 is downwardly angled toward the leg-engaging unit 144.

It may be preferable for the fastener to be a pin and opening arrangement whereby a pin 207 is removably received through a series of vertically spaced aligned openings 209 extending through the arm support mounting member 200 and the mounting member 205. The openings 209 are disposed in vertically spaced relation in a series. The pin 207 may be removably received through any two of the series of aligned openings 209 to allow height adjustment of the upper arm supporting pad 204 for accommodating users of different physical sizes. The pin 207 may be removed from the openings 209 to remove the upper arm supporting pad 204 and the mounting member 205 from the arm support mounting member 200. The upper arm supporting pad 204 and the mounting member 205 may also be fixedly attached to the arm support mounting member 200, for example, by welding. Other fasteners capable of fixedly attaching the upper arm supporting pad 204 and the mounting member 205 to the arm support mounting member 200 may be used.

An arm lift unit 206 includes a pair of horizontally aligned and fixedly spaced hand-engaging members 208. The hand-engaging members 208 are attached to a linkage bar 210, which is pivotally mounted to the generally straight portion 147 of the L-shaped member 145 by a U-shaped bracket member 211 in spaced relation from the outer end 146. The linkage bar 210 may be a chain or any other rigid structure for connecting the hand-engaging members 208 to the leg-engaging unit 144.

The arm lift unit 206 enables a user supported on the user support assembly 22 with their upper arms engaged on the arm-engaging pad 204 to move the leg-engaging unit 144 from the inoperative position thereof to the extended positions thereof.

The outer end 146 of the user support assembly 22 upwardly and outwardly extends from the arm support mounting member 200. The outer end 146 pivotally mounts the leg-engaging unit 144 thereto by a pivot pin 212 so that the user may move the leg-engaging unit 144 away from the normal inoperative position thereof into the desired extended position. Due to the arrangement of the elongated flexible non-extensible element 158 and the pulley member 159, when the leg-engaging unit 144 is moved away from the normal inoperative position thereof into the desired extended position, the resistance provided thereto may be essentially doubled.

Although the construction of the exerciser 10 has been described hereinabove having the leg-engaging unit 144 connected with the hand grip bar assembly 160, a second exemplary embodiment may include an exerciser having the leg-engaging unit 144 and the hand grip bar assembly 160 as separate, independent moving assemblies.

For example, the guide pulley member 87 may be removed from the mounting support member 76 and the elongated flexible non-extensible element 158 may be divided into two elongated flexible non-extensible elements, a first elongated flexible non-extensible element being provided for the leg-engaging unit 144 and a second elongated flexible non-extensible element being provided for the hand grip bar assembly 160. The first elongated flexible non-extensible element may be fixedly secured to the mounting support member 76 at one end thereof and the connector 156 at the opposite end thereof. By securing the first elongated flexible non-extensible element to the mounting support member 76, the leg-engaging unit 144 would be selectively operable by connecting the connectable and disconnectable connector 156 to the third connecting terminal 142, as will be further described below.

The second elongated flexible non-extensible element might extend downwardly toward the lower frame portion 14 such that a selectively connectable and disconnectable connector, similar to hook connectors 126, 130, could be fixedly secured thereto. The connector could then be selectively connected to the third connecting terminal 142 so as to render the hand grip bar assembly 160 selectively operable, as will be further described below.

With the leg-engaging unit 144 and the hand grip bar assembly 160 being separate, independent moving assemblies, the operations thereof are similar to that described below. However, the user may selectively switch the connecting terminal 142 from being used with the leg-engaging unit 144 to being used with the hand grip bar assembly 160. For example, the third connecting terminal 142 may be disconnected from the connector 156 and connected the connector suspended from the second elongated flexible non-extensible element of the hand grip bar assembly 160 instead.

Alternatively, the pulley member 159 may be replaced with a connecting element, i.e., a metal connector, such that the first elongated flexible non-extensible element directly connects with the leg-engaging unit 144. That way, the first elongated flexible non-extensible element connects to the third connecting terminal 142 at one end thereof and to the leg-engaging unit 144 via the connecting element at an opposite end thereof. By replacing the pulley member 159 with a connecting element, the amount of resistance provided to the leg-engaging unit 144 by the bungee cords 63 is not changed, i.e., the resistance is not increased.

OPERATION

In FIGS. 7–13, a user U is shown schematically. Motions of the user's arms, legs, or body, as well as motions of the moveable parts of the exerciser 10 are illustrated by broken lines. Resistance is provided by the resilient bungee cords 63 and can be adjusted to suit the user's requirements and physical abilities, as described above. Various exercises are described below in connection with different positions of the user.

Before certain hand, arm or chest exercises can be performed, each hand grip unit 56, 58 must be attached to the respective moving assembly 32, 34. To attach the hand grip units 56, 58, the user U latches each hand grip unit 56, 58 to either the respective looped end portion 110, 112 or to the respective looped intermediate portion 114, 116 depending on the user's physical size. For example, a user of large physical size may be more comfortable with the hand grip unit 56, 58 attached to the looped intermediate portions 114, 116.

The exercises illustrated in FIGS. 7, 8, 9, 11 and 12 are performed with the user support assembly 22 in the outside position thereof. The exerciser 10, however, enables the user U to execute a variety of physical exercises with the user support assembly 22 in the upright or inside position thereof. (FIG. 3).

The hand grip units 56, 58 are identical in construction and operation, therefore only the operation of the hand grip unit 56 will be described below.

After latching the hand grip unit 56 to one of the looped portions 110, 114, the user U may perform various arm, chest and shoulder exercises therewith by moving the hand grip unit 56 away from the pulley member 40.

As shown in FIGS. 1–3 and 7–14, the first connecting terminal 134 is connected with the flexible elongated non-extensible element 102 via the upper hook element 126. That way, the first connecting terminal 134 and the flexible elongated non-extensible element 102 move substantially in the same direction when the moving assembly 32 is moved away from the normal and operative position thereof. Particularly, as the hand grip unit 56 is moved away from the lower pulley member 40, the lower hook connector 130 engages the lower bungee cord stop structure 90, which in turn, allows the moving assembly 32 to be manually moved downwardly away from the normal inoperative position thereof.

The bungee cords 63 may be constructed such that the hook elements 126, 130 are permitted to move relatively away from one another so that the manual movement of the first and second moving assemblies 32, 34 away from the inoperative positions thereof cause the first and second connecting terminals 132, 134 to move away from the third connecting terminal 142. The bungee cords 63 connected to the first and second connecting terminals 132, 134 provide resilient resistance throughout the operative extent thereof to the movement of the first and second moving assemblies 32, 34 away from the inoperative positions thereof.

Without sufficient manual force on the hand grip unit 56 away from the lower pulley 40, the bungee cords 63 provide a resilient bias throughout the operative extent thereof to move the first and third connecting terminals 134, 142 toward one another. The resilient bias of the bungee cords 63 will move the moving assembly 32 toward the normal inoperative position thereof until the stop element 106 on the flexible elongated non-extensible element 102 abuts the stop structure 98.

During various exercises, as will be described in greater detail below, it may be preferable for the user U to maintain manual force on the hand grip unit 56 away from the lower pulley member 40. That way, the bungee cords 63 provide continuous resilient resistance to the exercised muscle throughout the exercise.

It may be preferable for the lower hook element 130 to be precluded from movement so that the lower hook element and will not abut the lower pulley member stop structure 90 when the first and second moving assemblies 32, 34 are in the inoperative positions thereof. For example, the lower hook element 130 may be connected with the leg-engaging unit 144 and/or the hand grip bar assembly 160 via the third connecting terminal 142.

Figure 8:
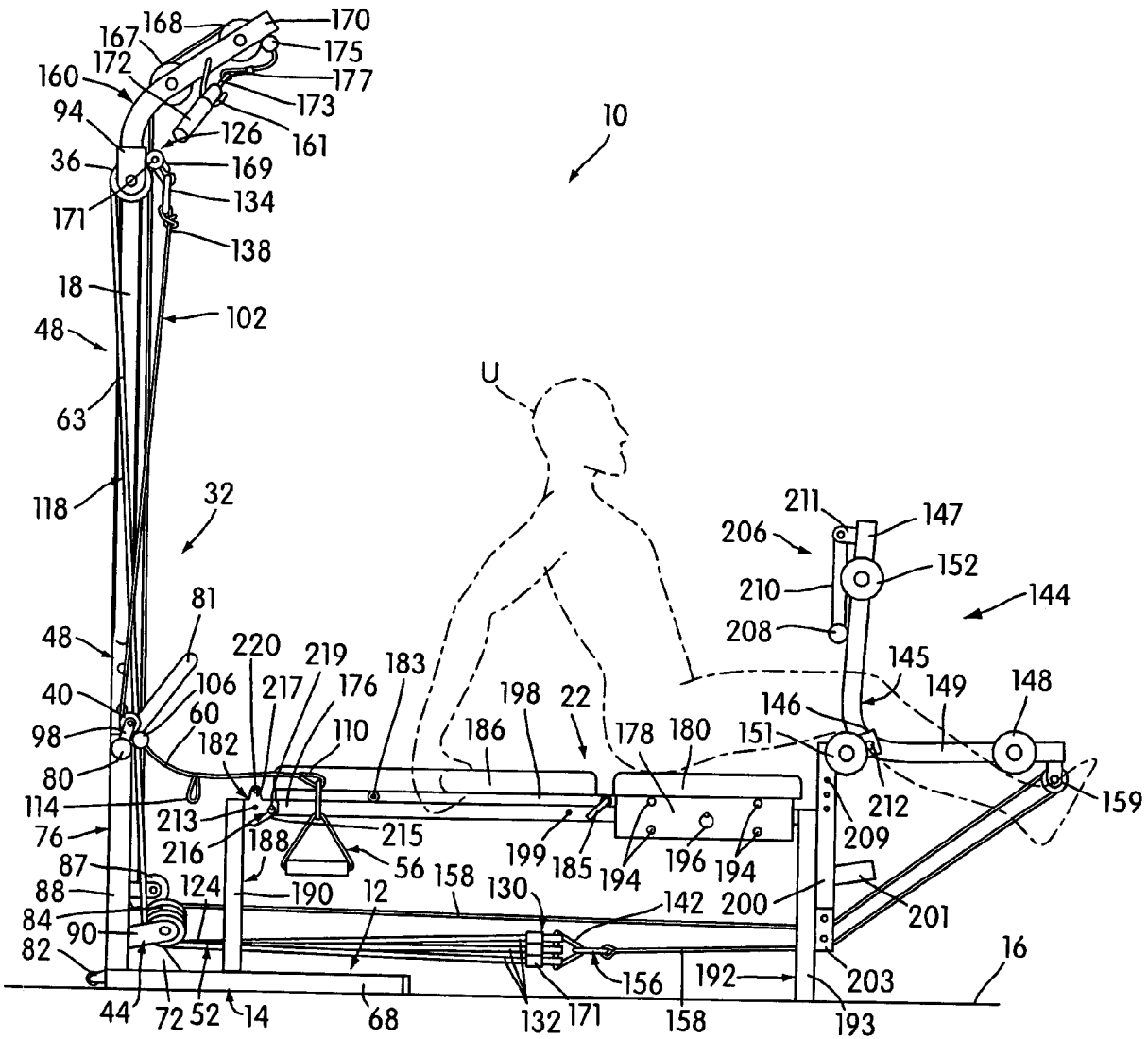
FIG. 8 is a side view of the exerciser of FIG. 2 but showing the arm lift unit removed from the exerciser and the leg-engaging unit being extended away from the user support assembly while a user is effecting a leg extension exercise.

The operation of the leg-engaging unit 144 will now be described (FIGS. 2 and 8). To prepare the leg-engaging unit 144 for certain leg exercises, the user U connects the lower hook element(s) 130 to the third connecting terminal 142 so that the bungee cord 63 may provide resilient resistance to the leg-engaging unit 144. The hook element(s) 130 and the connector 156 are connected to the third connecting terminal 142 so that they move together as the leg-engaging unit 144 is moved into its extended position.

Movement of the leg-engaging unit 144 away from the inoperative position thereof causes the third connecting terminal 142 to move away from the first and second connecting terminals 134, 136. Thus, enabling the bungee cords 63 connected to the first and second connecting terminals 134, 136 to provide resilient resistance throughout the operative extent thereof to the movement of the leg-engaging unit 144 away from the inoperative position thereof.

As the leg-engaging unit 144 is moved towards its extended position, the L-shaped member 145 is pivoted about the outer end portion of 146. The flexible non-extensible element 158 slides between the pair of rollers 203 so as to allow the leg-engaging unit 144 to move smoothly from the normal inoperative position thereof into the desired extended position thereof. In the extended position, the angled portion 149 is disposed in substantially parallel relation with respect to the horizontal surface 16.

The operation of the hand grip bar assembly 160 will now be described (FIGS. 1–3 and 12).

It will be appreciated that the third connecting terminal 142 need not be disconnected from the connector 156 to prepare the hand grip bar assembly 160 for certain arm, chest and shoulder exercises. Since the connector 156 remains connected to the third connecting terminal 142, the user may quickly switch from using either the leg-engaging unit 144 or the hand grip bar assembly 160 to using the other of the two operable assemblies 144, 160.

When the third connecting terminal 142 is connected to the hook connector 156, the resilient bias of the bungee cords 63 causes the stop element 175 positioned on the flexible non-extensible element 158 to abut against the uppermost pulley 168 and the inclined portion 170. The stop element 175 remains stationary while the third connecting terminal 142, which remains connected to the connector 156, moves in substantially the same direction as the hook connector 156 when the hand grip bar assembly 160 is engaged and moved away from the normal inoperative position thereof. When moved away from the normal inoperative position thereof, the manually engageable hand grip bar 172 is moved toward a desired extended position thereof by manual force exerted by a user U supported on the user support assembly 22. As the hand grip bar 172 is moved away from its normal inoperative position and toward its desired extended position, the bungee cords 63 provide resilient resistance to the movement thereof as the hand grip bar 172 is moved. The stop element 175 and the latching mechanism 177 move together with the hand grip bar 172 as the hand grip bar 172 is moved away from its normal inoperative position.

The operation of exerciser 10 has been fully described above, however, to show the versatility of the exerciser 10 various exercise examples will be described in greater detail below.

Although exercises can be performed individually or successively, it is contemplated that the exercises described herein may be performed in any sequence. An exemplary workout having a particular exercise sequence is described below, but more or less exercises can be performed at the user's discretion.

Figure 7:
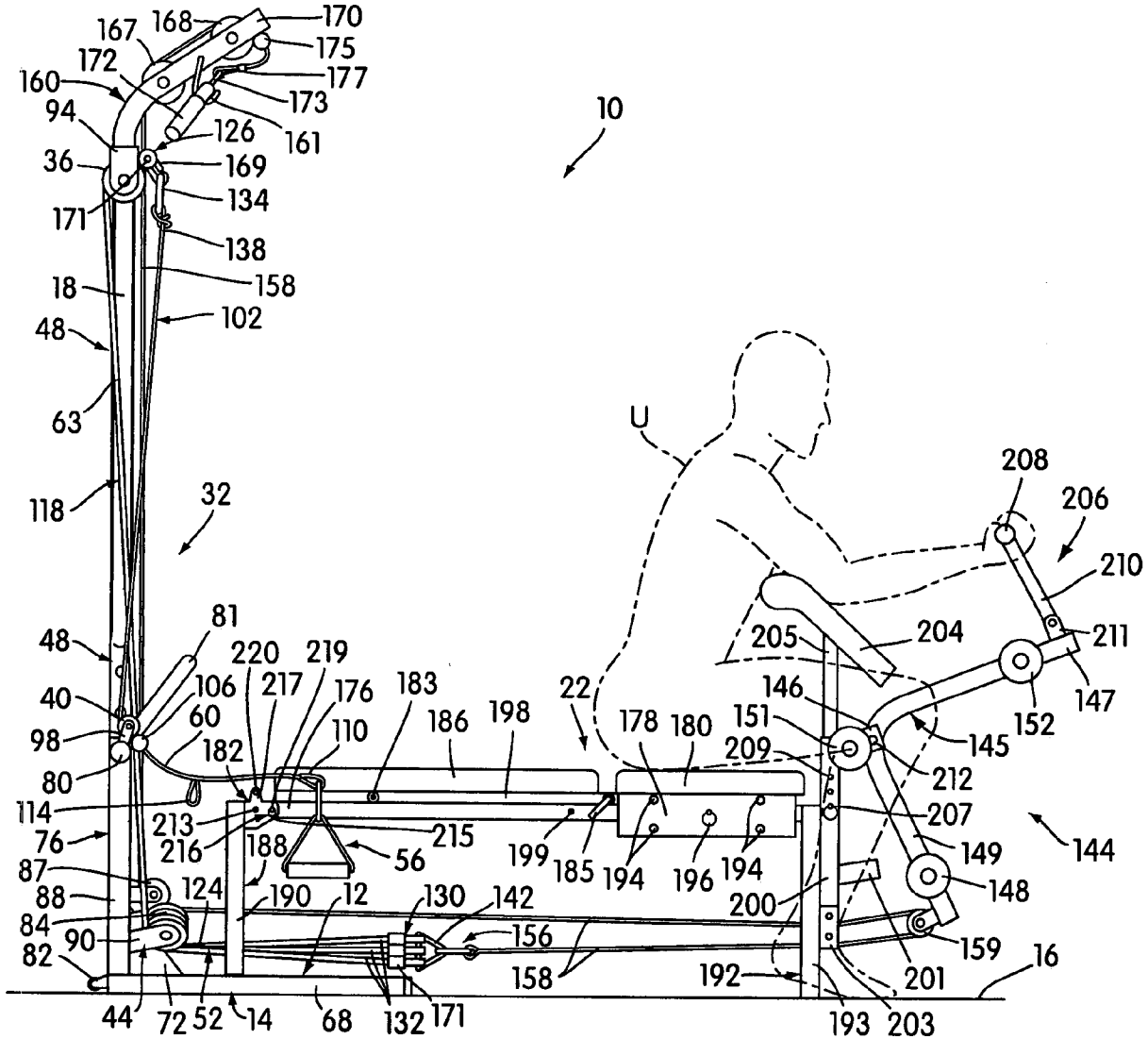
FIG. 7 is a side view of the exerciser of FIG. 2 but showing the arm lift unit being operated to cause the leg-engaging unit to be extended away from the user support assembly while a user is effecting an arm curl exercise.

As shown in FIG. 7, the hand grip units 56, 58 are latched to the looped end portions 110, 112, respectively, and the third connecting terminal is connected to the connector 156. The user support assembly 22 is in its inline bench position thereof or outer position thereof so that the user seat member 180 and the seat back member 186 are substantially parallel to the horizontal surface 16.

First, the user U straddles the user seat member 180 with his/her feet so as to face the leg-engaging unit 144. The user's lower legs (i.e., their shins) engage the leg-engaging members 148, 150 and the user's upper legs (i.e., the back of their knees) engage the leg-engaging members 151, 153 that are mounted to the angled portion 149. The user U may then be seated on the user seat member 180 such that the user's upper legs rest on the leg-engaging members 151, 153. The user's upper arms (i.e., their tricep muscle area) are supported on the upper arm supporting pad 204. The mounting member 205 and the upper arm supporting pad 204 may be vertically adjusted in accordance with the user's physical size.

As best shown in FIG. 7, once positioned on the user seat member 180 with their upper arms on the upper arm supporting pad 204, the user may perform a preacher curl exercise. To perform the preacher curl exercise, the user U would manually grasp the hand-engaging members 208 with an under the handle grip (palms facing upward). The user U would then pull the hand-engaging members 208 toward his/her shoulders, which in turn, causes the linkage bar 210 attached to the straight portion 147 to move the leg-engaging unit 144 from its normal inoperative position into its desired extended position. The bungee cords 63 provide resistance to the movement of the leg-engaging unit 144 as described above and the user U is able to exercise his/her bicep muscle.

Alternatively in this position and not shown, the user U may vary his/her grip from an under the handle grip on the hand-engaging members 208 to an over the handle grip on the hand-engaging members 208. By switching his/her grip on the hand-engaging members 208 and by pulling the hand-engaging members 208 toward his/her shoulders, the user U may exercise different muscles (i.e., their forearm).

In some instances, it may be preferable for the user U to use his/her legs during the preacher curl exercise to assist his/her arms in moving the leg-engaging unit 144 from its normal inoperative position into its desired extended position. By using his/her legs to help move the leg-engaging unit 144 into its desired extended position, the user U may have a higher load on his/her arms during the return or "negative" stroke. In the "negative" stroke, the leg-engaging unit 144 is returned to its normal inoperative position from its desired extended position. As a result of this technique, the user U could resist more weight or resistance than he/she could lift using only his/her arms during the "negative" stroke of the preacher curl exercise, which may help the user U build more muscle mass.

While sitting on the seat member 180 after finishing the preacher curl exercise, the user U may remove the mounting member 205 and the upper arm supporting pad 204 from the arm support mounting member 200 by removing the pin 207 from the horizontally aligned openings 209. The pin 207 may then be replaced through the openings 209 in the mounting member 205 once the mounting member 205 is removed from the arm support mounting member 200.

With the mounting member of 205 and the arm supporting pad 204 removed from the arm support mounting member 200, the user U may easily access the leg-engaging unit 144 to perform a leg extension exercise or a leg-curl exercise, as best shown in FIG. 8.

To perform the leg extension exercise, the user U remains in the same position as during the preacher curl exercise and extends his/her legs forwardly and outwardly from the outer leg structure 192 until his/her legs are substantially parallel with the horizontal surface 16. This movement causes the leg-engaging members 148, 150 of the leg-engaging unit 144 to move from the normal operative position thereof into the desired extended position thereof and provides resilient resistance to the user's legs, especially their quadriceps muscle. While performing a leg extension exercise, the user U may hold onto the seat back member 186 or user seat member 180 for additional support. Also, the user U may grasp the hand-engaging members 208 during the leg extension exercise to assist the leg-engaging unit 144 in moving from its normal inoperative position to its desired extended position. By using his/her arms to help move the leg-engaging unit 144 into its desired extended position, this technique allows the user U to have a higher load on his/her legs during the return or "negative" stroke. That way, the user U can resist more weight or resistance than he/she could lift using only his/her legs during the "negative" stroke of the leg extension exercise, which may help the user U build more muscle mass, as described above.

After the leg extension exercise, the user U may perform the leg-curl exercise. To perform the leg-curl exercise, the user U would reposition himself/herself on the user support assembly 22. The user U repositions himself/herself by standing up from his/her seated position on the user seat member 180. Then he/she moves to straddle the user seat member 180 with his/her feet so as to face the rigid upright support members 18, 20. The user's lower legs (i.e., their shins) engage the leg-engaging members 148, 150 and the user's upper legs (i.e., their thigh or quadriceps muscle) engage the leg-engaging members 151, 153.

The user U would then lay face down on the user support assembly 22 so that his/her legs (i.e., their calves) engage the leg curl members 152, 154. Once positioned, the user U may perform the leg curl exercise to exercise his/her hamstring muscle by bending his/her knee to move the angled portion 149 so that it is substantially parallel to the horizontal surface 16.

After finishing the leg curl exercise, the user U is finished with the leg-engaging unit 144 in the exemplary workout.

The user U may perform various arm, chest and shoulder exercises using the hand grip units 56, 58. For example, a bicep curl may be performed by the user U when he/she is standing above the seat back member 186 with his/her feet straddling the seat back member 186 so as to face the rigid upright support members 18, 20. The user U grasps the hand grip units 56, 58 so that his/her arms are fully extended downwardly and his/her palms face the rigid upright support members 18, 20. Then, the user U would bend his/her arms upwardly at his/her elbows so that the hand grip units 56, 58 would be pulled toward his/her shoulders. The bungee cords 63 resiliently resist this upward movement to exercise the bicep muscle of the user's arm.

Figure 9:
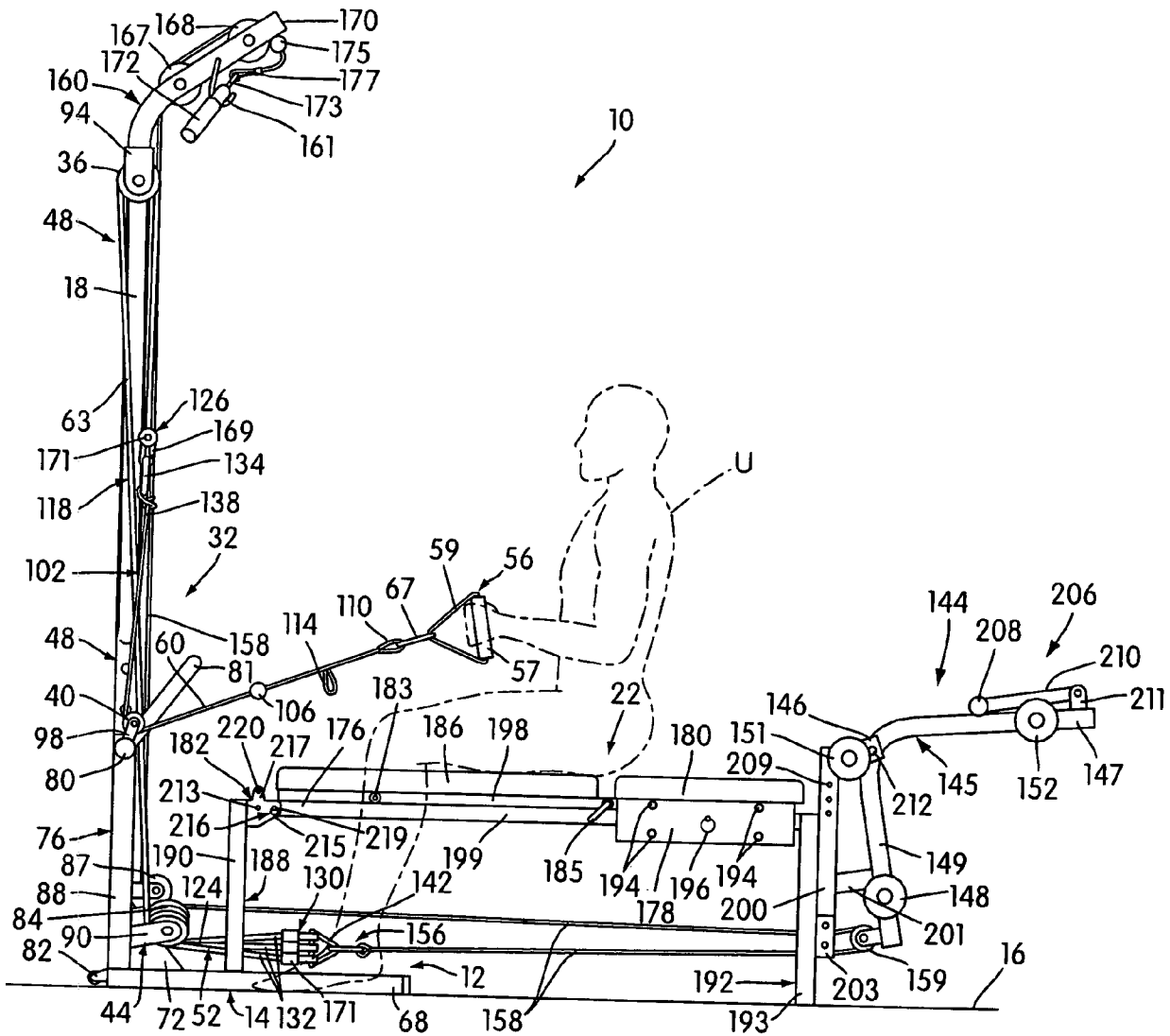
FIG. 9 is a side view of the exerciser of FIG. 2 but showing the hand grip units being extended away from the lower pulley members while a user is effecting a seated rowing exercise.
Figure 10:
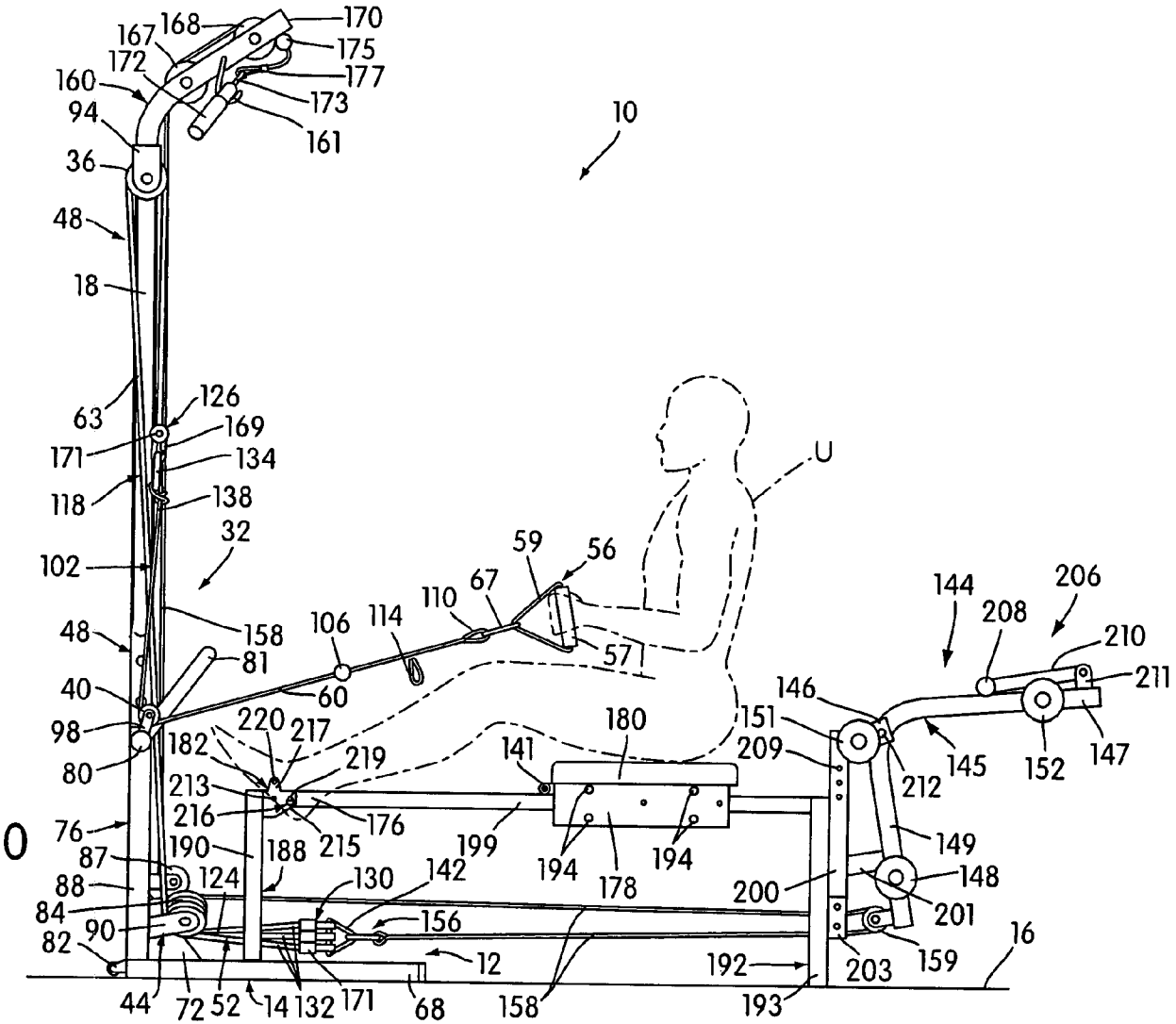
FIG. 10 is a side view of the exerciser of FIG. 2 but showing the hand grip units being extended away from the lower pulley members while a user is effecting an alternative seated rowing exercise.

FIGS. 9 and 10 illustrate two different seated rowing exercises. FIG. 9 shows one seated rowing exercise which may be performed by the user U by sitting on the seat back member 186 facing the rigid upright support members 18, 20. The user U grasps the hand grip units 56, 58 with an over the handle grip and slightly leans backward toward the leg-engaging unit 144. Then, the user U may clasp his/her fingers together so as to bring the hand grip units 56, 58 together. The user U pulls the hand grip units 56, 58 simultaneously toward his/her chest or abdomen against the resilient bias of the bungee cords 63.

The user U may not choose to clasp his/her fingers together when performing the seated row exercise, for example, due to personal preference. In this case, the hand grip units 56, 58 may be moved independently of one another against the resilient bias of the bungee cords 63.

Alternatively, FIG. 10 shows another seated rowing exercise. As illustrated, the user U may perform a different seated rowing exercise using the sliding capabilities of the user seat member 180. In this exemplary exercise, the user U might remove the removable cylindrical shaft member 185 of the pivoted frame support unit 181 from the journaling openings 141 to detach the seat back member 186 from the user seat member 180. Then, the user U may remove the releasably engageable lock 196 from the aligned holes 197 or 199 so that the user seat member 180 can slide along the elongated support member 174 in the longitudinal direction thereof. That way, instead of pulling the hand grips 56, 58 toward his/her chest or abdomen as in the above described seated rowing exercise, the user U might hold the hand grip units 56, 58 near his/her chest or abdomen and roll the user seat member 180 along the elongated support member 174 against the resilient bias of the bungee cords 63.

One way that the user U may roll the user seat member 180 along the elongated support member 174 via the sliding frame unit 178 would be to position his/her feet on the pulley mounting bar 80, the protruding member 81 or the spaced ends 190 of the support member 188 for support. FIG. 10 shows the user U supporting his/her feet on the spaced ends 190, however, the user U may choose to rest his/her feet on the protruding member 81. Then, by extending his/her legs outwardly, the user could move the user seat member 180 from end 176 of the elongated support member 174 to the opposite end 179 thereof against the resilient bias of the bungee cords 63.

The user U may reconnect the seat back member 186 and the user seat member 180 together by reinserting the cylindrical shaft member 185 through the journaling openings 141. It may be preferable for the user U to lock the user seat member 180 from moving by reinserting the releasably engageable lock 196 into the aligned openings 197, 199 before reconnecting the seat back member 186 thereto. Either way, once the seat back member 186 and the user seat member 180 are reconnected, the user U may perform other exemplary exercises described below.

Figure 11:
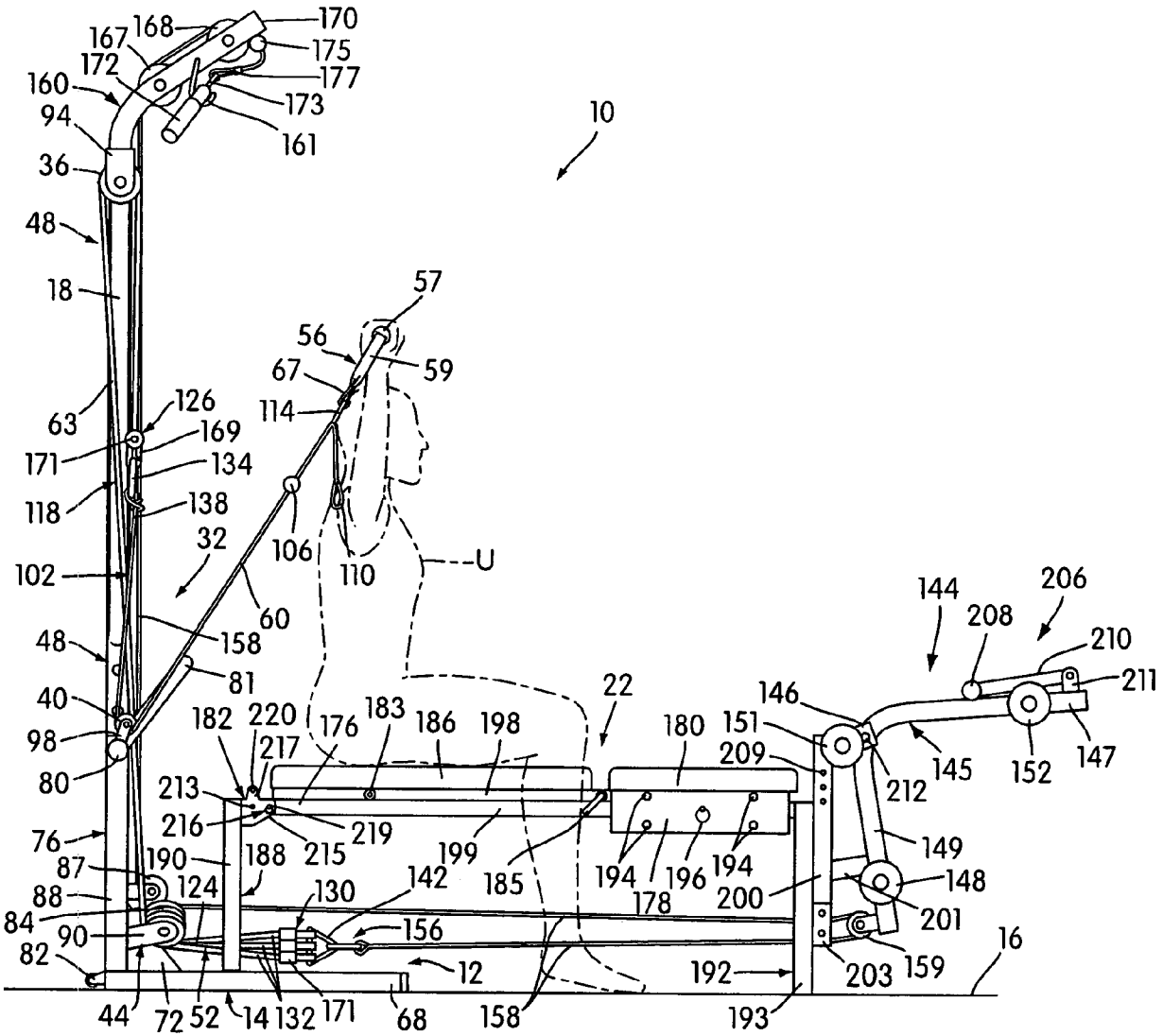
FIG. 11 is a side view of the exerciser of FIG. 2 but showing the hand grip units being extended away from the lower pulley members while a user is effecting a military press exercise.

As shown in FIG. 11, a military or shoulder press may be performed to exercise the arms and shoulders of the user U. First, the user U repositions himself/herself so as to be facing the leg-engaging unit 144 in a seated position on the seat back member 186. Then, the user U grasps the hand grip units 56, 58 with an over the handle grip and bends his/her arms so to position them laterally and inline with his/her shoulders with his/her palms face upwardly. The user U would then extend the hand grip units 56, 58 above his/her head so to extend his/her arms against the resistance of the bungee cords 63.

To perform arm, chest and shoulder exercises with the hand grip bar assembly 160, the user U may connect the latching mechanism 177 through the opening 173 in the hand grip bar 172 to secure the hand grip bar 172 to the elongated flexible non-extensible element 158. Alternatively, the user U may remove the hand grip bar 172 from the J-shaped supporting elements 161, if the hand grip bar 172 is already connected to the hand grip bar assembly 160.

Figure 12:
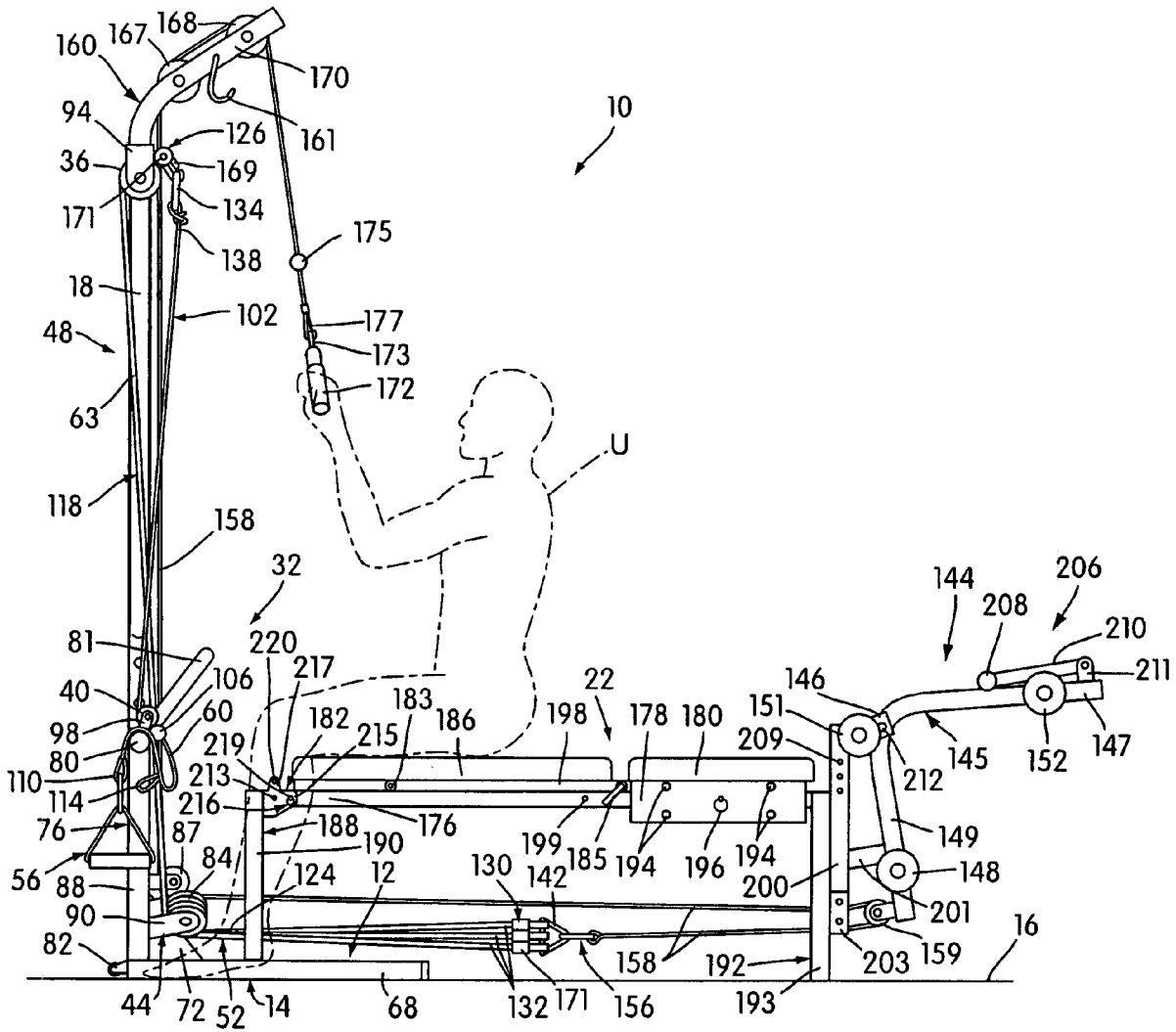
FIG. 12 is a side view of the exerciser of FIG. 4 showing the hand grip bar assembly connected to the exerciser and being extended toward the user support assembly while a user is effecting a lat pull down exercise.

As best shown in FIG. 12, the user U may sit in a seated position on the seat back member 186 so as to face the rigid upright support members 18, 20. In this seated position, the user U may perform a lat pull down exercise, where the user U grasps the hand grip bar 172, slightly leans toward the leg-engaging unit 144, and pulls the hand grip bar 172 towards his/her chest or abdomen. Alternatively, another pull down exercise can be performed by the user U sitting vertically on the seat back member 186 and pulling the hand grip bar 172 toward the back of his/her neck. The user U may also perform the lat pull down exercise while facing the leg-engaging unit 144 in this seated position.

In the exemplary workout, the user U may then sit up from his/her seated position on the seat back member 186 so as to stand above the user seat member 180 with his/her feet straddling the user seat member 180, facing the rigid upright support members 18, 20. To perform the tricep pull down exercise (not shown), the user U manually grasps the hand grip bar 172 with an over the handle grip so that the user's arms are bent at an angle equal to or less than 90 degrees. As the user extends his/her arms downwardly so as to straighten his/her arms, the hand grip bar 172 is moved from the normal inoperative position thereof to the extended position thereof against the resilient resistance of the bungee cords 63 to exercise the user's triceps muscle.

As best shown in FIG. 13, a bench press exercise and/or a chest fly exercise may be performed to exercise certain arm, chest and shoulder muscles. However, to effect these exercises, it may be preferable to move the user seat member 180 from the outer position thereof into the inner position thereof such that the seat back member 186 is disposed at a upwardly sloping angle with respect to the user seat member 180.

In order to move the user support assembly 22, the user U removes the releasably engageable lock 196 from the aligned holes 197. That way, the user seat member 180 can move from the outer position thereof to the inner position thereof via the rollers 194 sliding along the elongated support member 174. The user seat member 180 is moved to its inner position along the elongated support member 174 and releasably locked in the inner position thereof by the releasably engageable lock 196 extending through the horizontally aligned holes 199.

The chest fly exercise may be performed with the user U in the seated position such that the angled seat back support member 186 supports his/her back. To perform the chest fly exercise, the user U would grasp the hand grip units 56, 58 and laterally extend his/her arms so that the hand grip units 56, 58 are extended away from his/her chest. Then, the user U moves the hand grip units 56, 58 in an forwardly arcuate, sweeping motion so as to bring the hand grip units 56, 58 together in front of his/her chest against the resilient resistance of the bungee cords 63. The user U would resist the resilient bias of the bungee cords 63 as he/she move his/her arms back to the laterally extended position in a rearwardly arcuate, sweeping motion.

Another exercise that may be performed with the user U sitting in the user seat assembly 22 when the user seat assembly 22 is in the inner position thereof is a bench press exercise, which exercises the arms and chest of the user U. The user U would grasp the hand grip units 56, 58 with an over the hand grip and bends his/her arms so to position them laterally and inline with his/her shoulders with his/her palms face forwardly. The user U would then extend the hand grip units 56, 58 forwardly away from his/her chest so to extend his/her arms against the resistance of the bungee cords 63.

The hand grip units 56, 58 may be stored on the pulley mounting member 80 when not in use. Also, the user U may grasp the hand grip units 56, 58 with different grips on the hand grip units 56, 58, e.g., an under the handle grip, so as to exercise different muscle groups of the user U for each exercise described hereinabove.

It may be preferable for the exerciser 10 to be stored in the storage position thereof after the user U completes his/her workout. In this case, after moving the user support assembly 22 into the inline bench position shown in FIG. 7, the user U might remove the removable pin 216 from the holes 219. Then, the user U pivots the user support assembly 22 with respect to the frame assembly 12 about the pivoted frame bracket member 182. This pivotal movement positions the user support assembly 22 substantially parallel to the mounting support member 76 such that the user support assembly 22 is spaced from the mounting support member 76. The user may then insert the removable pin 216 through the holes 220 to hold or retain the user support assembly substantially parallel to the mounting support member 76 in its storage position.

For example, the user U may lift the outer leg structure 192 upwardly such that the elongated support member 174 pivots within the pivoted frame bracket member 182. It may be preferable for the user U to place the hand-engaging members 208 within the J-shaped supporting elements 161 so that the user support assembly 22 is releasably secured in the storage position thereof. That way, the J-shaped supporting elements 161 may help retain the exerciser 10 in the storage position thereof. As a result, even if the removable pin 216 is removed from the pivoted frame bracket 182, either accidentally or deliberately, the J-shaped supporting elements 161 retain the hand-engaging members 208 therein and the user seat assembly 22 of the exerciser 10 will not move out of its storage position.

Figure 14:
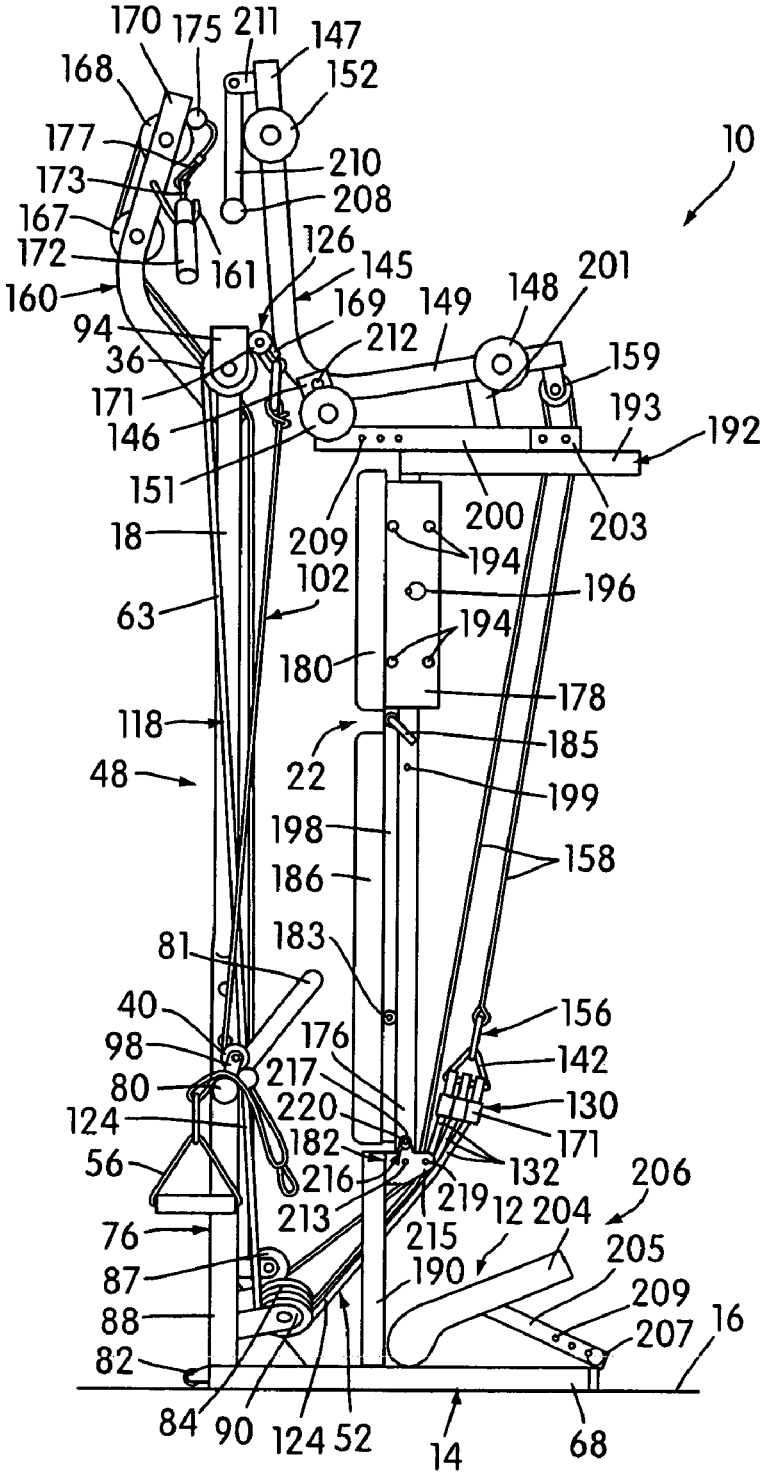
FIG. 14 is a side view of the exerciser of FIG. 1 showing the user seat assembly in the upright storage position thereof.

The hand grip bar 172 may also be supported in the J-shaped supporting elements 161 or may be removed therefrom and placed onto the cover plate 74 (as shown for the arm lift unit 206 in FIG. 14).

Once in the storage position thereof, the user U may transport the exerciser 10 to different locations of use by tilting the frame assembly 12 onto the rollers 82. By tilting the frame assembly 12 in a direction opposed to the direction of the outward extent of the user support assembly 22 when in the operative position, the rollers 82 can support the exerciser 10 thereon so as to facilitate movement thereof. The user U may tilt the frame assembly 12 onto the rollers 82 by holding onto the first and second rigid upright support members 18, 20 and pulling the support members 18, 20 backward (toward the rollers 82). It may be preferable to transport the exerciser 10 with the user support assembly 22 in the storage position thereof.

As further shown in FIG. 14, once the exerciser 10 is stored in the storage position thereof, the arm lift unit 206 may be stored on the cover plate 74

FIGS. 15–27 show another exerciser, generally indicated at 300, which is another embodiment of the exerciser 10 described above. In the following description of the embodiments illustrated in FIGS. 15–27, only the points of difference of the embodiments illustrated in FIGS. 15–27 from the embodiment illustrated in FIGS. 1–14 will be described. That is, in those embodiments, the constituent parts the same as those in the embodiment illustrated in FIGS. 1–14 are referenced correspondingly in the drawings and the description about them will be omitted. The exerciser 300 operates in a substantially similar manner as the exerciser 10, but realizes different construction.

The exerciser 300 comprises a frame assembly, generally indicated at 302, having a left and right series of bungee cords 118, 120 each including a number of bungee cords 63, respectively, mounted thereto to provide resilient resistance to first and second moving assemblies, generally indicated at 332, 334 (FIG. 15), respectively, a leg-engaging unit or leg unit, generally indicated at 344 (FIG. 15), a upright pull down bar unit assembly, generally indicated at 360 (FIG. 18), or a pull down bar, generally indicated at 365 (FIG. 20), all of which are described in greater detail below. The exerciser 300 also includes a user support assembly 322, which is described in greater detail below.

The frame assembly 302 includes a lower frame portion, generally indicated at 304, constructed and arranged to be stablely supported in an operative position on a horizontal surface and the user support assembly 322 is operatively connected with the lower frame portion 304 to support a user thereon.

First and second rigid upright support members 306, 308 are fixed at lower marginal portions 310, 312 thereof on the lower frame portion 304 and extend upwardly from the lower frame portion 304 when in the operative position thereof. The first and second rigid upright support members 306, 308 have first and second rigid upper free end portions 314, 316, respectively. The upper free end portions 314, 316 are configured to curve or extend upwardly from the lower marginal portions 310, 312 thereof in outwardly diverging relation with respect to one another, similar to how upper free end portions 24, 26 are configured. Lower free end portions 318, 320 are configured to curve or extend outwardly from the lower marginal portions 310, 312 thereof in horizontally spaced relation with respect to one another.

A pair of separate moving assemblies 332, 334 is disposed in normal inoperative positions with respect to the user support assembly 322. Each moving assembly 332, 334 is constructed and arranged to be manually engaged and individually manually moved away from the normal inoperative position thereof into a desired extended position by a user supported on the user support assembly 322.

The first and second moving assemblies 332, 334 include first and second upper pulley members 336, 338 rotatably mounted on the upper free end portions 314, 316 of the first and second rigid upright support members 306, 308, respectively. First and second lower pulley members 340, 342 are rotatably mounted on the lower free end portions 318, 320 of the first and second rigid upright support members 306, 308 at fixed positions below the upper pulley members 336, 338, respectively. First and second flexible elongated structures, generally indicated at 344, 346, are trained around the first and second upper pulley members 336, 338 and the first and second lower pulley members 340, 342, respectively. Terminal end portions 348, 350 of the first and second flexible elongated structures 343, 346 extend downwardly from the upper pulley members 336, 338 toward the lower frame portion 14. The terminal end portions 348, 350 can be fixedly secured to one or more end-fixing structures 352, 354 mounted on the lower free end portions 318, 320 of the first and second rigid upright support members 306, 308, respectively. The end-fixing structures 352, 354 are constructed and arranged to prevent upward movements of the terminal end portions 348, 350 and in this embodiment are generally arcuate shaped although other shapes could be used as well.

Figure 25:
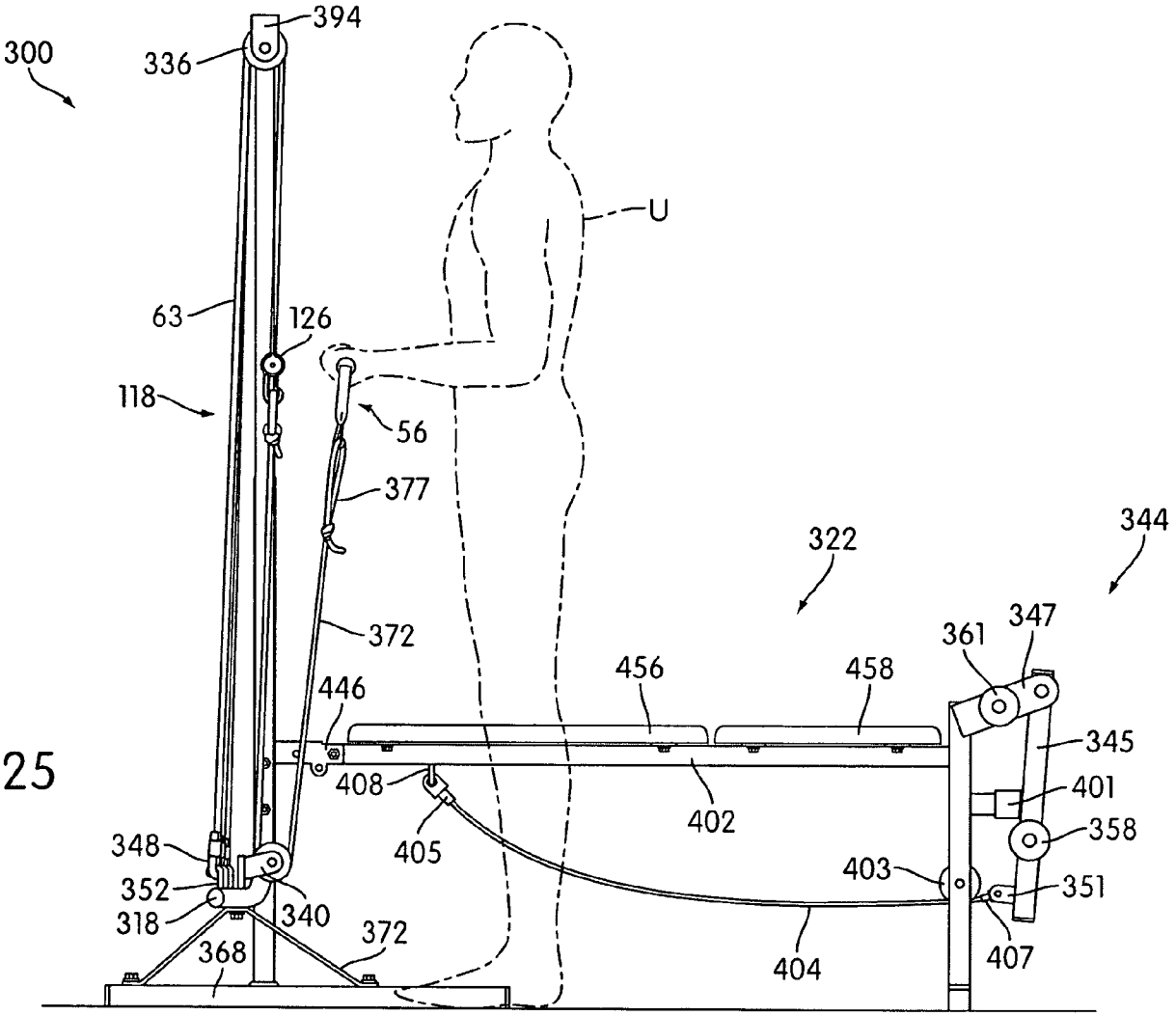
FIG. 25 is a side view of the exerciser of FIG. 15 but showing the hand grip units being extended away from the lower pulley members while a user is effecting an arm curl exercise.

First and second user hand grip units 56, 58 are connected with first and second end portions 60, 62 of the first and second flexible elongated structures 343, 346, respectively (only the user hand grip unit 56 connected to respective end portion 60 is shown in FIG. 25). The end portions 60, 62 are at opposite ends of the first and second flexible elongated structures 343, 346 as the terminal end portions 348, 350. The end portions 60, 62 extend outwardly from the lower pulley members 340, 342 in positions to enable a user supported on the user support assembly 22 to move the user hand grip units 56, 58 away from inoperative positions thereof into desired extended positions.

The first and second flexible elongated structures 343, 346 include the left and right series of bungee cords 63, which constitute resilient resistance structures, at the terminal end portions 348, 350 thereof. The bungee cords 63 resiliently resist movement of the first and second moving assemblies 332, 334, the leg-engaging unit 344, the upright pull down bar unit assembly 360 or the pull down bar 365 and the end portions 60, 62 of the flexible elongated structures 343, 346 away from the inoperative positions thereof into desired extended positions. The bungee cords 63 are further configured to resiliently return the first and second moving assemblies 332, 334, the leg-engaging unit 344, the upright pull down bar unit assembly 360 or the pull down bar 365 to the inoperative positions thereof when no longer moved by the user.

Figure 15:
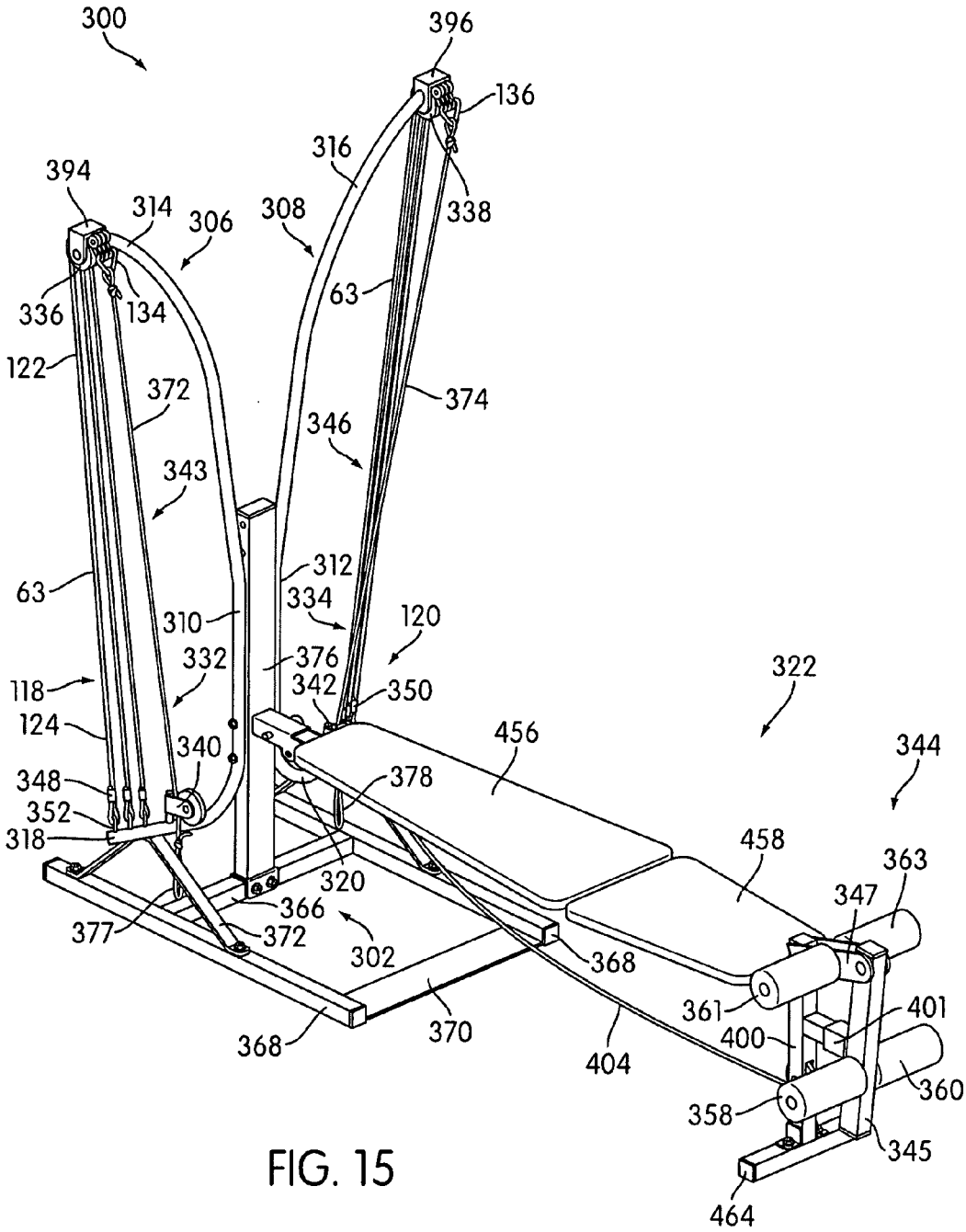
FIG. 15 is a perspective view of another exerciser embodying the principles of the present invention.
Figure 16:
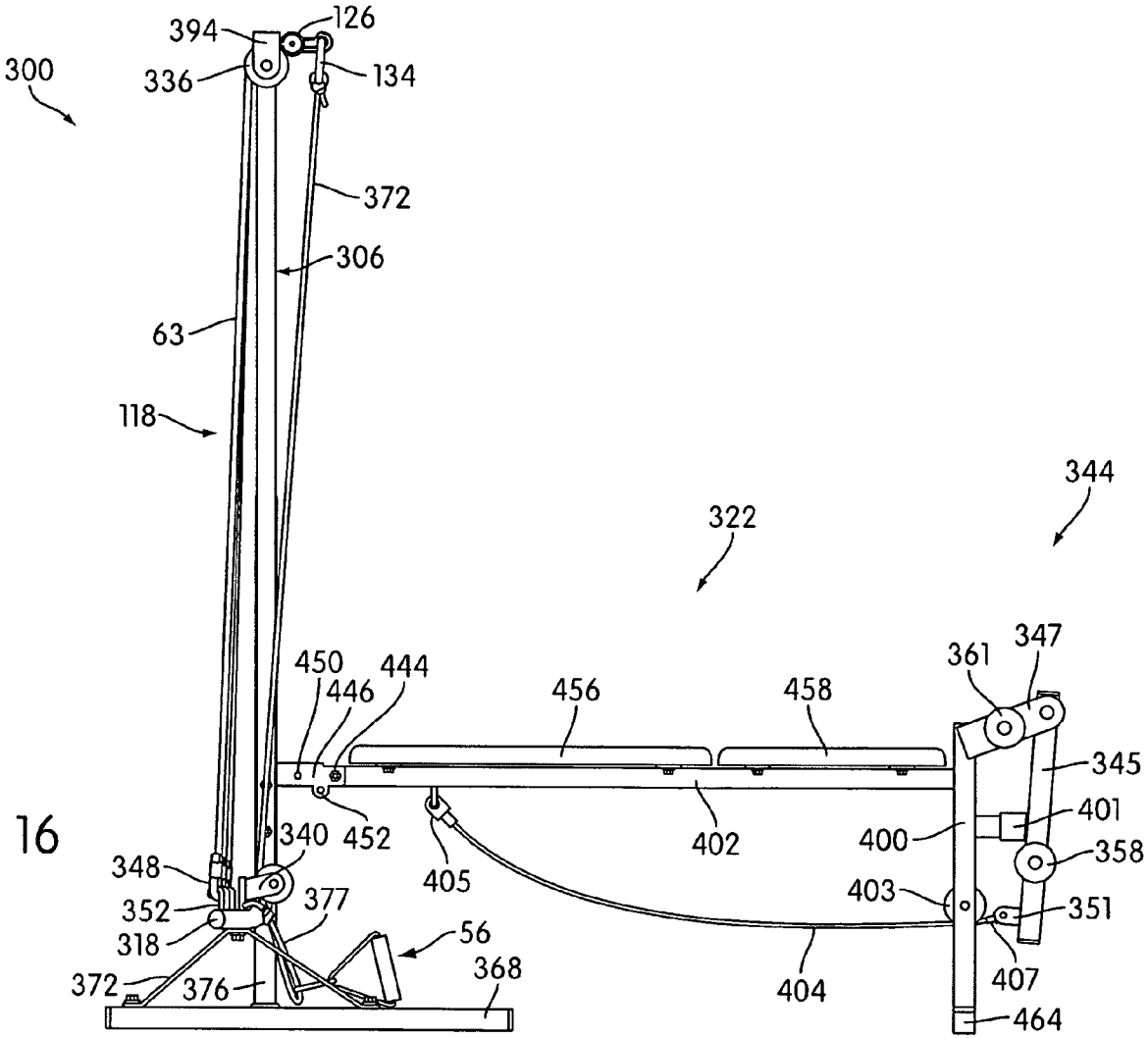
FIG. 16 is a side view of the exerciser of FIG. 15 showing a leg-engaging unit in a normal inoperative position thereof and the user support assembly in the inline bench or outer position thereof.

The lower frame assembly 304 may be formed from a rigid material, such as steel, and includes a substantially symmetrical support base 364. The support base 364 has a generally straight central section 366 and a pair of spaced legs 368 which transversely extend from the central section 366 to provide support to the lower frame portion 304 of the exerciser 300. A cross member 370 extends between the support legs 368 in parallel spaced relation to the central section 366 and a support brace 372 extends upward from each support leg 368 to support respective lower free end portions 318, 320 of the first and second rigid upright support members 306, 308 in order to provide additional support to the lower frame portion 304 and the lower free end portions 318, 320. A cover plate (not shown), which may be made from steel, plastic, wood, such as plywood, or any other type of material, could be positioned in abutting relation to the cross member 370 so as to form a common plane therewith which substantially covers the area extending between the spaced legs 368. As best shown in FIG. 15, a mounting support member 376 vertically extends from the central section 366 of the support base 364. The mounting support member 376 has a hollow transverse cross section, preferably substantially rectangular in form so as to provide sufficient strength and support to the lower frame assembly 304 of the exerciser 300. Other exercise components, such as the upright pull down bar assembly 360, for example, can be positioned within the mounting support member 376 to provide added versatility to the exerciser 300, as will be further described in detail below.

In the illustrated embodiment, each rigid upright support member 306, 308 is mounted, preferably by fasteners or bonding, such as welding, at respective lower marginal portions 310, 312 thereof to the mounting support member 376. The rigid upright support members 306, 308 may be positioned on opposite sides of the mounting support member 376 such that the lower marginal portions 310, 312 thereof abut an upper portion 378 of the mounting support member 376.

FIG. 15 best illustrates the first and second upper pulley members 336, 338 having an upper stop structure 394, 396, respectively, which extends across a peripheral portion thereof. The upper stop structures 394, 396 rotatably mount the first and second upper pulley members 336, 338, respectively on the upper free end portions 314, 316 of the first and second rigid upright support members 306, 308.

The first and second flexible elongated structures 343, 346 further include first and second flexible elongated non-extensible elements 372, 374, such as, for example, nylon cords or other flexible elongated non-extensible elements. The first and second flexible elongated non-extensible elements 372, 374 are trained around the lower pulley members 340, 342 so as to provide the first and second outwardly extending end portions 60, 62, respectively, of the first and second flexible elongated structures 343, 346.

Each non-extensible element 372, 374 can have a stop element in the form of looped end portions 377, 378, respectively, fixed to the respective end portion 60, 62 thereof. Each non-extensible element 372, 374 interengages with the respective lower pulley members 340, 342 to determine the inoperative position of the first and second moving assemblies 332, 334, respectively. More specifically, the stop elements 377, 378 cooperate with the respective lower pulley members 340, 342 to determine the inoperative positions of the end portions 60, 62 of the non-extensible elements 372, 374.

The looped end portions 377, 378 are configured to connect with the first and second hand grip units 56, 58, respectively. The looped end portions 377, 378 selectively engage a selectively connectable and disconnectable connector 406, which is connected with the leg-engaging unit 344, the upright pull down assembly 360 or the pull down bar 365 to provide resilient resistance thereto, as will be described in further detail below.

In the embodiment illustrated in FIG. 15, the bungee cords 63 are grouped into a first and second series of resiliently extensible bungee cords 118, 120 associated with the first and second moving assemblies 332, 334, respectively. Each series of bungee cords 118, 120 may include any number of bungee cords 63, each providing a resilient resistance.

Figure 28:
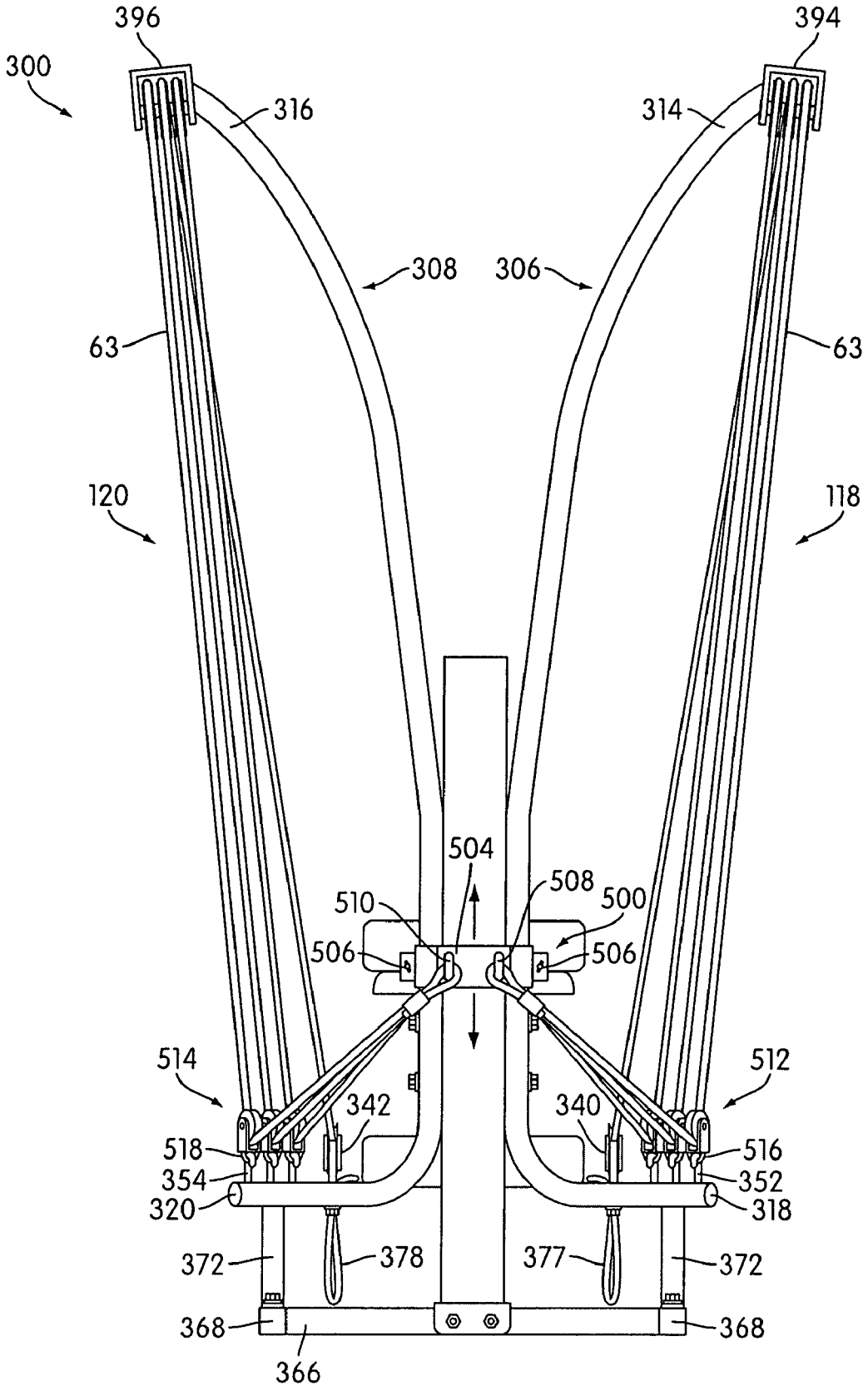
FIG. 28 is a rear view of the exerciser of FIG. 15 with an the for adjusting resistance provided to the exercising assemblies.
Figure 29:
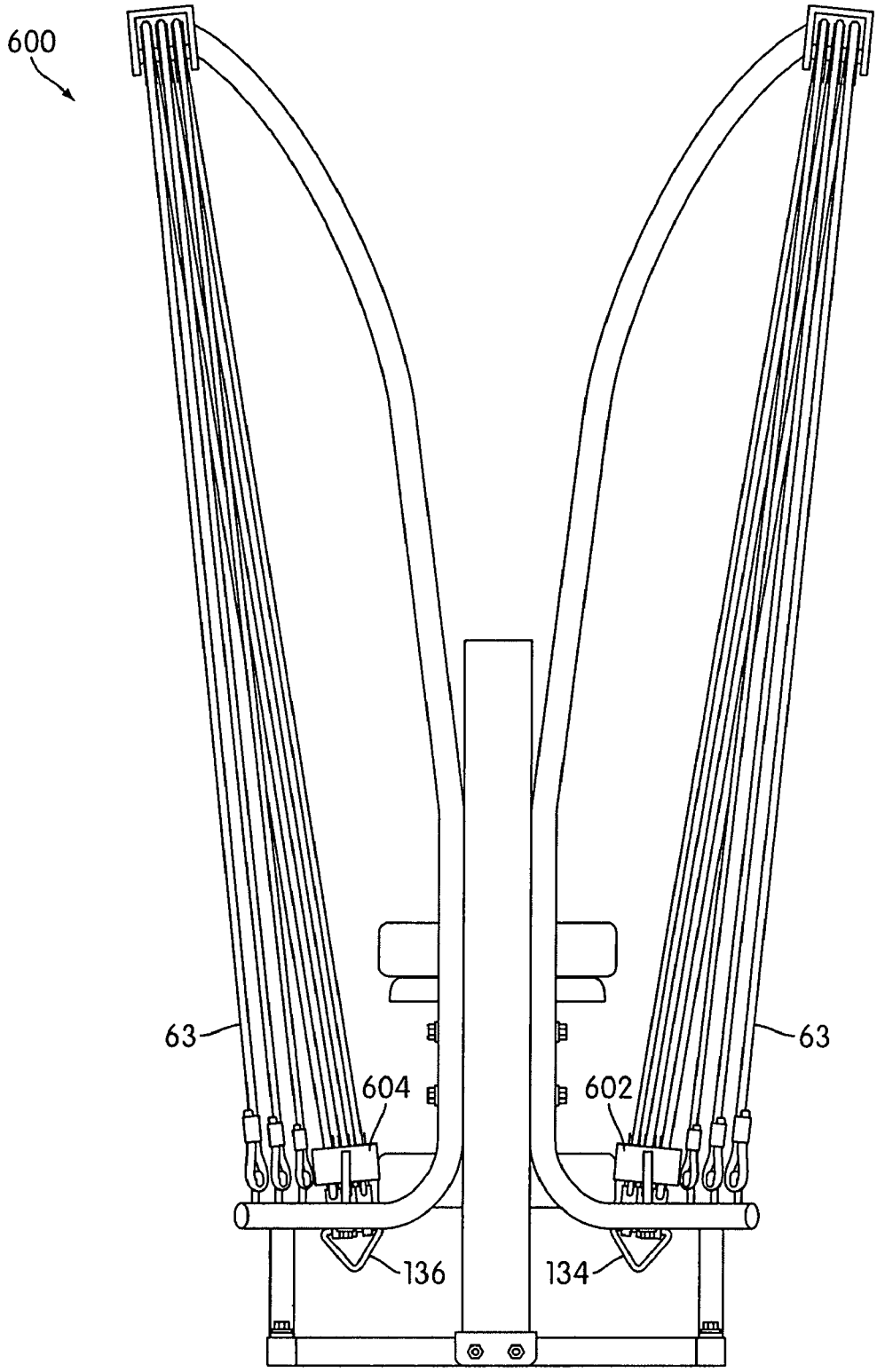
FIG. 29 is a rear view of another exerciser embodying the principles of the present invention capable of adjusting resistance provided to the exercising assemblies.
Figure 30:
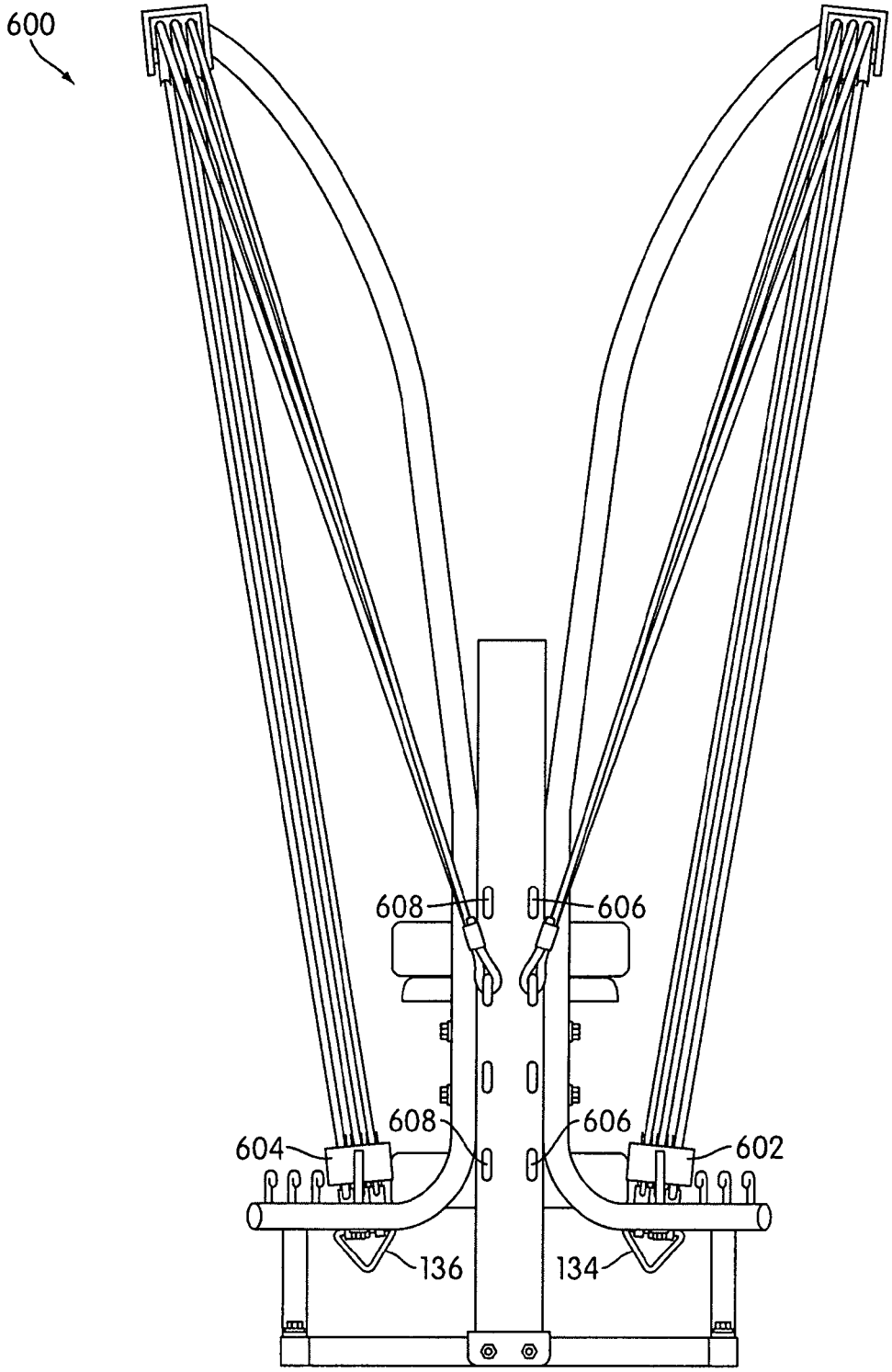
FIG. 30 is a rear view of the exerciser of FIG. 29, but having further adjustment capabilities for adjusting resistance provided to the exercising assemblies.

In the illustrated embodiment, each series of bungee cords 118, 120 includes one bungee cord 63 that provides ten pounds of resistance and two bungee cords 63 that each provide twenty pounds of resistance. However, any number of bungee cords 63 may be used in each series 118, 120 and the bungee cords 63 can have equal or different resilient resistances so as to provide the desired resilient resistance. As shown in FIGS. 28, 29 and 30 and described in greater detail below, the exerciser 300 can include an adjusting mechanism to change the resistance of each series of bungee cords 118, 120.

Each bungee cord 63 in the first and second series 118, 120 has an upper end portion 122 trained around one of the upper pulley members 336, 338 and a lower end portion 124 fixed to the end-fixing structure 352, 354, respectively.

As described above with respect to FIG. 5, upper hook connectors 126 can be fixed on the upper end portions 122 of the bungee cords 63. The upper hook connectors 126 selectively engage with first and second connecting terminals 134, 136, respectively, so that the first and second connecting terminals 134, 136 move substantially in the same direction when the respective moving assemblies 332, 334 are moved away from the normal inoperative position thereof.

The connecting terminals 134, 136 are fixedly disposed on adjacent ends 138, 140 of the associated non-extensible element 372, 374 to provide resilient resistance thereto. For example, the adjacent ends 138, 140 of the non-extensible elements 372, 374 may be fixedly disposed on the connecting terminals 134, 136 by a hook connector or by tying the ends 138, 140 around the respective connecting terminal 134, 136, for example. The connecting terminals 134, 136 are disposed in close proximity to the associated upper stop structure 94, 96 when the moving assemblies 332, 334 are in an inoperative position thereof.

It may be preferable for the connecting terminals 134, 136 to be constructed in the form of rigid annular members, such as metal rings, but the connecting terminals 134, 136 could be formed into any rigid or flexible configuration capable of being engaged by the hook elements 126.

As illustrated in FIGS. 15–18 and 20, the leg-engaging unit 344 is disposed in a normal inoperative position with respect to the user support assembly 322. The leg-engaging unit 344 includes an movable member 345 that is pivotally attached to an outer end portion 347 of the user support assembly 322. The movable member 345 is engaged to be moved away from the normal inoperative position thereof into a desired extended position by a user supported on the user support assembly 322, as will be described in greater detail below.

A pair of horizontally aligned and fixedly spaced leg-engaging members 358, 360 is pivotally mounted to the movable member 345. The leg-engaging members 358, 360 are pivotally movable with the movable member 345 from a normal inoperative position disposed outwardly of the user support assembly 322. Another pair of horizontally aligned and fixedly spaced leg-engaging members 361, 363 are mounted to the movable member 145 above the other pair of leg-engaging members 358, 360 in vertically spaced relation with respect thereto.

In the illustrated embodiment, an outer leg portion 400 is fixedly connected to an elongated support member 402 of the user support assembly 322. A rubber stop member 401 is mounted on the outer leg portion 400 and abuts the movable member 345 when the leg-engaging unit 344 is in the normal inoperative position thereof. A pulley member 403 is rotatably mounted to the outer leg portion 400. An elongated flexible non-extensible element 404 has a connecting terminal 405 at one end connected to a selectively connectable and disconnectable connector 406 for selectively connecting the elongated flexible non-extensible element 404 to the looped end portions 377, 378. The elongated flexible non-extensible element 404 has another end 407 connected to the movable member 345 at a connecting terminal 351. The elongated flexible non-extensible element 404 extends away from the movable member 345 through the pulley 403 toward the looped end portions 377, 378. The elongated flexible non-extensible element 404 can be secured to the elongated support member 402, when not in use, by securing the connecting terminal 405 to structure 408 extending downwardly from the elongated support member 402.

The bungee cords 63 can connect to the elongated flexible non-extensible element 404 when the selectively connectable and disconnectable connector 406 is connected to the looped end portions 377, 378, for example, by a connecting terminal (similar to connecting terminal 156 shown in FIG. 1).

Figure 18:
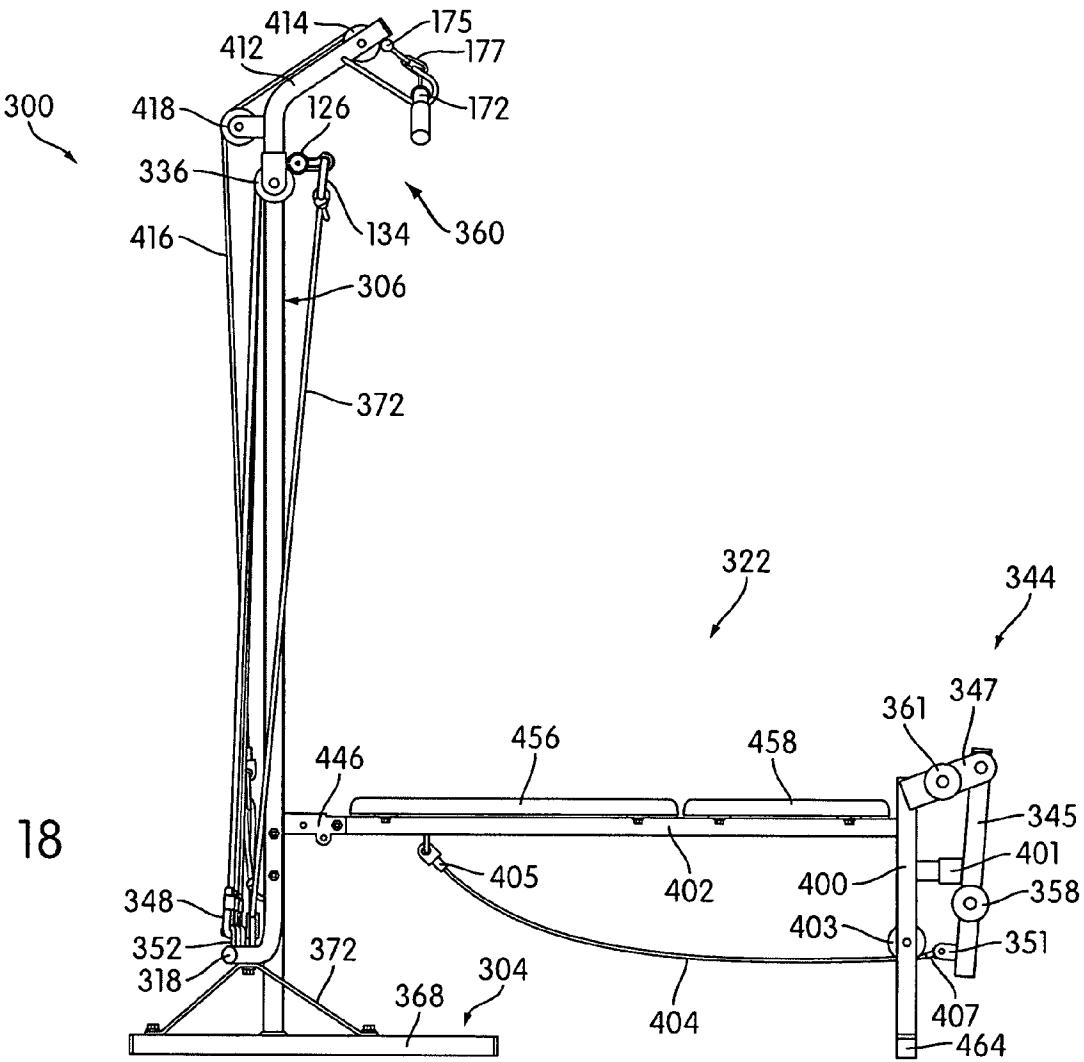
FIG. 18 is a side view of the exerciser of FIG. 15 showing a upright pull down unit connected to the exerciser in a normal inoperative position thereof.
Figure 19:
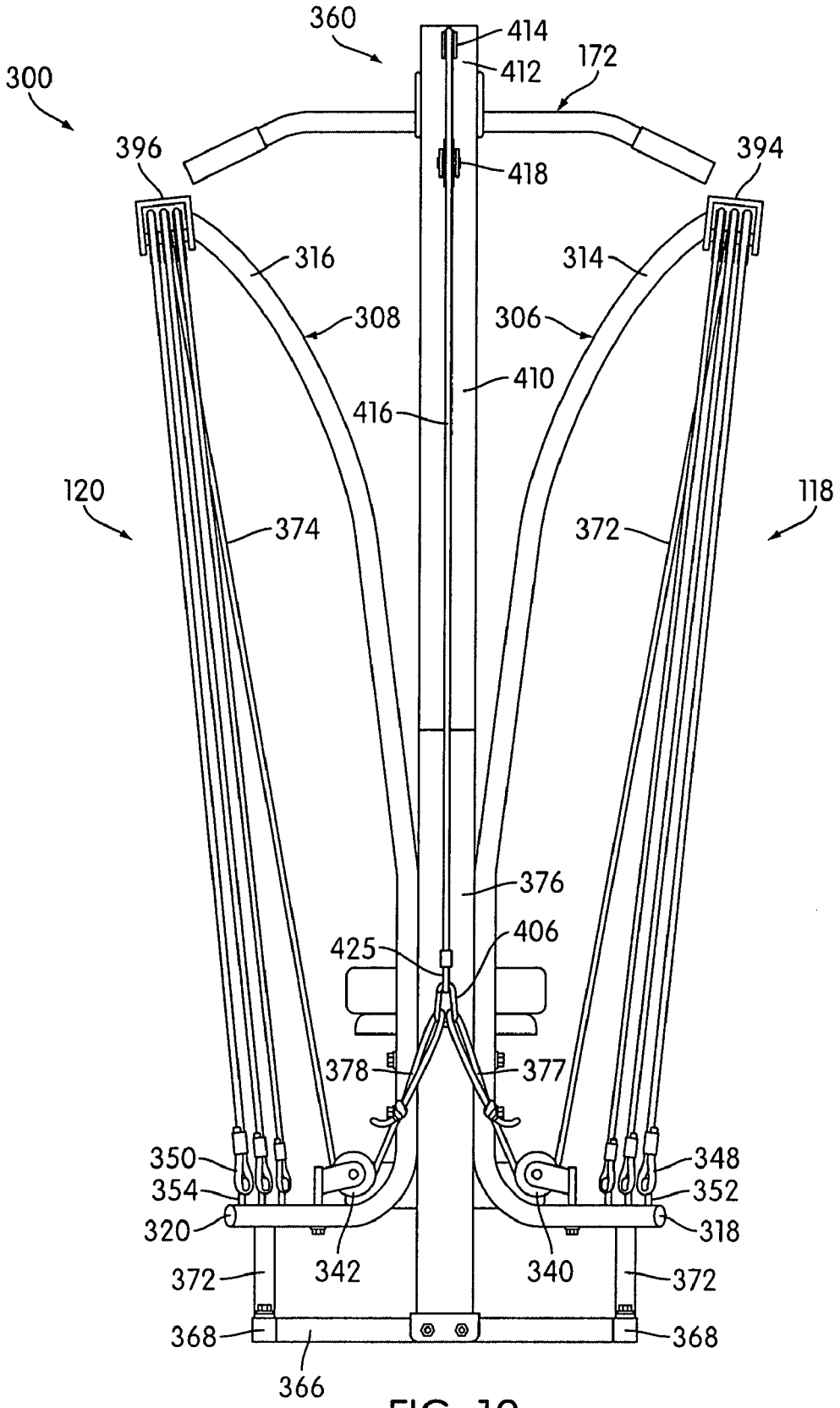
FIG. 19 is a rear view of the exerciser of FIG. 15 with the upright pull down unit connected to the exerciser in a normal inoperative position thereof.

As best shown in FIGS. 18–19, the upright pull down assembly 360 is mounted to extend upwardly from the mounting support member 376. A centrally located upright rigid frame member 410 is disposed within the interior of the mounting support member 376 and is fixedly secured therein by welding, fasteners or any known manner such as, for example screws, nuts and bolts, friction fit, interference fit or any fastener arrangement known in the art.

Alternatively, the fastener arrangement may include a pin and opening arrangement whereby the pin is removable received through a pair of horizontally aligned openings (not shown) extending through the mounting support member 376 and the frame member 410. That way, the fastener could allow optional removable attachment of the frame member 410 of the upright pull down assembly 360.

The upright pull down assembly 360 is carried by the central upright rigid frame member 410 in a normal inoperative position with respect to the user support assembly 322. An upper inclined end 412 of the upright pull down assembly 360 extends upwardly and away from the rigid frame member 410 to support a hand grip bar 172.

Guide pulley members 414, 418 may be rotatably mounted on the upper inclined end 412 of the upright pull down bar assembly 360 to guide an elongated flexible non-extensible element 416. The elongated flexible non-extensible element 416 extends from the hand grip bar 172 of the upright pull down bar assembly 360 and can be selectively connected to the looped end portions 377, 378 through a connecting terminal 425 with the selectively connectable and disconnectable connector 406. The lower pulley members 340, 342 can be pivoted as shown in FIG. 19 to allow for connection of the elongated flexible non-extensible element 416 to the looped end portions 377, 378 of the non-extensible elements 372, 374.

The elongated flexible non-extensible element 416 extends downwardly from the guide pulley members 414, 418 along the centrally located upright frame member 410 to selectively connect to the looped end portions 377, 378.

The manually engageable hand grip bar 172 is the same hand grip bar shown in the hand grip bar assembly 160 and may be engaged by a user and moved away from the normal inoperative position of the upright pull down assembly 360 into a desired extended position thereof by a user supported on the user support assembly 322.

The upper inclined end 412 may include a pair of J-shaped supporting elements 422, which are rigidly mounted to opposite sides thereof. The J-shaped supporting elements 422 are configured to receive and retain the hand grip bar 172 therebetween to stabilize and preclude swinging thereof when not being used. Alternatively, the J-shaped supporting elements 422 may be pivotally mounted to opposite sides of the upper inclined end 412.

A stop element 424 is disposed between the latching mechanism 177 and the upper inclined end 412. The upper inclined end 412 together with the uppermost guide pulley member 414 precludes the stop element 424 and the elongated flexible non-extensible element 416 from moving due to the resilient bias exerted by the bungee cords 63.

Figure 20:
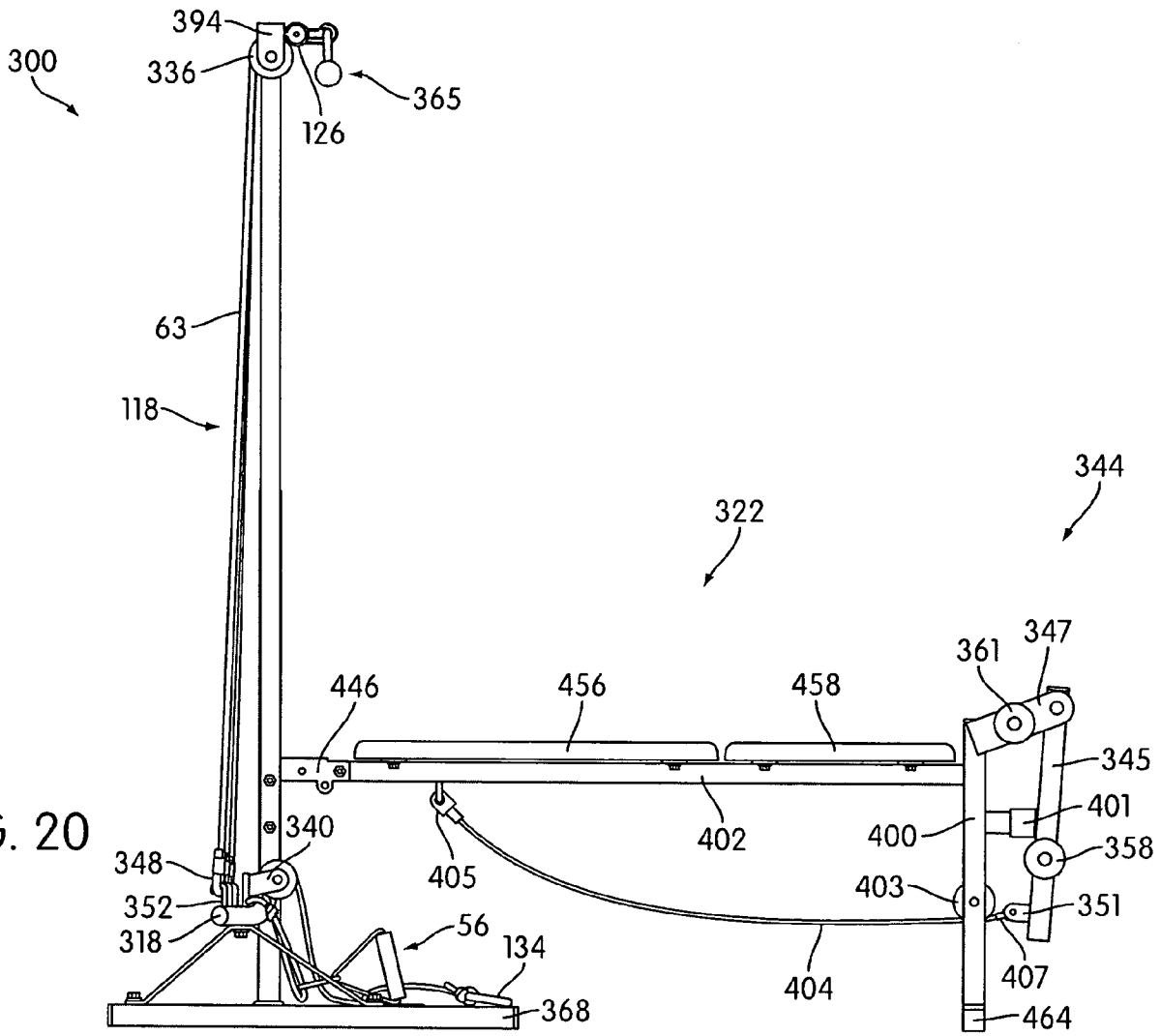
FIG. 20 is a side view of the exerciser of FIG. 15 showing a pull down bar connected to the exerciser in a normal inoperative position thereof.
Figure 21:
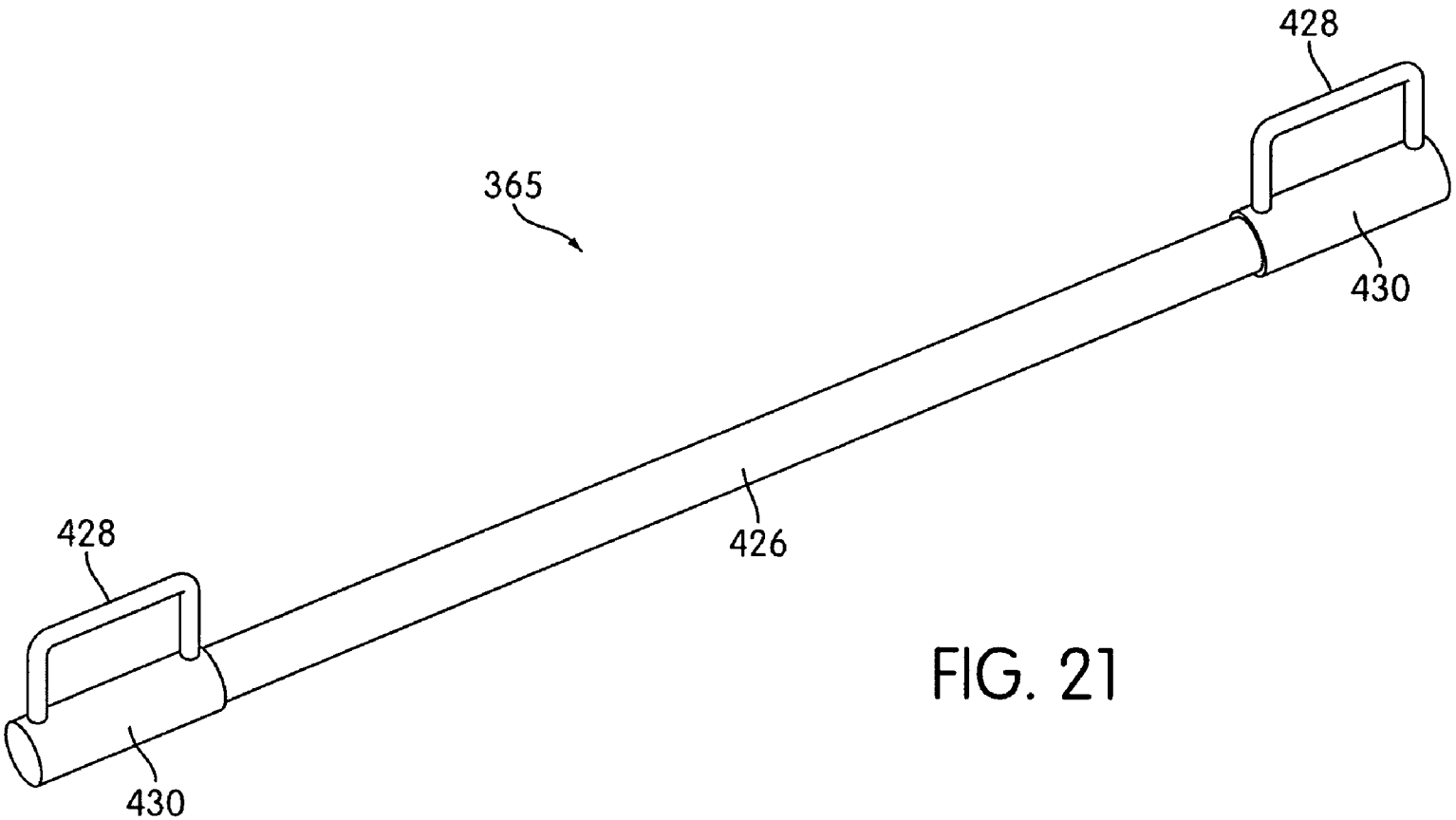
FIG. 21 is a perspective view of the pull down bar shown in FIG. 20.

As shown in FIGS. 20 and 21, a pull down bar 365 can be connected to the left and right series of bungee cords 118, 120. The pull down bar 365 includes a central portion 426 having connector receiving portions 428 extending outwardly from handle portions 430 to receive the hook connectors 126 of each bungee cord 63 in the left and right series of bungee cords 118, 120.

Figure 17:
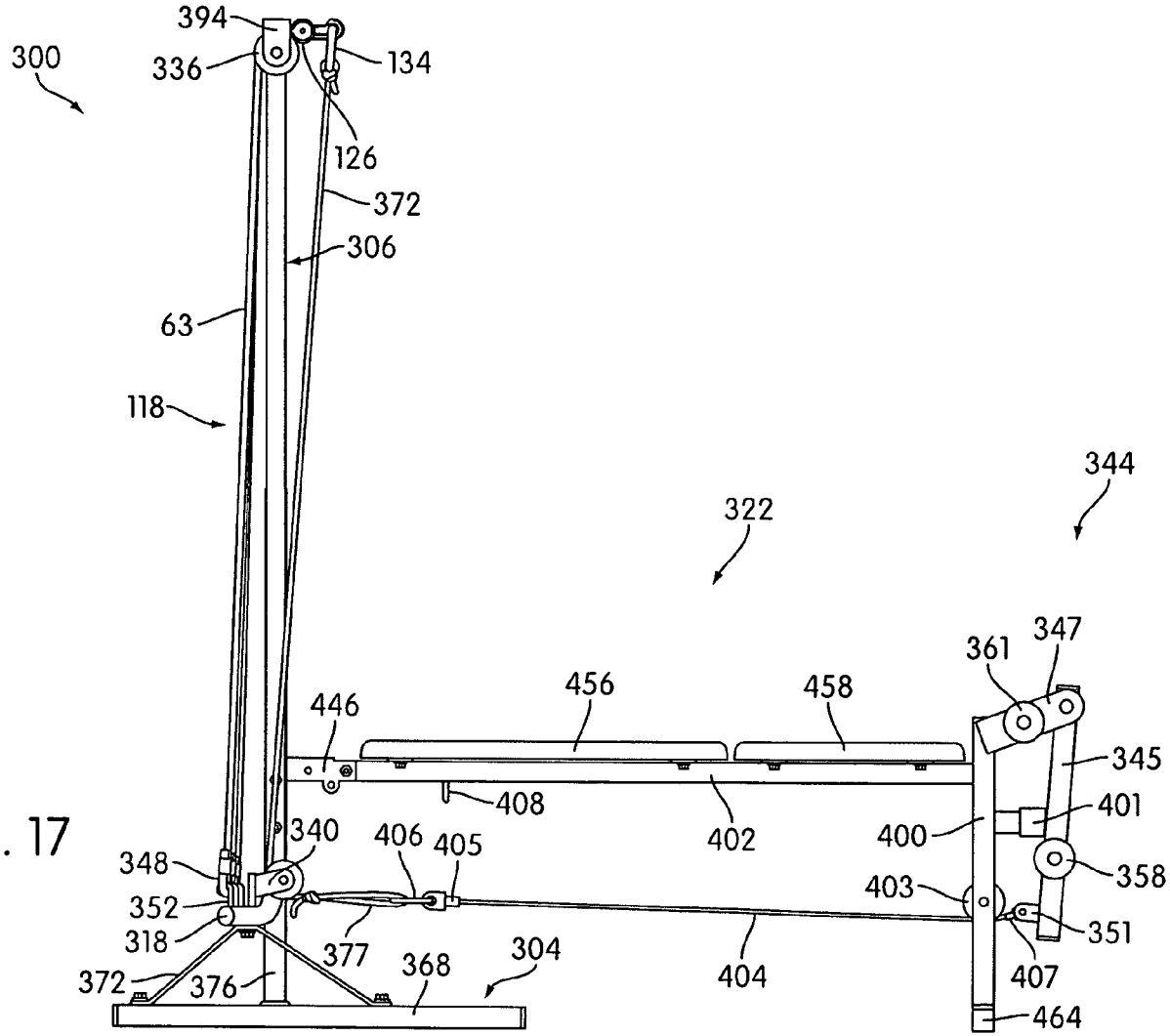
FIG. 17 is a side view of the exerciser of FIG. 15 showing the leg-engaging unit connected to the exerciser in a normal inoperative position thereof and the user support assembly in the upright or inner position thereof.

In FIGS. 17 and 19, the connector 406 is connected to the looped end portions 377, 378 so as to render the leg-engaging unit 344 and the upright pull down assembly 360 to have the movement thereof away from the inoperative position thereof resisted by the bungee cords 63. That way, the bungee cords 63 may provide resistance to the movement of the leg-engaging unit 344 and the upright pull down assembly 360.

As best shown in FIGS. 15–20, the user support assembly 322 includes the elongated support member 402. The elongated support member 402 has one end 440 connected to the outer leg structure 400 and another end 441 connected to a pivoted frame bracket member 442. The elongated support member 402 extends in an operative position generally horizontally outwardly from the pivoted frame bracket member 442 extending from the mounting support member 376. The elongated support member 402 is pivotally attached to the support member 376 by a pivot pin 444, which horizontally extends through both the elongated support member 402 and the pivoted frame bracket member 442.

In the illustrated embodiment, the pivoted frame bracket member 442 provides a projecting flange 446, which projects outwardly from the pivoted frame bracket member 442 toward the leg-engaging unit 344, and a downwardly extending flange 448. The pivoted frame bracket member 442 and the downwardly extending flange 446 define a pair of centrally disposed fastener-receiving holes 450, 452, respectively, therein. The fastener-receiving holes 450, 452 can align with fastener-receiving holes (not shown) in the elongated support member 402 for removably receiving a removable fastener or pin 444 therethrough, as will be described in greater detail below.

In the illustrated embodiment, the user support assembly 322 includes a seat back member 456 and a user seat member 458. The seat back member 456 can be selectively retained in a bench position extending in generally horizontally aligned relation to the user seat member 458 in an outer position thereof and an upright position extending generally inwardly in inclined relation to the user seat member 456 in an inner position thereof.

Alternatively, the seat back member 456 and the user seat member 458 can be fixedly connected to the elongated support member 402. Alternatively, the exerciser 300 can use the pivoted user support assembly 122 discussed above.

In an alternative embodiment not shown, the elongated support member 402 may be telescopically constructed so as to permit movement of the user seat member 458 from the outer position thereof to the inner position thereof by moving the elongated support member in a telescoping manner.

The elongated support member 402 is pivoted at its end 460 so as to be moved between the operative position thereof and an upright storage position. In the operative position, the fastener-receiving holes in the elongated support member 402 align with the fastener-receiving holes 450 in the pivoted frame bracket member 442. By inserting a removable pin 462 through the aligned holes, the elongated support member 402 may be releasably locked into its operative position.

In the storage position, the elongated support member 402, the outer leg structure 400 and the seat back and seat members 456, 458 are pivoted about the end 460 so as to be positioned alongside the mounting support member 376 (and the upright frame member 410 if the upright pull down assembly is attached to the exerciser 300). In the storage position, the fastener-receiving holes in the elongated support member 402 align with the fastener-receiving holes 452 in the downwardly extending flange 448. By inserting the removable pin 462 through the aligned holes, the elongated support member 402 may be releasably locked into its storage position.

The outer leg structure 400 is generally T-shaped with a pair of spaced ends 464 that engage and are supported on the horizontal surface in spaced relation to the frame 302. The outer leg structure 400 is fixed, preferably by welding or fasteners, to the elongated support member 402. The spaced ends 464 support the elongated support member 402 while the elongated support member 402 is in the generally horizontally outwardly extending relation from the pivoted frame bracket member 442 and the lower frame portion 304.

Although not shown, an upper arm supporting pad (similar to pad 204 described above) could be positioned within the hollow configuration of the movable member 345 and secured thereto by a fastener. Additionally, an arm lift unit could be provided on the movable member 345 so that a user could effect arm exercises similar to those described above.

FIG. 28 shows an adjustment mechanism or connecting structure, generally indicated at 500, for use with the exerciser 300 with no modification to the exerciser 300.

The adjustment mechanism or connecting structure 500 includes a substantially U-shaped bracket portions 502, 504 which cooperate to slidably mount the adjustment mechanism or connecting structure 500 to the mounting support member 376. Bracket portion 502, for example, has two leg portions (not shown) which extend through openings formed in the bracket portion 504. Fasteners 506 are secured to the leg portions in order to fixedly secure the bracket portions 502, 504 together.

End-fixing structures 508, 510 extend from the bracket portion 504 to receive the terminal end portions 348, 350 of the first and second flexible elongated structures 343, 346.

A series of pulley members 512, 514 have mounting openings 516, 518 formed therein for receiving cooperating end-fixing structures 352, 354. The series of pulley members 512, 514 can be rotatably mounted to the end-fixing structures 352, 354. The terminal end portions 348, 350 extend through the series of pulley members 512, 514 for engagement with the end-fixing structures 508, 510 extending from the bracket portion 504.

The adjustment mechanism or connecting structure 500 is configured to be slidably received along the mounting support member 376 in a vertical direction to change the resistance (either reduce or increase) the resistance provided by the bungee cords 63. For example, an upward movement of the adjustment mechanism or connecting structure would cause an increase in resistance provided by the bungee cords while a downward movement would cause a decrease in the resistance.

Because the end-fixing structures 508, 510 carry the terminal end portions 348, 350 as the adjustment mechanism or connecting structure 500 is moved along the mounting support member 376, the resistance provided by the bungee cords 63 can be changed.

The operation of the exerciser 300 is identical with or without the adjustment mechanism or connecting structure 500, but with the adjustment mechanism or connecting structure 500 resistance adjustment can be realized.

In the following description of the embodiments illustrated in FIGS. 29–30, only the points of difference of the embodiments illustrated in FIGS. 29 and 30 from the embodiment illustrated in FIGS. 15–28 will be described.

FIG. 29 shows an exerciser 600 having lower pulley members 602, 604 which differ from lower pulley members 340, 342 described above. The pulley members 602, 604 are configured to receive each bungee cord 63, after each bungee cord has been trained about the upper pulley members 336, 338. By "pre-loading" the bungee cords 63 by training the bungee cords 63 over the upper pulley members 336, 338, the resistance provided by those bungee cords will be increased over the resistance provided in exerciser 300.

The operation of the exerciser 600 is identical to the operation of the exerciser 300 with or without the adjustment mechanism or connecting structure 500. However, when connecting the hand grips 56, 58, the leg-engaging unit 344, the pull down assembly 360 or the pull down bar 365 to exerciser 600, the bungee cords 63 will be selectively connected to theses exercising assemblies through the connecting terminals 134, 136 instead of through the looped end portions 377, 378 of exerciser 300.

Although exercisers 500 and 600 are described as separate embodiments herein, it is possible to replace the lower pulley members 340, 342 of exerciser 500 with the lower pulley members 602, 604 of exerciser 600. Additionally, the bungee cords 63 could be "pre-loaded" as described above when the lower pulley members 602, 604 replace the lower pulley members 340, 342.

FIG. 30 shows the exerciser 600, but with end-fixing structures 606, 608 extending from the mounting support member 376 to receive the terminal end portions 348, 350 of the first and second flexible elongated structures 343, 346. The end-fixing structures 606, 608 are aligned in series along the mounting support member 376.

The pulley members 602, 604 receive each bungee cord 63, after each bungee cord has been trained about the upper pulley members 336, 338, so that the bungee cords 63 are "pre-loaded" as shown in FIG. 29. The end-fixing structures 606, 608 provide additional adjustment by allowing for the terminal end portions 348, 350 to be selectively received by the end-fixing structures 606, 608.

Positioning the terminal end portions 348, 350 on the uppermost end-fixing structures 606, 608 will provide the greatest resistance, while positioning the terminal end portions 348, 350 on the lowermost end-fixing structures 606, 608 will provide the least resistance. In some situations, it may be preferable to have different resistances for each terminal end portion 348, 350. In this case, terminal end portion 348 could be positioned on the uppermost end-fixing structure 606 while terminal end portion 350 be positioned on the lowermost end-fixing structure 608. Accordingly, the left and right series of bungee cords, will provide different resistances to the exercising assembly attached thereto.

Operation

In FIGS. 22–27, a user U is shown schematically. Motions of the user's arms, legs, or body, as well as motions of the moveable parts of the exerciser 300 are illustrated by broken lines. Resistance is provided by the resilient bungee cords 63 and can be adjusted to suit the user's requirements and physical abilities, as described above. Various exercises are described below in connection with different positions of the user.

Before certain hand, arm or chest exercises can be performed, each hand grip unit 56, 58, the pull down bar 365 or the upright pull down assembly 360 must be attached to the respective moving assembly 332, 334. To attach the hand grip units 56, 58, the user U latches each hand grip unit 56, 58 to either the respective looped end portion 377, 378. To attach the pull down bar 365, the user U connects one or more bungee cords 63 to the connector receiving portions 428 of the pull down bar 365. To attach the upright pull down assembly 360, the user U secures the centrally located upright rigid frame member 410 within the interior of the mounting support member 376 and connects the elongated flexible non-extensible element 416 to the looped end portions 377, 378 with connector 406.

The exercises illustrated in FIGS. 22–27 are performed with the user support assembly 322 in the outside position thereof. The exerciser 300, however, enables the user U to execute a variety of physical exercises with the user support assembly 122 in the upright or inside position thereof as described above.

The hand grip units 56, 58 are identical in construction and operation, therefore only the operation of the hand grip unit 56 will be described below.

After latching the hand grip unit 56 to the looped portion 377, the user U may perform various arm, chest and shoulder exercises therewith by moving the hand grip unit 56 away from the lower pulley member 340.

Figure 22:
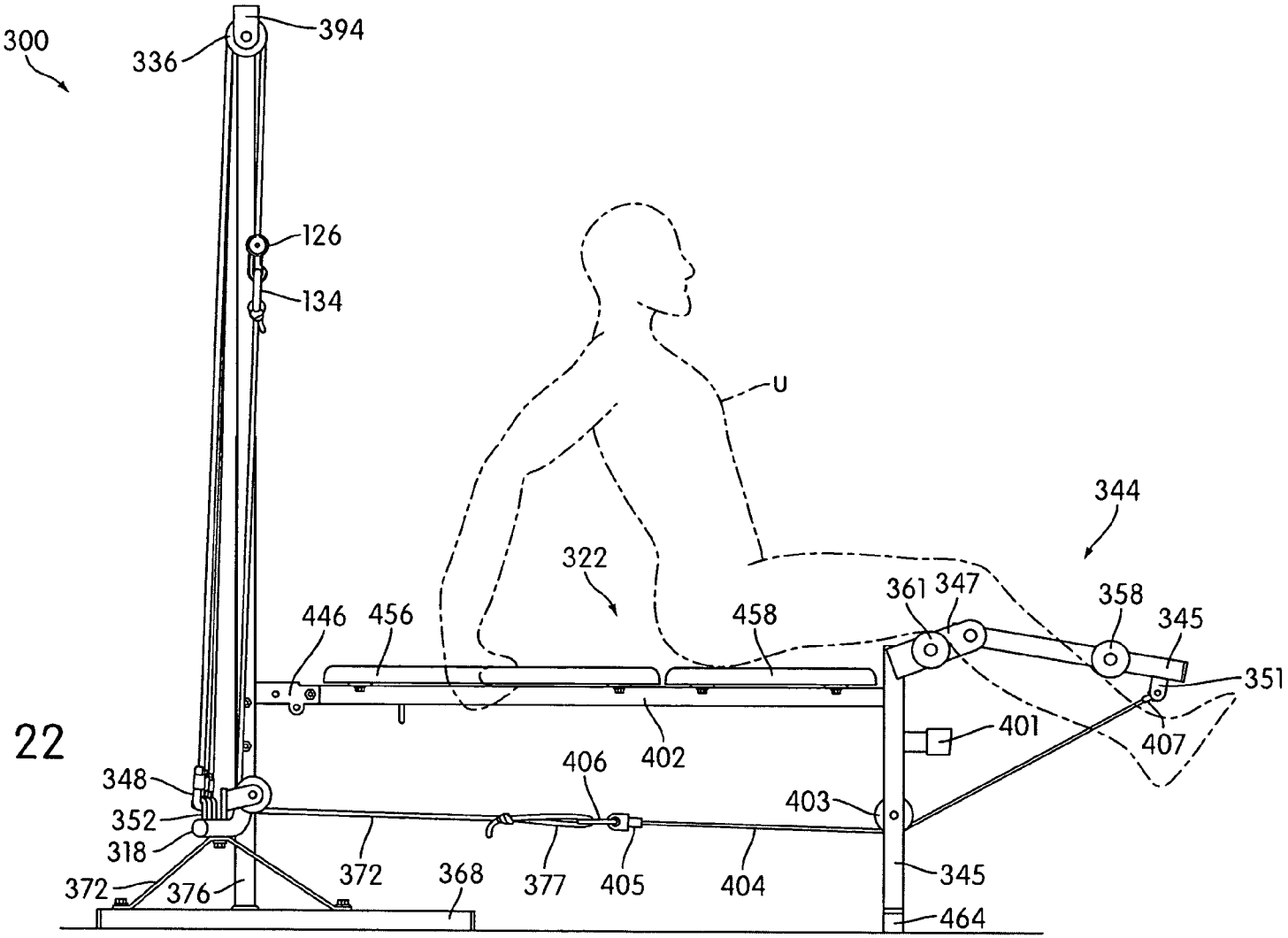
FIG. 22 is a side view of the exerciser of FIG. 15 but showing the leg unit being extended away from the lower pulley members while a user is effecting a leg extension exercise.

As shown in FIG. 22, the first connecting terminal 134 is connected with the flexible elongated non-extensible element 372 via the upper hook element 126 of each bungee cord 63. That way, the first connecting terminal 134 and the flexible elongated non-extensible element 372 move substantially in the same direction when the moving assembly 332 is moved away from the normal and operative position thereof. Particularly, as the hand grip unit 56 is moved away from the lower pulley member 340, the terminal end portions 348, 350 are prevented from moving upward by end-fixing structures 352, 354, which in turn, allows the moving assembly 332 to be manually moved downwardly away from the normal inoperative position thereof.

The bungee cords 63 may be constructed so to provide resilient resistance throughout the operative extent thereof to the movement of the first and second moving assemblies 332, 334 away from the inoperative positions thereof.

Without sufficient manual force on the hand grip unit 56 away from the lower pulley 340, the bungee cords 63 provide a resilient bias throughout the operative extent thereof. The resilient bias of the bungee cords 63 will move the moving assembly 332 toward the normal inoperative position thereof until the looped end portion 377, 378 abuts the lower pulley member 340, 342.

During various exercises, as will be described in greater detail below, it may be preferable for the user U to maintain manual force on the hand grip unit 56 away from the lower pulley member 340. That way, the bungee cords 63 provide continuous resilient resistance to the exercised muscle throughout the exercise.

The operation of the leg-engaging unit 344 will now be described (FIG. 22). To prepare the leg-engaging unit 344 for certain leg exercises, the user U connects the looped end portions 377, 378 to the connecting terminal 405 with connector 406 so that the bungee cord 63 may provide resilient resistance to the leg-engaging unit 344. The looped end portions 377, 378 and the connecting terminal 405 move together as the leg-engaging unit 344 is moved into its extended position.

Movement of the leg-engaging unit 344 away from the inoperative position thereof causes the connecting terminal 405 to move away from the first and second connecting terminals 134, 136. Thus, enabling the bungee cords 63 connected to the first and second connecting terminals 134, 136 to provide resilient resistance throughout the operative extent thereof to the movement of the leg-engaging unit 344 away from the inoperative position thereof.

As the leg-engaging unit 344 is moved towards its extended position, the movable member 345 is pivoted about the outer end portion 440 of the elongated support structure 402. The flexible non-extensible element 404 is trained around the pulley 403 so as to allow the leg-engaging unit 344 to move smoothly from the normal inoperative position thereof into the desired extended position thereof. In the extended position, the movable member 345 is disposed in generally substantially parallel relation with respect to the horizontal surface.

Figure 24:
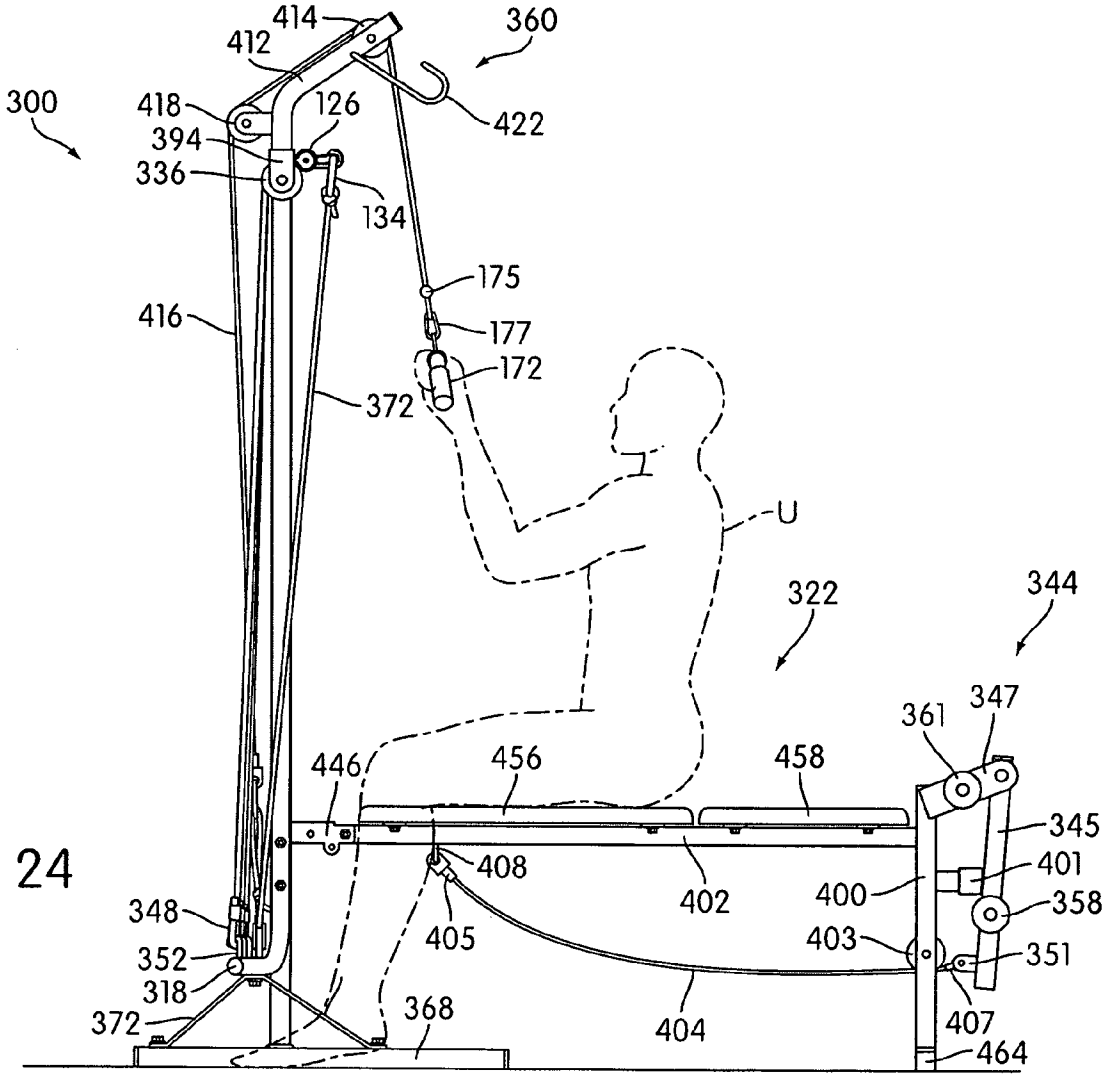
FIG. 24 is a side view of the exerciser of FIG. 15 but showing the upright pull down unit being extended away from the upper pulley members while a user is effecting an arm exercise or a lat pull down exercise.

The operation of the upright pull down assembly 360 will now be described (FIGS. 18, 19 and 24).

When the user U connects the elongated flexible non-extensible element 416 to the looped end portions 377, 378 with connector 406, the resilient bias of the bungee cords 63 causes the stop element 175 positioned on the flexible non-extensible element 416 to abut against the uppermost guide pulley 414 and the inclined portion 412. When moved away from the normal inoperative position thereof, the manually engageable hand grip bar 172 is moved toward a desired extended position thereof by manual force exerted by a user U supported on the user support assembly 322 or standing nearby. As the hand grip bar 172 is moved away from its normal inoperative position and toward its desired extended position, the bungee cords 63 provide resilient resistance to the movement thereof as the hand grip bar 172 is moved. The stop element 175 and the latching mechanism 177 move together with the hand grip bar 172 as the hand grip bar 172 is moved away from its normal inoperative position.

Figure 23:
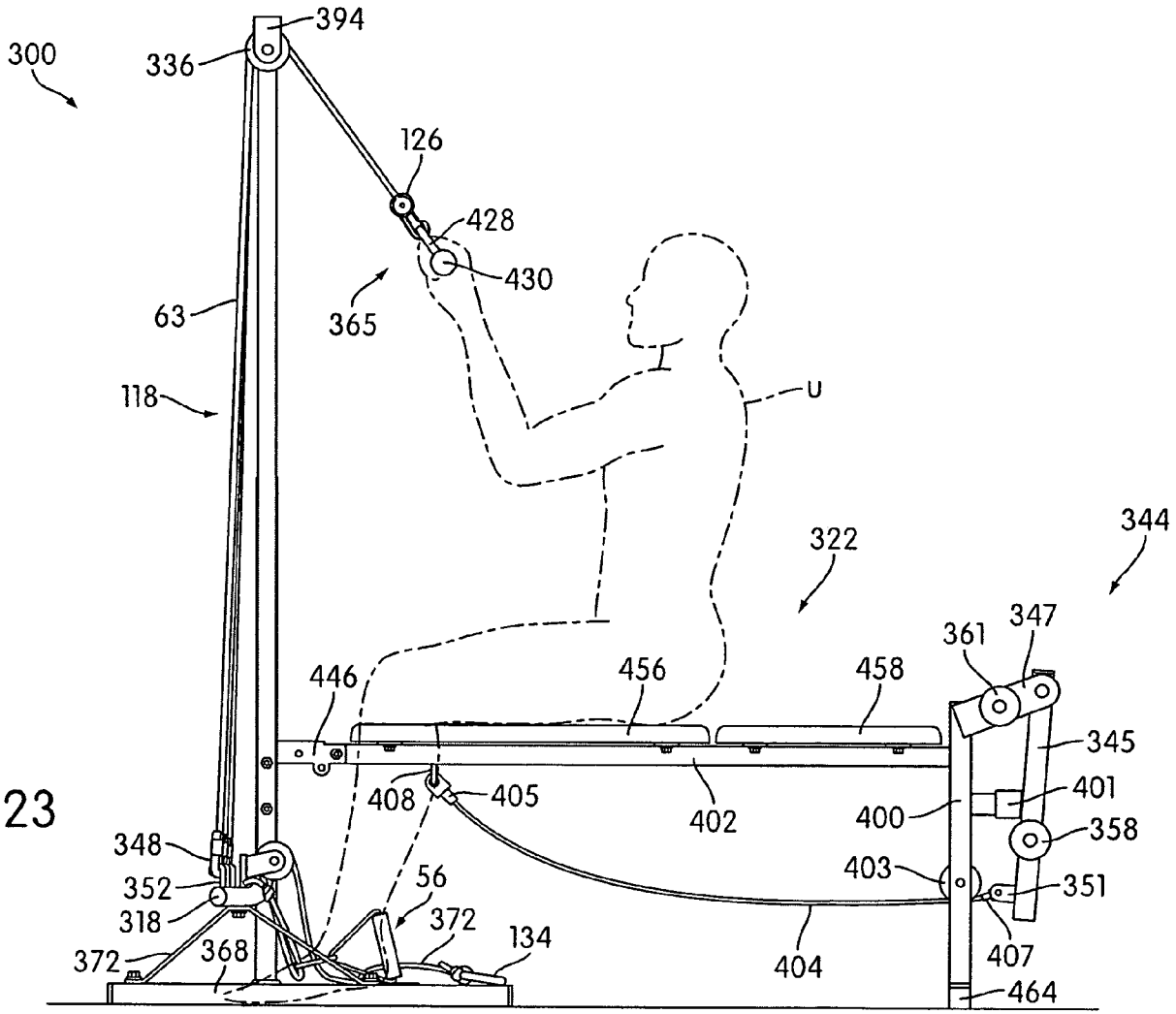
FIG. 23 is a side view of the exerciser of FIG. 15 but showing the pull down bar being extended away from the upper pulley members while a user is effecting an arm exercise or a lat pull down exercise.

The operation of the pull down bar 365 will now be described (FIGS. 20–21 and 23).

When the user U connects one or more bungee cords 63 to the connector receiving portions 428 of the pull down bar 365, the resilient bias of the bungee cords 63 is transferred to the pull down bar 365. When moved away from the normal inoperative position thereof, the pull down bar 365 is moved toward a desired extended position thereof by manual force exerted by a user U supported on the user support assembly 322 or standing nearby. As the pull down bar 365 is moved away from its normal inoperative position and toward its desired extended position, the bungee cords 63 provide resilient resistance to the movement thereof as the pull down bar 365 is moved.

The operation of exerciser 300 has been fully described above, however, to show the versatility of the exerciser 300 various exercise examples will be described in greater detail below.

Although exercises can be performed individually or successively, it is contemplated that the exercises described herein may be performed in any sequence. An exemplary workout having a particular exercise sequence is described below, but more or less exercises can be performed at the user's discretion.

FIG. 22 shows a user U performing a leg-extension exercise. To effect this exercise, the user U could straddle the user seat member 458 with his/her feet so as to face the leg-engaging unit 344. The user's lower legs (i.e., their shins) engage the leg-engaging members 358, 360 and the user's upper legs (i.e., the back of their knees) engage the leg-engaging members 361, 363 that are mounted to the outer end portion 347 of the user support assembly 322. The user U may then be seated on the user seat member 458 such that the user's upper legs rest on the leg-engaging members 361, 363.

From this position, the user U may easily access the leg-engaging unit 344 to perform a leg extension exercise or a leg-curl exercise, as best shown in FIG. 22.

To perform the leg extension exercise, the user U extends his/her legs forwardly and outwardly from the outer leg structure 400 until his/her legs are substantially parallel with the elongated support member 402 and the horizontal surface. This movement causes the leg-engaging members 358, 360 of the leg-engaging unit 344 to move from the normal operative position thereof into the desired extended position thereof and provides resilient resistance to the user's legs, especially their quadriceps muscle. While performing a leg extension exercise, the user U may hold onto the seat back member 456 or user seat member 458 for additional support.

After the leg extension exercise, the user U may perform the leg-curl exercise as described above, but with his/her legs (i.e., their calves) engage the leg-engaging members 361, 363 instead of the leg curl members 152, 154 described above.

After finishing the leg extension or leg curl exercise, the user U is finished with the leg-engaging unit 344 in the exemplary workout.

Figure 26:
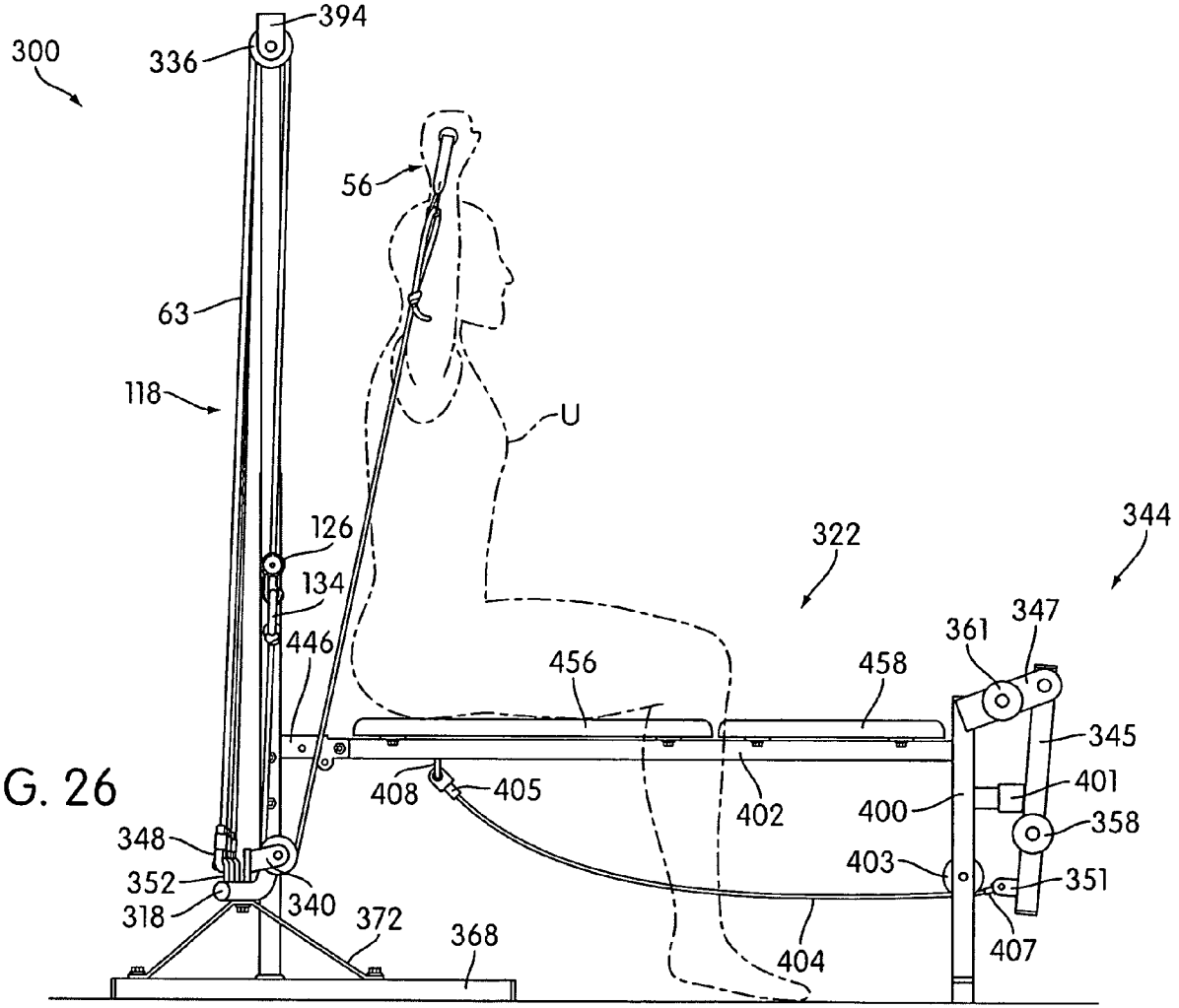
FIG. 26 is a side view of the exerciser of FIG. 15 but showing the hand grip units being extended away from the lower pulley members while a user is effecting a military press exercise.
Figure 27:
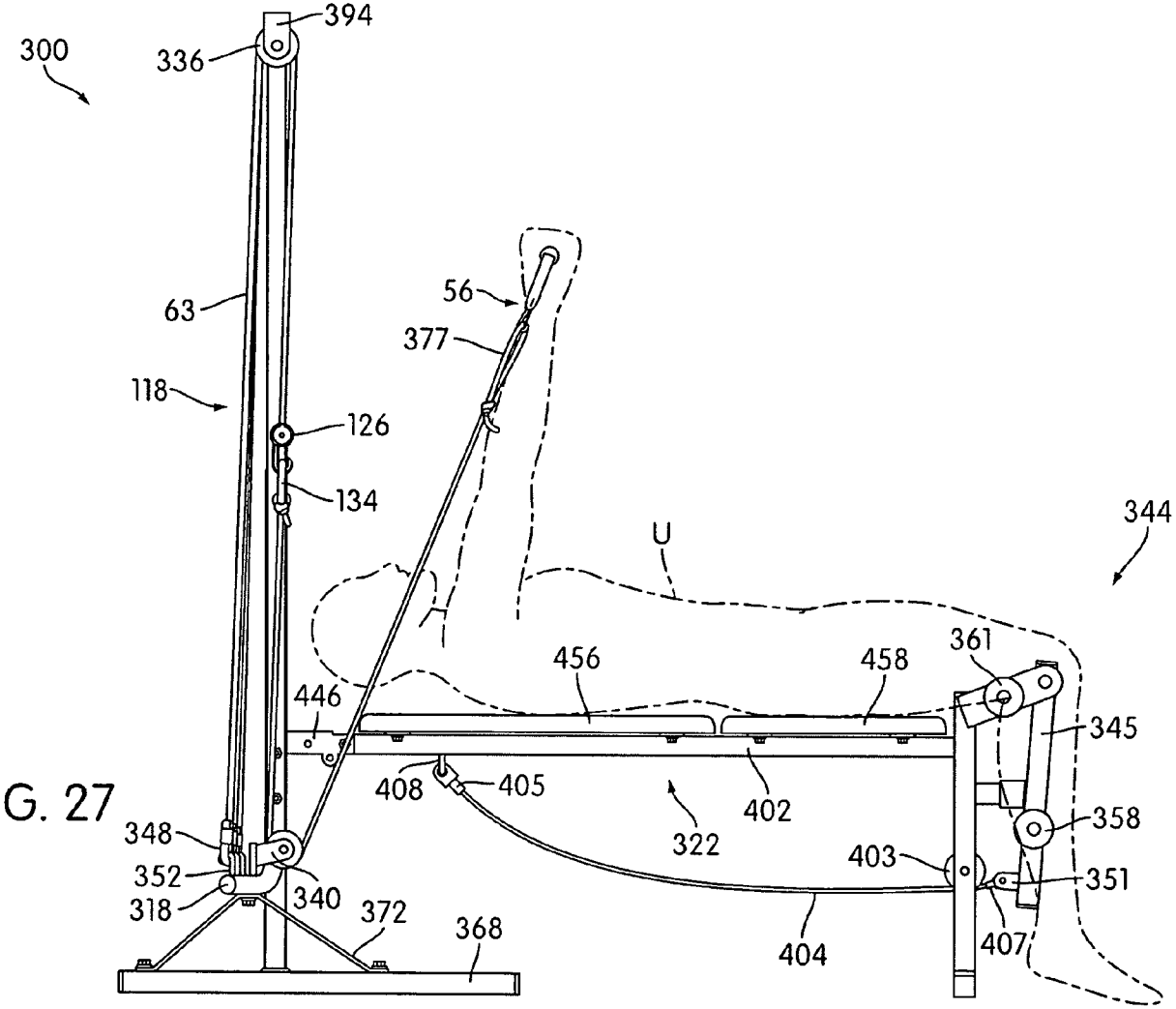
FIG. 27 is a side view of the exerciser of FIG. 15 but showing the hand grip units being extended away from the lower pulley members while a user is effecting a bench press or chest fly exercise.

As shown in FIGS. 25–27, the hand grip units 56, 58 are latched to the looped end portions 377, 378, respectively. The user support assembly 322 is in its inline bench position thereof or outer position thereof so that the user seat member 458 and the seat back member 456 are substantially parallel to the horizontal surface.

The user U may perform various arm, chest and shoulder exercises using the hand grip units 56, 58. For example, a bicep curl is shown in FIG. 25 and may be performed by the user U when he/she is standing above the seat back member 456 with his/her feet straddling the seat back member 456 so as to face the rigid upright support members 306, 308. The user U grasps the hand grip units 56, 58 so that his/her arms are fully extended downwardly and his/her palms face the rigid upright support members 306, 308. Then, the user U would bend his/her arms upwardly at his/her elbows so that the hand grip units 56, 58 would be pulled toward his/her shoulders. The bungee cords 63 resiliently resist this upward movement to exercise the bicep muscle of the user's arm.

As shown in FIG. 26, a military or shoulder press may be performed to exercise the arms and shoulders of the user U. First, the user U repositions himself/herself so as to be facing the leg-engaging unit 344 in a seated position on the seat back member 456. Then, the user U grasps the hand grip units 56, 58 with an over the handle grip and bends his/her arms so to position them laterally and inline with his/her shoulders with his/her palms face upwardly. The user U would then extend the hand grip units 56, 58 above his/her head so to extend his/her arms against the resistance of the bungee cords 63.

As best shown in FIG. 27, a bench press exercise and/or a chest fly exercise may be performed to exercise certain arm, chest and shoulder muscles. The chest fly exercise may be performed with the user U in a seated position on the user support assembly 322 facing the leg-engaging unit 344. To perform the chest fly exercise, the user U would grasp the hand grip units 56, 58 and laterally extend his/her arms so that the hand grip units 56, 58 are extended away from his/her chest. Then, the user U moves the hand grip units 56, 58 in an forwardly arcuate, sweeping motion so as to bring the hand grip units 56, 58 together in front of his/her chest against the resilient resistance of the bungee cords 63. The user U would resist the resilient bias of the bungee cords 63 as he/she move his/her arms back to the laterally extended position in a rearwardly arcuate, sweeping motion.

Another exercise that may be performed with the user U sitting in the user seat assembly 322 is a bench press exercise, which exercises the arms and chest of the user U. The user U would grasp the hand grip units 56, 58 with an over the hand grip and bends his/her arms so to position them laterally and inline with his/her shoulders with his/her palms face forwardly. The user U would then extend the hand grip units 56, 58 forwardly away from his/her chest so to extend his/her arms against the resistance of the bungee cords 63.

To perform arm, chest and shoulder exercises with the upright pull down assembly 360, the user U may connect the latching mechanism 177 through the opening 173 in the hand grip bar 172 to secure the hand grip bar 172 to the elongated flexible non-extensible element 416. Alternatively, the user U may remove the hand grip bar 172 from the J-shaped supporting elements 422, if the hand grip bar 172 is already connected to the upright pull down assembly 360.

As best shown in FIG. 24, the user U may sit in a seated position on the seat back member 456 so as to face the rigid upright support members 306, 308. In this seated position, the user U may perform a lat pull down or other arm pull down exercise, where the user U grasps the hand grip bar 172, slightly leans toward the leg-engaging unit 344, and pulls the hand grip bar 172 towards his/her chest or abdomen. Alternatively, another pull down exercise can be performed by the user U sitting vertically on the seat back member 456 and pulling the hand grip bar 172 toward the back of his/her neck. The user U may also perform the lat pull down exercise while facing the leg-engaging unit 344 in this seated position.

In the exemplary workout, the user U may then sit up from his/her seated position on the seat back member 456 so as to stand above the user seat member 458 with his/her feet straddling the user seat member 458, facing the rigid upright support members 306, 308. To perform the tricep pull down exercise (not shown), the user U manually grasps the hand grip bar 172 with an over the handle grip so that the user's arms are bent at an angle equal to or less than 90 degrees. As the user extends his/her arms downwardly so as to straighten his/her arms, the hand grip bar 172 is moved from the normal inoperative position thereof to the extended position thereof against the resilient resistance of the bungee cords 63 to exercise the user's triceps muscle.

To perform arm, chest and shoulder exercises with the pull down bar 365, the user U may connect the pull down bar 365 to the bungee cords 63 as described above. As best shown in FIG. 23, the user U may sit in a seated position on the seat back member 456 so as to face the rigid upright support members 306, 308. In this seated position, the user U may perform arm pull down exercises, where the user U grasps the handle portions 430 of the pull down bar 365, slightly leans toward the leg-engaging unit 344, and pulls the pull down bar 365 towards his/her chest or abdomen.

Alternatively, another pull down exercise can be performed by the user U sitting vertically on the seat back member 456 and pulling the pull down bar 365 toward the back of his/her neck. The user U may also perform a lat pull down exercise while facing the leg-engaging unit 344 in this seated position. As with the upright pull down assembly 360, a tricep pull down exercise, as described above, can be effected with the pull down bar 365.

Figure 31:
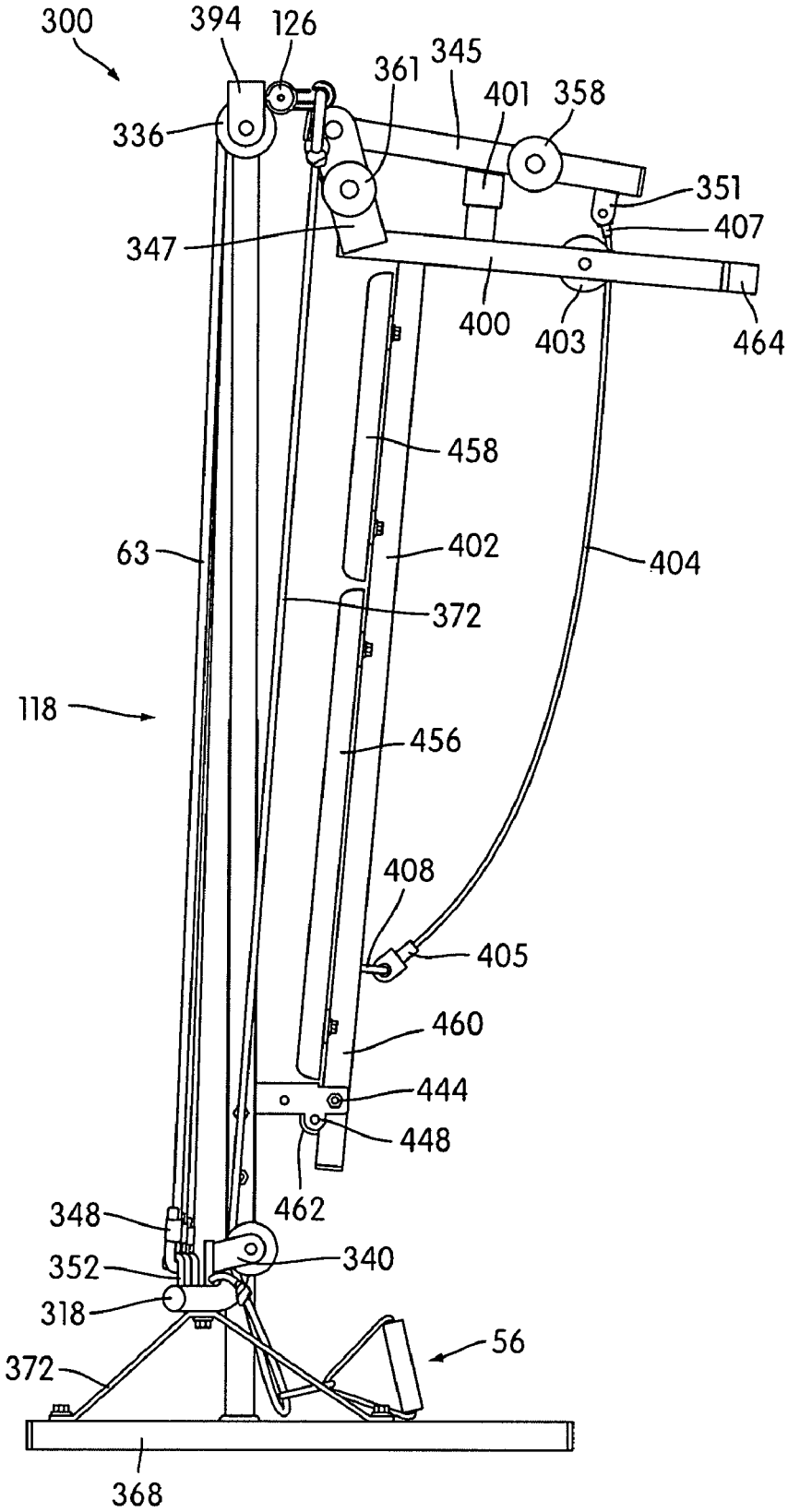
FIG. 31 is a side view of the exerciser of FIG. 15 showing the user seat assembly in an upright storage position thereof.
Figure 32:
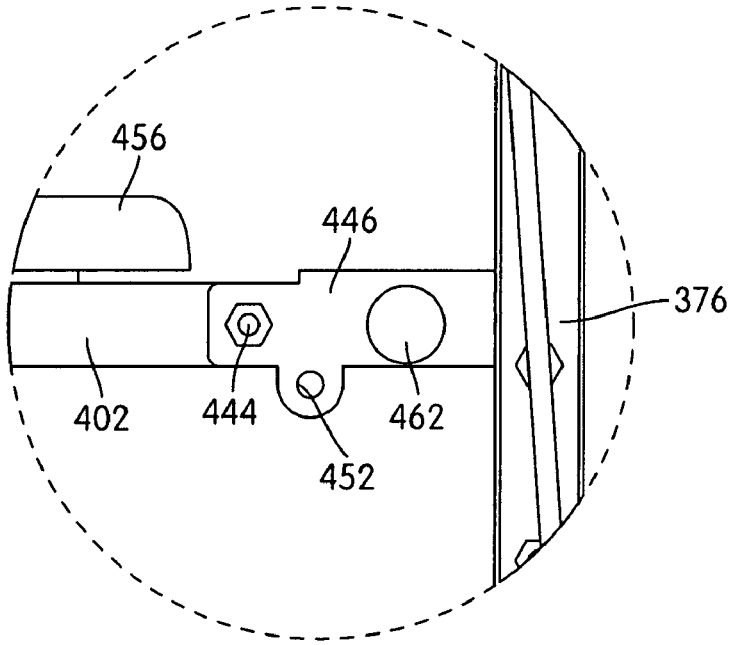
FIG. 32 is an enlarged view of a pivot mechanism of the exerciser of FIG. 15 when the user seat assembly is in the inline bench position thereof.
Figure 33:
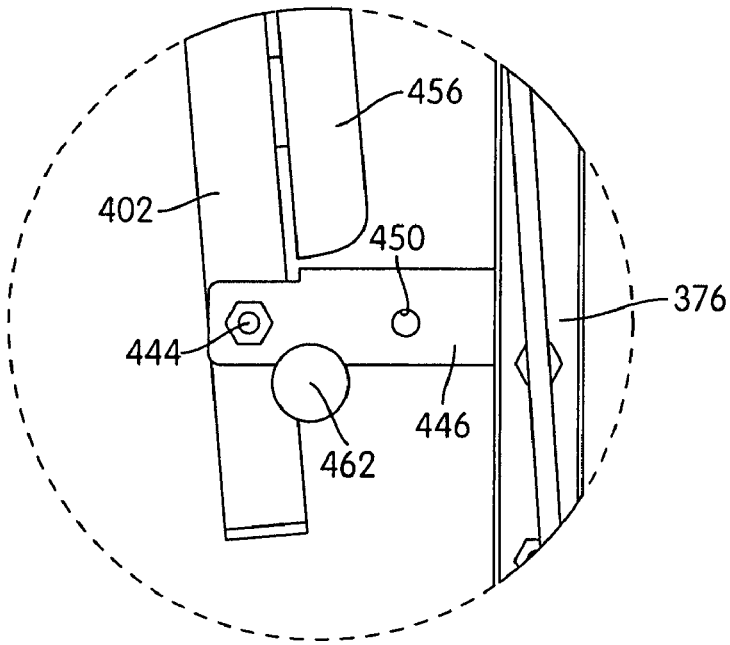
FIG. 33 is an enlarged view of a pivot mechanism of the exerciser of FIG. 15 when the user seat assembly is in the upright storage position thereof.

It may be preferable for the exerciser 300 to be stored in the storage position thereof after the user U completes his/her workout (FIGS. 31–33). In this case, the user U might remove the removable pin 462 from the holes 450. Then, the user U pivots the user support assembly 322 with respect to the frame assembly 302 about the pivoted frame bracket member 446. This pivotal movement positions the user support assembly 322 substantially parallel to the mounting support member 376 such that the user support assembly 322 is spaced from the mounting support member 376. The user may then insert the removable pin 462 through the holes 448 to hold or retain the user support assembly substantially parallel to the mounting support member 376 in its storage position.

For example, the user U may lift the outer leg structure 400 upwardly such that the elongated support member 402 pivots within the pivoted frame bracket member 446. The hand grip bar 172 may also be supported in the J-shaped supporting elements 422 if needed or may be removed therefrom.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. An exerciser comprising:

a frame assembly including a lower frame portion constructed and arranged to be stably supported in an operative position on a horizontal surface and rigid upright frame structure defining laterally spaced left and right free end portions;

a user support assembly operatively connected with said lower frame portion constructed and arranged to support a user thereon; and left and right moving assemblies disposed in normal inoperative positions with respect to said user support assembly constructed and arranged to be manually engaged and individually manually moved away from the normal inoperative position thereof into a desired extended position by a user supported on said user support assembly, said left and right moving assemblies comprising:

left and right upper pulley members rotatably mounted on the left and right upper free end portions of said rigid upright frame structure respectively;

left and right lower pulley members rotatably mounted on said frame assembly at fixed positions below said upper pulley members respectively;

left and right flexible elongated structures trained around said left and right upper and lower pulley members respectively;

left and right user hand grip units connected with left and right end portions of said left and right flexible elongated structures extending in positions to enable a user supported on said user support assembly to move said left and right user hand grip units away from inoperative positions thereof into desired extended positions;

said left and right flexible elongated structures including left and right series of bungee cords having fixed ends and movable ends provided with (1) stop structure thereon for engaging cooperating stop structure associated with left and right pulley members respectively so as to determine inoperative positions thereof and enable resilient movements therefrom to desired extended positions and to resiliently return said left and right user hand grip units to the inoperative positions thereof when no longer moved by the user and (2) connector structure outwardly of said stop structure;

left and right connecting structure on said frame assembly constructed and arranged to enable the fixed end of said left and right series of bungee cords to be fixed in selected fixed positions on said frame assembly so as to extend upwardly from the fixed positions and around the upper left and right pulley members, respectively;

said left and right hand grip units having cooperating connector structure selectively connectable with the connector structure of said bungee cords so as to enable the user to connect the left and right hand grip units to any number of bungee cords in the left and right series of bungee cords and thereby select different resilient bias of said left and right series of bungee cords when in the inoperative and extended positions thereof.

2. An exerciser as defined in claim 1, wherein the connector structure of said left and right hand grip units include left and right triangular shaped terminal connectors, respectively.

3. An exerciser as defined in claim 2, wherein said cooperating stop structure is associated with said left and right upper pulley members respectively.

4. An exerciser as defined in claim 2, further comprising a pull down bar constructed and arranged to be gripped by one or both hands of a user and to be moved through exercising strokes, said movable ends of said left and right bungee cords being selectively connected to said pull down bar or said left and right hand grip units for movement through operative strokes in response to the exercising strokes of said pull down bar or said left and right hand grip units by the user.

5. An exerciser as defined in claim 4, wherein said left and right flexible elongated structures include left and right flexible elongated non-extensible members each having one end connected to respective movable ends of said left and right bungee cords and having another end trained around respective left and right lower pulley members.

6. An exerciser as defined in claim 2, further comprising a upright pull down unit connected to the frame assembly and including a centrally supported pull down member constructed and arranged to be engaged by one or both hands of a user and to be moved through exercising strokes, said left and right bungee cords being selectively connected to said left and right hand grip units respectively or to said upright pull down unit for movement through operative strokes in response to the exercising strokes of said left and right hand grip units and the exercising strokes of the pull down member of said upright pull down unit by the user.

7. An exerciser as defined in claim 6, wherein the upright pull down unit includes a central frame member fixed to said lower frame portion and extending upwardly therefrom and a centrally located pulley member on said central frame member disposed between said left and right free end portions and a central flexible elongated non-extensible member trained over said centrally located pulley member fixed to said centrally supported pull down member, and wherein the left and right lower pulley members are rotatably mounted on said frame assembly such that the left and right flexible elongated non-extensible members are selectively connectable to said central flexible elongated non-extensible member.

8. An exerciser as defined in claim 3, further comprising a leg unit having a leg-engaging member constructed and arranged to be engaged by a leg or legs of a user and to be moved through exercise strokes, said left and right bungee cords being selectively connected to said left and right hand grip units respectively or to said leg unit for movement through operative strokes in response to the exercising strokes of said left and right hand grip units and the exercising strokes of the leg-engaging member of said leg unit by the user.

9. An exerciser as defined in claim 8, wherein said leg unit includes unit structure pivoted to an outer end portion of said user support assembly, and having an elongated flexible non-extensible element connected thereto, said leg-engaging member including one of a pair of horizontally aligned and fixedly spaced leg-engaging members pivotally movable with said unit structure from a normal inoperative position disposed outwardly of said user support assembly wherein a user supported on said user support assembly in enabled to engage lower forwardly facing portions of the user's legs therewith and move said pair of leg-engaging members thereby from said inoperative position to an extended position spaced upwardly and outwardly from the inoperative position thereof.

10. An exerciser as defined in claim 8, further comprising a upright pull down unit connected to the frame assembly and constructed and arranged to be engaged by one or both hands of a user and to be moved through exercising strokes, said left and right bungee cords being selectively connected to said left and right hand grip units respectively, said leg unit or to said upright pull down unit for movement through operative strokes in response to the exercising strokes of said left and right hand grip units, the exercising strokes of the leg unit and the exercising strokes of said upright pull down unit by the user.

11. An exerciser as defined in claim 1, wherein said cooperating stop structure is associated with said left and right lower pulley members respectively.

12. An exerciser as defined in claim 11, further comprising a leg unit having a leg engaging member constructed and arranged to be engaged by a leg or legs of a user and to be moved through exercise strokes, said left and right bungee cords being selectively connected to said left and right hand grip units respectively or to said leg unit for movement through operative strokes in response to the exercising strokes of said left and right hand grip units and the exercising strokes of the leg-engaging member of said leg unit by the user.

13. An exerciser as defined in claim 12, wherein said leg unit includes unit structure pivoted to an outer end portion of said user support assembly, and having an elongated flexible non-extensible element connected thereto, said leg-engaging member including one of a pair of horizontally aligned and fixedly spaced leg-engaging members pivotally movable with said unit structure from a normal inoperative position disposed outwardly of said user support assembly wherein a user supported on said user support assembly in enabled to engage lower forwardly facing portions of the user's legs therewith and move said pair of leg-engaging members thereby from said inoperative position to an extended position spaced upwardly and outwardly from the inoperative position thereof.

14. An exerciser as defined in claim 1, wherein said user support assembly includes:

a user seat member;

a user seat back member;

an elongated support member having one end connected to said upright frame assembly and extending in an operative position generally horizontally outwardly therefrom;

an outer leg structure constructed and arranged to engage and be supported on the horizontal surface in spaced relation to said frame extending in an operative position in supporting relation with respect to said elongated support member to maintain the elongated support member in said generally horizontally outwardly extending relation from said lower frame portion, seat mounting structure constructed and arranged to mount said user seat member for movement horizontally with respect to said elongated support member when in the operative position thereof between an outer position and an inner position and spaced inwardly of and at generally the same level as said outer position;

seat back mounting structure disposed in supporting relation to said seat back member constructed and arranged to be moved between a bench position extending in generally horizontally aligned relation to said user seat member and an upright position extending generally inwardly in inclined relation to said user seat member in response to the movement of said user seat member between the outer and inner positions thereof respectively.

15. An exerciser as defined in claim 1, said rigid upright frame structure includes left and right rigid upright support members fixed at lower end portions thereof on said lower frame portion and extending upwardly from said lower frame portion when in the operative position thereof, said laterally spaced left and right free end portions being disposed above said lower frame portion in outwardly diverging relation with respect to one another.

16. An exerciser as defined in claim 1, further comprising a leg unit having a leg engaging member constructed and arranged to be engaged by a leg or legs of a user and to be moved through exercise strokes, wherein said left and right flexible elongated structures trained around said left and right lower pulley members are selectively connected to said left and right hand grip units respectively or to said leg unit for movement through operative strokes in response to the exercising strokes of said left and right hand grip units and the exercising strokes of the leg-engaging member of said leg unit by the user.

17. An exerciser as defined in claim 16, further comprising a upright pull down unit connected to the frame assembly and constructed and arranged to be engaged by one or both hands of a user and to be moved through exercising strokes, wherein said left and right flexible elongated structures trained around said left and right lower pulley members are selectively connected to said leg unit or to said upright pull down unit for movement through operative strokes in response to the exercising strokes of said leg unit and the exercising strokes of said upright pull down unit by the user.

18. An exerciser as defined in claim 1, further comprising a pull down bar constructed and arranged to be gripped by one or both hands of a user and to be moved through exercising strokes, wherein said left and right flexible elongated structures trained around said left and right upper pulley members are selectively connected to said left and right hand grip units respectively or to said pull down bar for movement through operative strokes in response to the exercising strokes of said left and right hand grip units and the exercising strokes of said pull down bar by the user.

19. An exerciser as defined in claim 1, wherein said connecting structure with respect to each left and right bungee cord comprises a hook connector.

20. An exerciser as defined in claim 19, wherein said hook connectors are movable with respect to the frame assembly such that the fixed end of said left and right bungee cords can be moved into selected fixed positions on said frame assembly which provide selected different resilient bias of said bungee cords.

21. An exerciser comprising:

a frame assembly including a lower frame portion constructed and arranged to be stablely supported in an operative position on a horizontal surface, a central upright portion fixed to said lower frame portion and extending upwardly therefrom, and left and right rigid upright support members fixed at lower end portions thereof on said central upright frame portion and extending upwardly therefrom when in the operative position thereof, said left and right rigid upright support members having integral laterally spaced left and right upper free ends disposed above said lower frame portion in outwardly diverging relation with respect to one another;

a user support assembly operatively connected with said lower frame portion constructed and arranged to support a user thereon; and left and right moving assemblies disposed in normal inoperative positions with respect to said user support assembly constructed and arranged to be manually engaged and individually manually moved away from the normal inoperative position thereof into a desired extended position by a user supported on said user support assembly, said left and right moving assemblies comprising:

left and right upper pulley members rotatably mounted on the left and right upper free end portions of said left and right rigid upright support members respectively;

left and right lower pulley members rotatably mounted on said frame assembly at fixed positions below said upper pulley members respectively;

left and right flexible elongated structures trained around said left and right upper and lower pulley members respectively;

left and right user hand grip units connected with left and right end portions of said left and right flexible elongated structures extending in positions to enable a user supported on said user support assembly to move said left and right user hand grip units away from inoperative positions thereof into desired extended positions;

said left and right flexible elongated structures including left and right bungee cords having fixed ends fixed directly to said frame structure and movable ends provided with stop structure thereon for engaging cooperating stop structure associated with left and right pulley members respectively so as to determine inoperative positions thereof and enable resilient movements therefrom to desired extended positions and to resiliently return said left and right user hand grip units to the inoperative positions thereof when no longer moved by the user.

22. An exerciser as defined in claim 21, wherein said left and right hand grip units are connected with said left and right flexible elongated structures by left and right terminal connectors, respectively.

23. An exerciser as defined in claim 22, wherein said left and right bungee cords comprise left and right series of bungee cords, each bungee cord of each series includes a hook connector selectively connectable with respective left and right terminal connectors enabling each bungee cord of each series to be selectively retained in said inoperative position or in connected relationship with the associated terminal connector to thereby vary the resilient resistance provided by the bungee cords.

24. An exerciser as defined in claim 22, wherein said cooperating stop structure is associated with said left and right upper pulley members respectively.

25. An exerciser as defined in claim 22, further comprising a pull down bar constructed and arranged to be gripped by one or both hands of a user and to be moved through exercising strokes, said movable ends of said left and right bungee cords being selectively connected to said pull down bar or said left and right hand grip units for movement through operative strokes in response to the exercising strokes of said pull down bar or said left and right hand grip units by the user.

26. An exerciser as defined in claim 25, wherein said left and right flexible elongated structures include left and right flexible elongated non-extensible members each having one end connected to respective movable ends of said left and right bungee cords and having another end trained around respective left and right lower pulley members.

27. An exerciser as defined in claim 26, further comprising a upright pull down unit connected to the frame assembly and including a centrally supported pull down member constructed and arranged to be engaged by one or both hands of a user and to be moved through exercising strokes, said left and right bungee cords being selectively connected to said left and right hand grip units respectively or to said upright pull down unit for movement through operative strokes in response to the exercising strokes of said left and right hand grip units and the exercising strokes of said upright pull down unit by the user.

28. An exerciser as defined in claim 24, further comprising a leg unit having a leg engaging member constructed and arranged to be engaged by a leg or legs of a user and to be moved through exercise strokes, said left and right bungee cords being selectively connected to said left and right hand grip units respectively or to said leg unit for movement through operative strokes in response to the exercising strokes of said left and right hand grip units and the exercising strokes of the leg engaging member of said leg unit by the user.

29. An exerciser as defined in claim 28, wherein said leg unit includes unit structure pivoted to an outer end portion of said user support assembly, and having an elongated flexible non-extensible element connected thereto, said leg-engaging member including one of a pair of horizontally aligned and fixedly spaced leg-engaging members pivotally movable with said unit structure from a normal inoperative position disposed outwardly of said user support assembly wherein a user supported on said user support assembly in enabled to engage lower forwardly facing portions of the user's legs therewith and move said pair of leg-engaging members thereby from said inoperative position to an extended position spaced upwardly and outwardly from the inoperative position thereof.

30. An exerciser as defined in claim 28, further comprising a upright pull down unit connected to the frame assembly and constructed and arranged to be engaged by one or both hands of a user and to be moved through exercising strokes, said left and right bungee cords being selectively connected to said left and right hand grip units respectively, said leg unit or to said upright pull down unit for movement through operative strokes in response to the exercising strokes of said left and right hand grip units, the exercising strokes of the leg unit and the exercising strokes of said upright pull down unit by the user.

31. An exerciser as defined in claim 22, wherein said cooperating stop structure is associated with said left and right lower pulley members respectively.

32. An exerciser as defined in claim 31, further comprising a leg unit having a leg engaging member constructed and arranged to be engaged by a leg or legs of a user and to be moved through exercise strokes, said left and right bungee cords being selectively connected to said left and right hand grip units respectively or to said leg unit for movement through operative strokes in response to the exercising strokes of said left and right hand grip units and the exercising strokes of said leg unit by the user.

33. An exerciser as defined in claim 32, wherein said leg-engaging unit is pivoted to an outer end portion of said user support assembly with which an elongated flexible non-extensible element is connected, said leg-engaging unit having a pair of horizontally aligned and fixedly spaced leg-engaging members pivotally movable therewith from a normal inoperative position disposed outwardly of said user support assembly wherein a user supported on said user support assembly in enabled to engage lower forwardly facing portions with legs and move said leg-engaging members thereby from said inoperative position to an extended position spaced upwardly and outwardly from the inoperative position thereof.

34. An exerciser comprising:

a frame assembly including a lower frame portion constructed and arranged to be stablely supported in an operative position on a horizontal surface, a central upright frame portion fixed to and extending upwardly from said lower frame portion, left and right rigid upright support members fixed at lower end portions thereof on said central upright frame portion and extending upwardly therefrom when in the operative position thereof, said left and right rigid upright support members having integral laterally spaced left and right upper free ends disposed above said lower frame portion in outwardly diverging relation with respect to one another;

a user support assembly operatively connected with said frame assembly and constructed and arranged to support a user thereon, said user support assembly including:

a user seat member;

a user seat back member;

an elongated support member having one end connected to said central upright frame portion and extending in an operative position generally horizontally outwardly therefrom;

an outer leg structure constructed and arranged to engage and be supported on the horizontal surface in spaced relation to said frame assembly extending in an operative position in supporting relation with respect to said elongated support member to maintain the elongated support member in said generally horizontally outwardly extending relation from said central upright frame portion, seat back mounting structure operatively associated with said seat back member on said elongated support member constructed and arranged to enable said seat back member to be selectively retained in a bench position extending in generally horizontally aligned relation to said user seat member in an outer position thereof and an upright position extending generally inwardly in inclined relation to said user seat member in an inner position thereof, the one end of said elongated support member being pivotally mounted on an outwardly extending mounting bracket fixed to said central upright frame portion so as to be moved between the operative position thereof and an upright storage position wherein said elongated support member, said outer leg structure and said seat and seat back members are alongside said central upright frame portion; and left and right moving assemblies disposed in normal inoperative positions with respect to said user support assembly constructed and arranged to be manually engaged and individually manually moved away from the normal inoperative position thereof into a desired extended position by a user supported on said user support assembly, said left and right moving assemblies having left and right portions operatively associated with cooperating structure on said left and right upper free ends said left and right portions further including left and right upper pulley members and said left and right moving assemblies include left and right flexible elongated structure including a series of bungee cords, and including flexible elongated structures trained over respective left and right pulley's.

35. An exerciser as defined in claim 34, including left and right hand grip units connected with said left and right flexible elongated structures by left and right terminal connectors, respectively.

36. An exerciser as defined in claim 35, wherein, each bungee cord of each series includes a hook connector selectively connectable with respective left and right terminal connectors enabling each bungee cord of each series to be selectively retained in said inoperative position or in connected relationship with the associated terminal connector to thereby vary the resilient resistance provided by the bungee cords.

37. An exerciser as defined in claim 35, wherein said cooperating stop structure is associated with said left and right upper pulley members respectively.

38. An exerciser as defined in claim 35, further comprising a pull down bar constructed and arranged to be gripped by one or both hands of a user and to be moved through exercising strokes, said movable ends of said left and right bungee cords being selectively connected to said pull down bar or said left and right hand grip units for movement through operative strokes in response to the exercising strokes of said pull down bar or said left and right hand grip units by the user.

39. An exerciser as defined in claim 38, wherein said left and right flexible elongated structures include left and right flexible elongated non-extensible members each having one end connected to respective movable ends of said left and right bungee cords and having another end trained around respective left and right lower pulley members.

40. An exerciser as defined in claim 39, further comprising a upright pull down unit connected to the frame assembly and including a centrally supported pull down member constructed and arranged to be engaged by one or both hands of a user and to be moved through exercising strokes, said left and right bungee cords being selectively connected to said left and right hand grip units respectively or to said upright pull down unit for movement through operative strokes in response to the exercising strokes of said left and right hand grip units and the exercising strokes of said upright pull down unit by the user.

41. An exerciser as defined in claim 40, wherein the upright pull down unit includes a central frame member fixed to said lower frame portion and extending upwardly therefrom and a centrally located pulley member on said central frame member disposed between said left and right free end portions and a central flexible elongated non-extensible member trained over said centrally located pulley member fixed to said centrally supported pull down member, and wherein the left and right lower pulley members are rotatably mounted on said frame assembly such that the left and right flexible elongated non-extensible members are selectively connectable to said central flexible elongated non-extensible member.

42. An exerciser as defined in claim 37, further comprising a leg unit having a leg engaging member constructed and arranged to be engaged by a leg or legs of a user and to be moved through exercise strokes, said left and right bungee cords being selectively connected to said left and right hand grip units respectively or to said leg unit for movement through operative strokes in response to the exercising strokes of said left and right hand grip units and the exercising strokes of said leg unit by the user.

43. An exerciser as defined in claim 42, wherein said leg-engaging unit is pivoted to an outer end portion of said user support assembly with which an elongated flexible non-extensible element is connected, said leg-engaging unit having a pair of horizontally aligned and fixedly spaced leg-engaging members pivotally movable therewith from a normal inoperative position disposed outwardly of said user support assembly wherein a user supported on said user support assembly in enabled to engage lower forwardly facing portions with legs and move said leg-engaging members thereby from said inoperative position to an extended position spaced upwardly and outwardly from the inoperative position thereof.

44. An exerciser as defined in claim 42, further comprising a upright pull down unit connected to the frame assembly and constructed and arranged to be engaged by one or both hands of a user and to be moved through exercising strokes, said left and right bungee cords being selectively connected to said left and right hand grip units respectively, said leg unit or to said upright pull down unit for movement through operative strokes in response to the exercising strokes of said left and right hand grip units, the exercising strokes of the leg unit and the exercising strokes of said upright pull down unit by the user.

45. An exerciser as defined in claim 35, wherein said cooperating stop structure is associated with said left and right lower pulley members respectively.

46. An exerciser as defined in claim 45, further comprising a leg unit having a leg engaging member constructed and arranged to be engaged by a leg or legs of a user and to be moved through exercise strokes, said left and right bungee cords being selectively connected to said left and right hand grip units respectively or to said leg unit for movement through operative strokes in response to the exercising strokes of said left and right hand grip units and the exercising strokes of the leg engaging member of said leg unit by the user.

47. An exerciser as defined in claim 46, wherein said leg unit includes unit structure pivoted to an outer end portion of said user support assembly, and having an elongated flexible non-extensible element connected thereto, said leg-engaging member including one of a pair of horizontally aligned and fixedly spaced leg-engaging members pivotally movable said unit structure from a normal inoperative position disposed outwardly of said user support assembly wherein a user supported on said user support assembly in enabled to engage lower forwardly facing portions of the user's legs therewith and move said pair of leg-engaging members thereby from said inoperative position to an extended position spaced upwardly and outwardly from the inoperative position thereof.

48. An exerciser as defined in claim 34, wherein said seat back member and said user seat member are movable in response to one another when (1) said seat back member is selectively retained in the bench position thereof and said user seat member is in the outer position thereof and when (2) said seat back member is selectively retained in the an upright position thereof and said user seat member is in an inner position thereof.

49. An exerciser as defined in claim 19, wherein said hook connectors are fixed to said frame assembly at generally the same horizontal level.

50. An exerciser as defined in claim 19, wherein said hook connectors are fixed to said frame assembly in vertically spaced relation.

* * * * *